US007914633B1

(12) United States Patent
Barrett et al.

(10) Patent No.: US 7,914,633 B1
(45) Date of Patent: Mar. 29, 2011

(54) WHITE PROPELLANT COMPOSITIONS

(75) Inventors: G Dean Barrett, Kansas City, MO (US); Terry M Dielh, Alta Vista, KS (US); Thomas W Bowen, Shawnee, KS (US)

(73) Assignee: Hodgdon Powder Company, Inc., Shawnee Mission, KS (US)

( * ) Notice: Subject to any disclaimer, the term of this patent is extended or adjusted under 35 U.S.C. 154(b) by 623 days.

(21) Appl. No.: 11/870,383

(22) Filed: Oct. 10, 2007

Related U.S. Application Data

(63) Continuation-in-part of application No. 10/352,542, filed on Jan. 28, 2003, now Pat. No. 7,344,610.

(51) Int. Cl.

| | |
|---|---|
| ***C06B 31/00*** | (2006.01) |
| ***C06B 31/02*** | (2006.01) |
| ***C06B 31/08*** | (2006.01) |
| ***C06B 29/00*** | (2006.01) |
| ***C06B 29/02*** | (2006.01) |
| ***D03D 23/00*** | (2006.01) |
| ***D03D 43/00*** | (2006.01) |

(52) U.S. Cl. ..... 149/45; 149/61; 149/70; 149/75; 149/77; 149/109.4

(58) Field of Classification Search ..... 149/83, 149/45, 61, 70, 75, 77, 109.4
See application file for complete search history.

(56) References Cited

U.S. PATENT DOCUMENTS

| | | | | |
|---|---|---|---|---|
| 4,128,443 | A * | 12/1978 | Pawlak et al. | 149/71 |
| 4,497,676 | A | 2/1985 | Kurtz | |
| 4,728,376 | A | 3/1988 | Kurtz | |
| 5,449,423 | A | 9/1995 | Cioffe | |
| 5,542,997 | A * | 8/1996 | Zeuner et al. | 149/35 |
| 5,569,875 | A | 10/1996 | Fey | |
| 5,633,476 | A | 5/1997 | Cioffe | |
| 6,688,232 | B2 * | 2/2004 | Griesbach et al. | 102/288 |
| 2004/0011235 | A1 * | 1/2004 | Callaway et al. | 102/336 |

* cited by examiner

*Primary Examiner* — James E McDonough
(74) *Attorney, Agent, or Firm* — Joseph B Bowman

(57) ABSTRACT

Sulfur-free and carbon-free, white propellant compositions for use as a blackpowder substitute in firearms, munitions, and pyrotechnics to form combustion byproducts that are water soluble and are free of corrosive sulfur compounds and black carbon residues. Formulations include a fuel agent selected from the group consisting of sodium benzoate, lactose, sodium salicylate, sodium m-nitrobenzoate, and mixtures thereof. The fuel agent is combined with dextrin, potassium nitrate, potassium perchlorate, and tricalcium phosphate. Dicyanodiamide may be incorporated in the formulation as a burn rate modifier.

14 Claims, No Drawings

WHITE PROPELLANT COMPOSITIONS

CROSS-REFERENCE TO RELATED APPLICATIONS

This application is a continuation-in-part of co-pending application Ser. No. 10/352,542, filed Jan. 28, 2003, entitled "Sulfur-Free Propellant Compositions".

STATEMENT REGARDING FEDERALLY SPONSORED RESEARCH OR DEVELOPMENT

None

BACKGROUND OF THE INVENTION

This invention relates to propellants in firearms, munitions, pyrotechnics, and the like. More specifically, this invention relates to a blackpowder substitute which is white in color that forms combustion byproducts that are easily cleaned with water and that are free of corrosive sulfur compounds and of black residues.

Blackpowder was one of the first materials that could be used as a propellant, an explosive, and in pyrotechnic devices. The Chinese are credited with its development many centuries ago. As blackpowder characteristics became known, its uses expanded. It was first used in cannons and hand cannons in Europe in the $14^{th}$ century. It began to be used in civil engineering projects in the $16^{th}$ century and in coal mining operations during the $17^{th}$ century. The forerunner of today's muzzleloading guns, the matchlock musket, was also invented in the $16^{th}$ century. Following that matchlock, further developments in firearms made the use of blackpowder more effective and convenient. In rapid succession, better ignition systems were developed with both the wheellock and the flintlock during the $16^{th}$ century. The percussion cap firearm, similar to that used today, was not developed until the $19^{th}$ century.

Thus, for hundreds of years, blackpowder remained unchallenged as the only material of its type. Inventors directed their efforts to making better use of blackpowder. With the advent of nitro-cellulose smokeless powder in the latter part of the 19th century, blackpowder lost its preeminence as the only gun propellant. Smokeless powder burned cleaner and produced more energy than did blackpowder, and it was safer to use and handle. However, because of blackpowder's lower gun barrel pressures, ignition characteristics, and low cost of manufacture, blackpowder retained its place in the market as the only propellant for antique firearms such as muzzleloaders and the preferred material for use in fuse manufacture, ignition devices, cannon round igniters, fireworks, and the like.

In 1978, U.S. Pat. No. 4,128,443 was issued to Pawlak and Levenson for Deflagrating Propellant Compositions. Blackpowder was soon no longer the muzzleloading propellant of choice for many sportsmen. The principal product marketed as a result of the Pawlak et. al. patent is known as Pyrodex powder. This product does not detonate and is less prone to accidental ignition than is blackpowder. In addition to being used as a propellant in muzzleloading and cartridge guns, Pyrodex powder has been formulated as a delay powder, a fuse powder, a fireworks powder, and in some military applications. However, Pyrodex is not without its own drawbacks. It does not ignite satisfactorily in flintlock guns and, like blackpowder, it contains sulfur which results in combustion residues that are hard to remove and can cause corrosion if left in the gun barrel.

U.S. Pat. No. 4,497,676 issued in 1985 to Kurtz. It was the first in a number of patents on sulfur-free compositions utilizing potassium nitrate and ascorbic or erythorbic acid. Some of these patents used slurries in the manufacture thus requiring the subsequent removal of large quantities of water. Others required cooking or heating with the attendant high production cost and hazard. Many of these products had low energy content and were very hygroscopic with the result that the product coagulated in the container, becoming a single, unusable lump.

Cioffe further expanded on the use of ascorbic or erythorbic acid in U.S. Pat. No. 5,449,423 by adding potassium perchlorate. This product had reduced hygroscopicity and higher energy, however, it requires high energy inputs during manufacture for compaction and subsequent granulation. The resulting product has been known to detonate. Other similar products are known that have the same bad characteristics.

Several factors have combined to increase the market for a clean burning, high performance propellant composition. Deer population in many states has grown substantially due to good conservation management, and these states now have separate seasons for muzzleloading guns during a so-called primitive weapons season, as well as a regular season for conventional, high powered firearms. The same is true in many western states having elk herds. Due to the growing popularity of muzzleloaders, gun manufacturers have developed the "in-line" rifle which gives better ignition than the side-hammer percussion rifle, and these weapons are made to withstand higher gun barrel pressures. When Pyrodex powder was first introduced, the most popular projectile was the patched round ball. Today, modern projectiles using plastic sabots with a metal jacketed bullet are gaining acceptance and higher velocities are desirable.

The demand is growing for propellant compositions that will keep pace with expanding market of shooters and sportsmen having an interest in muzzleloading type weaponry. At the same time, the need remains for propellant compositions which solve the many disadvantages and drawbacks of corrosiveness and cleaning difficulty associated with blackpowder and conventional blackpowder substitutes such as Pyrodex powder. The primary objective of this invention is to meet these needs.

SUMMARY OF THE INVENTION

More specifically, an object of the invention is to provide a propellant composition as a sulfur free deflagrating gas generating formulation to eliminate the presence of corrosive, sulfur-containing byproducts of combustion.

A corollary object of the invention is to provide a propellant composition as a sulfur free substitute for conventional blackpowder and which may be loaded in firearms on a volumetric basis similar to the way that blackpowder is loaded, rather than on a weight basis.

Another object of the invention is to provide a propellant composition of the character described which is white in color and free of elemental carbon to eliminate the presence of black residues associated with conventional blackpowder and blackpowder substitutes.

Another object of the invention is to provide a propellant composition for which the combustion byproducts may be readily removed with water to provide easy cleanup of weaponry in which such propellant composition is utilized.

Another object of the invention is to provide a propellant composition of the character described which forms water soluble combustion products free of sulfur-containing compounds and of black carbonaceous residues.

An additional object of the invention is to provide a propellant composition of the character described with significant water formation in the combustion products as compared to blackpowder in order to facilitate cleaning of the firearm.

A further object of the invention is to provide a propellant composition of the character described having reliable and consistent performance characteristics of good ignition, no detonation, good burn rate, low hygroscopic properties, reasonable time to peak pressure, adequate fouler pressure, moderate peak pressure, and reproducible velocity performance and ballistics.

Yet another object of the invention is to provide a propellant composition of the character described which can be manufactured from readily available chemicals, can be safely handled and stored, has an adequate shelf life, and can be manufactured in a modern gunpowder plant within industry standards for safety, handling, manufacture and storage.

In summary, an object of the invention is to provide sulfur-free and carbon-free, white propellant compositions for use as a blackpowder substitute in firearms, munitions, and pyrotechnics to form combustion byproducts that are water soluble and are free of corrosive sulfur compounds and black carbon residues. Formulations include a fuel agent selected from the group consisting of sodium benzoate, lactose, sodium salicylate, sodium m-nitrobenzoate, and mixtures thereof. The fuel agent is combined with dextrin, potassium nitrate, potassium perchlorate, and tricalcium phosphate. Dicyanodiamide may be incorporated in the formulation as a burn rate modifier.

Other and further objects of the invention, together with the features of novelty appurtenant thereto, will appear in the following detailed description of the invention.

DETAILED DESCRIPTION OF THE INVENTION

The important benefits of sulfur in various pyrotechnic mixtures such as blackpowder and modern blackpowder substitutes, such as Pyrodex powder as taught in U.S. Pat. No. 4,128,443 incorporated herein by reference, have long been known. However, the significant drawbacks and disadvantages of sulfur in pyrotechnic mixtures for firearms have also long been understood. The presence of sulfur in these prior art mixtures results in sulfur compounds being present in the combustion residue. In the case of blackpowder, such compounds include hydrogen sulfide, potassium sulfate, potassium thiosulfate, and potassium sulfide. In the case of Pyrodex powder, the sulfur-containing byproducts include principally potassium sulfate and potassium thiosulfate. Such sulfur compounds are difficult to remove from gun barrels where repeated use of the firearms without intermediate cleaning is frequently practiced. Without cleaning, such sulfur compounds combine with moisture and are highly corrosive to the metal parts of the firearm.

In both blackpowder and Pyrodex, sulfur is a necessary component. The low melting point of sulfur (i.e., 244° F.) contributes to a lower autoignition temperature and promotes a faster burning rate in propellant mixtures. In the traditional formulation of blackpowder, charcoal represents 15% by weight, potassium nitrate represents 75% by weight and sulfur represents 10% by weight. The autoignition temperature of blackpowder is approximately 580° F. and the burn rate is about 2.3 seconds per inch at atmospheric pressure.

If sulfur is simply removed from blackpowder, in an effort to control production of the corrosive sulfur byproducts, the product is changed dramatically. The autoignition temperature rises from 580 to 750 or higher, the burn rate slows down form 2.3 seconds/inch to more than 4.1 seconds/inch, and the ignition properties become very poor. In other words, the modified blackpowder becomes ineffective for use as a propellant composition.

Although the numbers themselves change, the same relationship holds true for Pyrodex powder. When sulfur is removed from Pyrodex powder, the autoignition temperature rises, the burn rate slows down, and the ignition is poor. Therefore, it has heretofore not been possible to simply eliminate sulfur from Pyrodex powder and still maintain a propellant composition useful in muzzleloading weapons.

We have discovered that sulfur can be eliminated and still maintain a propellant by using a gluconic acid salt or an alkali metal nitrobenzoate salt as an ignition aid to various mixtures of oxidizing and reducing agents known to those skilled in the art. It is also possible to combine these novel formulations with various propellant additives known to those skilled in the gunpowder arts, such as binders, burning rate modifiers, flow agents, colorants, coating agents, moisture retardants and mixtures thereof.

The gluconic acid salts tested in formulations coming within the scope of this invention include sodium gluconate and potassium gluconate. Sodium gluconate has a chemical formula of $C_6H_{11}NaO_7$, a molecular weight of 218.13 and the recognized properties as indicated as reference #8372 of The Merck Index ($9^{th}$ Edition), incorporated herein by reference. The form most commonly used and readily available is sodium D-gluconate. Potassium gluconate has a chemical formula of $C_6H_{11}KO_7$, a molecular weight of 234.24 and the recognized properties as indicated as reference #7413 of The Merck Index ($9^{th}$ Edition).

Within the broad working range of concentrations tested for use as an ignition aid, the gluconic acid salt may be present in the amount of 0 to 45% by weight, is preferably present in the amount of 1 to 25% by weight, and is present in the amount of 2 to 15% by weight in the most likely commercial product applications.

The alkali metal nitrobenzoate salt tested in formulations within the scope of this invention include sodium meta-nitrobenzoate, or sodium 3-nitrobenzoate.

The compound has a chemical formula of $C_7H_4NO_4Na$, a molecular weight of 189.11 and the recognized properties as indicated as reference #6411 of The Merck Index ($9^{th}$ Edition).

Within the broad working range of concentrations tested for use as an ignition aid, the sodium meta-nitrobenzoate may be present in the amount of 0 to 40% by weight, is preferably present in the amount of 1 to 15% by weight, and is present in the amount of 2 to 12% by weight in the most likely commercial product applications.

The oxidizing and reducing or fuel agents useful in the formulations of this invention include carbon, sugars, nitrate salts, perchlorate salts, benzoate salts, and mixtures thereof. Oxidizing and reducing agents specifically tested include carbon, lactose, potassium nitrate, potassium perchlorate, sodium benzoate, and mixtures thereof.

The element carbon has a chemical formula of C, a molecular weight of 12.01 and the recognized properties as indicated as reference #1814 of The Merck Index ($9^{th}$ Edition). The form most commonly used and readily available for use in this invention is charcoal. More specifically, the charcoal was air float charcoal derived from wood.

Within the broad working range of concentrations tested for use as a fuel in the propellant formulations, carbon may be present in the amount of 0 to 15% by weight, is preferably present in the amount of 1 to 12% by weight, and is present in the amount of 3 to 7% by weight in the most likely commercial product applications.

Numerous sugars have served as fuels for prior art compositions of propellants. Lactose has specifically been tested and found useful as a fuel in the formulations of this invention. However, other known sugars, such as dextrose, sucrose and fuels derived therefrom, are expected to be useful when combined with ignition agents of gluconate or sodium nitrobenzoate salts, or mixtures thereof. Lactose has a chemical formula of $C_{12}H_{22}O_{11}$, a molecular weight of 360.31 and the recognized properties as indicated as reference #5192 of The Merck Index ($9^{th}$ Edition).

Within the broad working range of concentrations tested for use as a fuel in the propellant formulations, lactose may be optionally present in the amount of 0 to 15% by weight, is preferably present in the amount of 0 to 12% by weight, and may be optionally present in the amount of 0 to 10% by weight in the most likely commercial product applications.

Nitrate salts have served as oxidizing agents in prior art propellants. Potassium nitrate, known commonly as saltpeter, has been extensively tested and found useful as an oxidizing agent in the formulations of this invention. Potassium nitrate has a chemical formula of $KNO_3$, a molecular weight of 101.10 and the recognized properties as indicated as reference #7432 of The Merck Index ($9^{th}$ Edition).

Within the broad working range of concentrations tested for use as an oxidizing agent in the propellant formulations, potassium nitrate may be present in the amount of 0 to 60% by weight, is preferably present in the amount of 20 to 50% by weight, and may be present in the amount of 30 to 45% by weight in the most likely commercial product applications.

Since the development of Pyrodex powder as a blackpowder substitute, perchlorate salts have also served as oxidizing agents in prior art propellants. Potassium perchlorate has been extensively tested and found useful as an oxidizing agent in the formulations of this invention. Potassium perchlorate has a chemical formula of $KClO_4$, a molecular weight of 138.55 and the recognized properties as indicated as reference #7439 of The Merck Index ($9^{th}$ Edition).

Within the broad working range of concentrations tested for use as an oxidizing agent in the propellant formulations, potassium perchlorate may be present in the amount of 0 to 70% by weight, is preferably present in the amount of 15 to 50% by weight, and may be present in the amount of 20 to 40% by weight in the most likely commercial product applications.

The benzoate salts sodium benzoate and potassium benzoate have been tested and found useful in the formulations of this invention. Sodium benzoate has a chemical formula of $C_7H_5NaO_2$, a molecular weight of 144.11 and the ($9^{th}$ recognized properties as indicated as reference #8326 of The Merck Index Edition). Potassium benzoate has a chemical formula of $C_7H_5KO_2$, a molecular weight of 160.22 and the recognized properties as indicated as reference #1100 of The Merck Index ($9^{th}$ Edition).

Within the broad working range of concentrations tested for use in the propellant formulations, benzoate salt may be present in the amount of 0 to 30% by weight, is preferably present in the amount of 2 to 20% by weight, and may be present in the amount of 3 to 10% by weight in the most likely commercial product applications.

A broad range of various formulations of oxidizing and reducing agents with the ignitions agents of gluconic acid salts, or an alkali metal nitrobenzoate salt such as sodium nitrobenzoate or potassium nitrobenzoate, or mixtures thereof have been combined, without product degradation, with a variety of known propellant additives. Such additives include binders, burning rate modifiers, flow agents, colorants, coating agents, moisture retardants and mixtures thereof.

Propellant binders may comprise simply water, but dextrin is an agent known to serve as an effective binder in gunpowders. Dextrin has a chemical formula of $C_6H_{10}O_5$, a molecular weight of 162.14 and the recognized properties as indicated as reference #2909 of The Merck Index ($9^{th}$ Edition).

Within the broad working range of concentrations tested for use as a binder in the propellant formulations, dextrin may be present in the amount of 0 to 10% by weight, is preferably present in the amount of 1 to 9% by weight, and may be present in the amount of 2 to 8% by weight in the most likely commercial product applications.

Likewise, water may also serve as a burning rate modifier. Dicyanodiamide is another agent known to modify burn rate in gunpowders. Dicyanodiamide has a chemical formula of $C_2H_4N_4$, a molecular weight of 84.08 and the recognized properties as indicated as reference #3068 of The Merck Index ($9^{th}$ Edition).

Within the broad working range of concentrations tested for use as burn rate modifier in the propellant formulations, dicyanodiamide may be present in the amount of 0 to 10% by weight, is preferably present in the amount of 1 to 8% by weight, and may be present in the amount of 2 to 7% by weight in the most likely commercial product applications.

Tricalcium phosphate may serve as a flow agent in the propellant formulations. Tricalcium phosphate has a chemical formula of $Ca_3(PO_4)_2$, a molecular weight of 310.20 and the recognized properties as indicated as reference #1695 of The Merck Index ($9^{th}$ Edition).

Within the broad working range of concentrations tested for use as a flow agent in the propellant formulations, tricalcium phosphate may be present in the amount of 0 to 1% by weight, is preferably present in the amount of 0.1 to 0.9% by weight, and may be present in the amount of 0.2 to 0.8% by weight in the most likely commercial product applications.

A small amount of carbon black may serve as a colorant in the propellant formulations. Blackpowder traditionalists and muzzleloading enthusiasts expect substitute powders to have a pleasing black color. Accordingly, an appropriate color shade may be achieved by adding up 0.5% by weight carbon black to the propellant formulations of this invention.

Likewise, coating agents such as graphite may be added to the propellant formulations of this invention. This may be done to improve the pouring and consistency of the product to better match the esthetics of traditional blackpowder characteristics.

Although the propellant formulations of this invention have not been found to be excessively hygroscopic, moisture retardants may be included in the product. Acceptable moisture retardants include silicon compounds known in the art for their moisture trapping and retaining properties.

Since the gluconic acid salts and alkali metal nitrobenzoate salt disclosed for use in this invention have not been previously known to have any use in pyrotechnic compositions, extensive tests have been conducted to attempt to understand the nature and scope of these compounds in various propellant formulations. A large number of the tested formulations are included in this application in Tables 1 through 3.

In the reported formulations of Tables 1 through 3, the raw materials of each formulation are given as a weight percentage. The combustion products are theoretically calculated and are likewise given as weight percentage.

In order to characterize the research compositions, the byproducts of the combustion reaction were calculated by a mass balance and a uniform method of determining the reaction byproducts. It is of course recognized that the uniform method does not necessarily yield correct absolute values due to the changes in byproducts that can occur from the reaction environment of high temperature and pressure to atmospheric conditions. Nonetheless, such method does give a good basis for relative comparison of one formulation with another.

The uniform method selected to calculate the reaction byproducts involves certain assumptions as follows. Materials that have very high melting points and are basically inert are considered to pass through the reaction unchanged. The inert portion of trace materials such as in charcoal are assumed to pass through the reaction unchanged. All hydrogen in the raw materials is assumed to be converted to water. All nitrogen in the raw materials is produced as nitrogen gas. All sodium in the raw materials is first produced as sodium chloride and secondly as sodium carbonate. All chlorine in the raw materials is first produced as sodium chloride and secondly as potassium chloride. Any remaining potassium after the above conversions is produced as potassium carbonate. Any remaining carbon is converted to carbon monoxide. Any remaining oxygen is used to convert carbon monoxide to carbon dioxide.

The composition of combustion products given in Tables 1 through 3, therefore, were determined in accordance with the foregoing method with the exception of the combustion products for blackpowder which are well known to those skilled in the gunpowder art to have the accepted values as listed.

As reported under performance characteristics in each of Tables 1 through 3, various test procedures or observations were made for each propellant formulation. A brief description of the test procedure or observation of the reported results are given as follows.

Autoignition Temperature is given in degrees Fahrenheit. Grains of the composition were placed on a hot plate at various locations until a location was found that caused combustion. The temperature of that location on the plate was then measured and recorded.

In the Open Tube Burn test, a small quantity of the composition was placed in a ½" diameter plastic tube which was taped at one end. A fuse was placed in the open end and ignited. The nature of combustion of the composition was observed and the results recorded.

Burn Rate is given in seconds per inch. A quantity of the composition was compressed in a ½" diameter tube at consistent pressure by increments until a pressing of about 1½" in length was obtained. The pressed composition was then ignited and the time of burning was measured. The walls of the tube restricted the burning to just the cross-sectional area of the tube so that the composition burned in a cigarette type manner.

The Bulk Density is given in grams per cubic centimeter (gms/cc). A known volume of the composition was weighed, and the bulk density was calculated and recorded.

Moisture content is given as a weight percentage. Moisture content was measured using an Ohaus-type scale.

Ballistic characteristics were taken for 80 grains volumetric samples which means that the same volume was used that was equal to the volume of 80 grains by weight of blackpowder. The ballistic data was recorded.

The projectile velocities of multiple tests were measured and recorded as feet per second. For each shot, the test gun was charged with a known quantity of composition and the projectile was fired through velocity screens separated by a known distance. The time for the projectile to pass through one screen to the next was measured and the velocity was then calculated and recorded. Lo velocity represents the lowest velocity in the range of tests for the particular powder formulation being studied, Hi velocity represents the highest in the range of tests, ES velocity represents the spread between Lo and Hi velocities, Av velocity represents the average velocity, and SD velocity is the standard deviation for the range of tests.

The TTP test is given in milliseconds and represents the time to peak pressure. An electronic device was used to measure the elapsed time from the onset of pressure rise until the maximum pressure occurs in the gun barrel breech.

The Pressure test is given in pounds per square inch. A piezometer was used to determine the pressure in the breech of the gun at each firing of the composition and the maximum of such readings was recorded.

The Fouler pressure test is given in pounds per square inch. The Fouler pressure is measured with the piezometer as above, but this reading represents the first shot in a group of firings and was normally done with a clean barrel.

The ability to clean any combustion residue with water alone was also observed as part of the tests. With the exception of the tests on blackpowder recorded for comparative purposes, all of the formulations of this invention formed combustion byproducts which were easily removed with gun cleaning patches dipped in plain water.

In the following Table 1 representative examples are shown of propellant formulations in which a gluconic acid salt alone serves as the ignition aid for the oxidizing and reducing agents as indicated.

TABLE 1

Gluconate Formulations

| | Chemical Formula | Mole Weight | Black Powder | Ref #657 | Ref #171 | Ref #75 |
|---|---|---|---|---|---|---|
| RAW MATERIALS, wt. % | | | | | | |
| Carbon Black | C | 12.01 | | 0.45 | 0.5 | 0.5 |
| Charcoal | C | 12.01 | 15.00 | 3.15 | 3 | |
| Dextrin | $C_6H_{10}O_5$ | 162.14 | | 6.00 | 6 | 6 |
| Dicyanodiamide | $C_2H_4N_4$ | 84.08 | | | | |
| Graphite | C | 12.01 | | | | |
| Lactose | $C_{12}H_{22}O_{11}$ | 360.31 | | | 6.1 | |
| Sodium m-Nitrobenzoate | $C_7H_4NO_4Na$ | 189.11 | | | | |
| Potassium Nitrate | $KNO_3$ | 101.10 | 75.00 | 16.63 | 38 | 53.1 |
| Potassium Perchlorate | $KClO_4$ | 138.55 | | 48.83 | 32.5 | 21.2 |
| Sodium Benzoate | $C_7H_5NaO_2$ | 144.11 | | 21.00 | 9.8 | 14.8 |
| Potassium Benzoate | $C_7H_5KO_2$ | 160.22 | | | | |
| Sodium Gluconate | $C_6H_{11}NaO_7$ | 218.13 | | 3.55 | 3.7 | 4 |
| Potassium Gluconate | $C_6H_{11}KO_7$ | 234.24 | | | | |

TABLE 1-continued

| Gluconate Formulations | | | | | | |
|---|---|---|---|---|---|---|
| Sulfur | S | 32.06 | 10.00 | | | |
| Tricalcium Phosphate | $Ca_3(PO_4)_2$ | 310.20 | | 0.40 | 0.4 | 0.4 |
| TOTAL | | | 100.00 | 100.00 | 100.0 | 100 |
| COMBUSTION PRODUCTS, wt. % | | | | | | |
| Ammonium Carbonate | $(NH_4)_2CO_3$ | 96.11 | 0.97 | | | |
| Carbon Dioxide | $CO_2$ | 44.01 | 24.93 | | 16.2 | 19 |
| Carbon Monoxide | CO | 28.01 | 3.97 | 38.20 | 17.4 | 9.3 |
| Hydrogen Sulfide | $H_2S$ | 34.08 | 0.69 | | | |
| Methane | $CH_4$ | 16.04 | 0.49 | | | |
| Nitrogen | $N_2$ | 28.02 | 9.92 | 2.30 | 5.3 | 7.4 |
| Potassium Carbonate | $K_2CO_3$ | 138.20 | 26.56 | 22.40 | 32.2 | 44.7 |
| Potassium Thiocyanate | KCNS | 97.18 | 1.97 | | | |
| Potassium Sulfate | $K_2SO_4$ | 174.25 | 12.34 | | | |
| Potassium Thiosulfate | $K_2S_2O_3$ | 190.32 | 15.40 | | | |
| Potassium Sulfide | $K_2S$ | 110.26 | 2.23 | | | |
| Potassium Chloride | KCl | 74.56 | | 14.30 | 10.9 | 2.3 |
| Sodium Carbonate | $Na_2CO_3$ | 105.99 | | | | |
| Sodium Chloride | NaCl | 58.45 | | 9.40 | 5.1 | 7.1 |
| Tricalcium Phosphate | $Ca_3(PO_4)_2$ | 310.20 | | 0.40 | 0.4 | 0.4 |
| Water | $H_2O$ | 18.02 | | 11.60 | 11.6 | 9.8 |
| Ash or Unburned Carbon | C | 12.01 | 0.53 | 1.40 | 0.9 | |
| TOTAL | | | 100.00 | 100.00 | 100.0 | 100 |
| PERFORMANCE FACTORS | | | | | | |
| Autoignition Temp, ° F. | | | 580 | 800 | 760 | 860 |
| Open tube burn | | | just burn | fast | just burn | just burn |
| Burn rate, secs/in. | | | 2.3 | 5.3 | 7.9 | 9.1 |
| Bulk Density | | | 1 | 0.84 | 0.87 | 0.81 |
| Moisture, wt. % | | | <0.5 | 0.9 | 0.7 | 0.8 |
| Ballistics 80 gr.vol. | | | | | | |
| Lo velocity, fps | | | 1624 | 1586 | 1764 | 1393 |
| Hi velocity, fps | | | 1690 | only | 1863 | 1426 |
| ES velocity, fps | | | 66 | one | 99 | 33 |
| Av velocity, fps | | | 1664 | shot | 1825 | 1407 |
| SD velocity, fps | | | 26 | | 48 | 15 |
| TTP, ms. | | | 0.8 | 0.2 | 1 | 1 |
| Pressure, psi max. | | | 11000 | 29500 | 6800 | 3600 |
| Fouler pressure, psi | | | | | 4100 | 1600 |

| | Chemical Formula | Ref #85 | Ref #165 | Ref #175 | Ref #663 | Ref #664 |
|---|---|---|---|---|---|---|
| RAW MATERIALS, wt. % | | | | | | |
| Carbon Black | C | 0.5 | 0.5 | 0.5 | | |
| Charcoal | C | | 3 | 3 | 5 | 5 |
| Dextrin | $C_6H_{10}O_5$ | | 6 | 4 | 4 | 4 |
| Dicyanodiamide | $C_2H_4N_4$ | | | | | |
| Graphite | C | | | | | |
| Lactose | $C_{12}H_{22}O_{11}$ | | 6.8 | 7 | 5.5 | 7 |
| Sodium m-Nitrobenzoate | $C_7H_4NO_4Na$ | | | | | |
| Potassium Nitrate | $KNO_3$ | 55.5 | 37 | 37.8 | 37.8 | 37.8 |
| Potassium Perchlorate | $KClO_4$ | 22.2 | 31.5 | 32.2 | 32.2 | 32.2 |
| Sodium Benzoate | $C_7H_5NaO_2$ | 17.4 | 10.8 | 11 | 11 | 9.5 |
| Potassium Benzoate | $C_7H_5KO_2$ | | | | | |
| Sodium Gluconate | $C_6H_{11}NaO_7$ | 4 | 4 | 4.1 | 4.1 | 4.1 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100.0 | 100.0 | 100.0 | 100.0 |
| COMBUSTION PRODUCTS, wt. % | | | | | | |
| Ammonium Carbonate | $(NH_4)_2CO_3$ | | | | | |
| Carbon Dioxide | $CO_2$ | 25.5 | 10.2 | 13.7 | 12.9 | 13.5 |
| Carbon Monoxide | CO | 2.2 | 23.9 | 20 | 21 | 20.2 |
| Hydrogen Sulfide | $H_2S$ | | | | | |
| Methane | $CH_4$ | | | | | |
| Nitrogen | $N_2$ | 7.7 | 5.1 | 5.2 | 5.2 | 5.2 |
| Potassium Carbonate | $K_2CO_3$ | 47.3 | 31.4 | 32.5 | 32.5 | 31.5 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |

TABLE 1-continued

| | | Gluconate Formulations | | | | |
|---|---|---|---|---|---|---|
| Potassium Chloride | KCl | 1.7 | 10.3 | 10.1 | 10.1 | 11.2 |
| Sodium Carbonate | $Na_2CO_3$ | | | | | |
| Sodium Chloride | NaCl | 8.1 | 5.3 | 5.6 | 5.6 | 4.8 |
| Tricalcium Phosphate | $Ca_3(PO_4)_2$ | 0.4 | 0.4 | 0.4 | 0.4 | 0.4 |
| Water | $H_2O$ | 7.1 | 12.5 | 11.6 | 10.7 | 11.6 |
| Ash or Unburned Carbon | C | | 0.9 | 0.9 | 1.6 | 1.6 |
| TOTAL | | 100 | 100.0 | 100.0 | 100.0 | 100.0 |
| PERFORMANCE FACTORS | | | | | | |
| Autoignition Temp, ° F. | | 930 | 740 | 770 | 770 | 740 |
| Open tube burn | | just burn fast | burn fast | burn fast | | |
| Burn rate, secs/in. | | 7.1 | 6.9 | 6.7 | 7.2 | 7.8 |
| Bulk Density | | 0.64 | 0.84 | 0.81 | 0.84 | 0.84 |
| Moisture, wt. % | | 0.7 | 0.7 | 0.7 | 0.8 | 0.8 |
| Ballistics 80 gr.vol. | | | | | | |
| Lo velocity, fps | | 1545 | 1864 | 1937 | 1930 | 1839 |
| Hi velocity, fps | | 1592 | 1941 | 1976 | 1960 | 1884 |
| ES velocity, fps | | 138 | 77 | 39 | 30 | 45 |
| Av velocity, fps | | 1537 | 1923 | 1958 | 1946 | 1865 |
| SD velocity, fps | | 70 | 33 | 17 | 11 | 18 |
| TTP, ms. | | 0.8 | 0.8 | 0.8 | 0.7 | 0.7 |
| Pressure, psi max. | | 11100 | 7700 | 8800 | 10400 | 8900 |
| Fouler pressure, psi | | 6000 | 5400 | 8000 | 7000 | 6300 |
| | Chemical Formula | Ref #665 | Ref #158 | Ref #680 | Ref #685 | Ref #677 |
| RAW MATERIALS, wt. % | | | | | | |
| Carbon Black | C | | 0.5 | | | |
| Charcoal | C | 7 | 3 | 7 | 7 | 7 |
| Dextrin | $C_6H_{10}O_5$ | 4 | 6 | 3.5 | 3.5 | 3 |
| Dicyanodiamide | $C_2H_4N_4$ | | | | | |
| Graphite | C | | | | | |
| Lactose | $C_{12}H_{22}O_{11}$ | 3.5 | 7.4 | 4 | 4 | 4 |
| Sodium m-Nitrobenzoate | $C_7H_4NO_4Na$ | | | | | |
| Potassium Nitrate | $KNO_3$ | 37.8 | 35.9 | 39.4 | 39.4 | 37.8 |
| Potassium Perchlorate | $KClO_4$ | 32.2 | 30.6 | 30.7 | 33.2 | 32.2 |
| Sodium Benzoate | $C_7H_5NaO_2$ | 11 | 11.8 | 10.5 | 8 | 11 |
| Potassium Benzoate | $C_7H_5KO_2$ | | | | | |
| Sodium Gluconate | $C_6H_{11}NaO_7$ | 4.1 | 4.4 | 4.5 | 4.5 | 4.6 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100.0 | 100.0 | 100.0 | 100.0 | 100.0 |
| COMBUSTION PRODUCTS, wt. % | | | | | | |
| Ammonium Carbonate | $(NH_4)_2CO_3$ | | | | | |
| Carbon Dioxide | $CO_2$ | 10.4 | 3.6 | 11.3 | 21.4 | 10.6 |
| Carbon Monoxide | CO | 23.8 | 30.3 | 22.5 | 12.9 | 23.6 |
| Hydrogen Sulfide | $H_2S$ | | | | | |
| Methane | $CH_4$ | | | | | |
| Nitrogen | $N_2$ | 5.2 | 5 | 5.5 | 5.5 | 5.2 |
| Potassium Carbonate | $K_2CO_3$ | 32.5 | 31.6 | 33.2 | 32 | 32.5 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 10.1 | 8.8 | 9.8 | 12.4 | 10.1 |
| Sodium Carbonate | $Na_2CO_3$ | | | | | |
| Sodium Chloride | NaCl | 5.6 | 5.9 | 5.4 | 4.3 | 5.6 |
| Tricalcium Phosphate | $Ca_3(PO_4)_2$ | 0.4 | 0.4 | 0.4 | 0.4 | 0.4 |
| Water | $H_2O$ | 9.8 | 13.4 | 9.8 | 8.9 | 9.8 |
| Ash or Unburned Carbon | C | 2.2 | 0.9 | 2.2 | 2.2 | 2.2 |
| TOTAL | | 100.0 | 99.9 | 100.1 | 100.0 | 100.0 |
| PERFORMANCE FACTORS | | | | | | |
| Autoignition Temp, ° F. | | 770 | 720 | 720 | 740 | 720 |
| Open tube burn | | fast | just burn | fast | | fast |
| Burn rate, secs/in. | | 6.3 | 7.3 | 6.7 | 8.1 | 6.6 |
| Bulk Density | | 0.82 | 0.83 | 0.8 | 0.86 | 0.81 |
| Moisture, wt. % | | 0.8 | 0.7 | 0.9 | 0.8 | 0.7 |
| Ballistics 80 gr.vol. | | | | | | |

TABLE 1-continued

| Gluconate Formulations | | | | | | |
|---|---|---|---|---|---|---|
| Lo velocity, fps | | 1939 | 1762 | 1908 | 1905 | 1930 |
| Hi velocity, fps | | 1955 | 1890 | 1995 | 1966 | 2024 |
| ES velocity, fps | | 16 | 128 | 87 | 61 | 94 |
| Av velocity, fps | | 1948 | 1845 | 1951 | 1936 | 1980 |
| SD velocity, fps | | 7 | 52 | 26 | 27 | 44 |
| TTP, ms. | | 0.7 | 0.8 | 0.7 | 0.8 | 0.6 |
| Pressure, psi max. | | 10900 | 7300 | 12600 | 11000 | 15400 |
| Fouler pressure, psi | | 6700 | 4600 | 8500 | 6200 | 11900 |
| | Chemical Formula | Ref #147 | Ref #151 | Ref #679 | Ref #164 | Ref #58 |
| RAW MATERIALS, wt. % | | | | | | |
| Carbon Black | C | 0.5 | 0.5 | | 0.5 | |
| Charcoal | C | 3 | 3 | 7 | | 5 |
| Dextrin | $C_6H_{10}O_5$ | 6 | 6 | 3 | 6 | 6 |
| Dicyanodiamide | $C_2H_4N_4$ | | | | | 4.9 |
| Graphite | C | | | | | |
| Lactose | $C_{12}H_{22}O_{11}$ | 9.5 | 8 | 4.2 | 9.6 | |
| Sodium m-Nitrobenzoate | $C_7H_4NO_4Na$ | | | | | |
| Potassium Nitrate | $KNO_3$ | 37.9 | 34.8 | 39.4 | 34.2 | 48.6 |
| Potassium Perchlorate | $KClO_4$ | 26.5 | 29.7 | 30.7 | 32.9 | 19.4 |
| Sodium Benzoate | $C_7H_5NaO_2$ | 11.4 | 12.8 | 10.5 | 11.5 | 10.7 |
| Potassium Benzoate | $C_7H_5KO_2$ | | | | | |
| Sodium Gluconate | $C_6H_{11}NaO_7$ | 4.8 | 4.8 | 4.8 | 4.9 | 5 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100.0 | 100.0 | 100.0 | 100.0 | 100 |
| COMBUSTION PRODUCTS, wt. % | | | | | | |
| Ammonium Carbonate | $(NH_4)_2CO_3$ | | | | | |
| Carbon Dioxide | $CO_2$ | | | 11.3 | 8.8 | 2.2 |
| Carbon Monoxide | CO | 33.1 | 33.4 | 22.4 | 24.5 | 26.3 |
| Hydrogen Sulfide | $H_2S$ | | | | | |
| Methane | $CH_4$ | | | | | |
| Nitrogen | $N_2$ | 5.3 | 4.8 | 5.5 | 4.7 | 10 |
| Potassium Carbonate | $K_2CO_3$ | 32.9 | 31.3 | 33.4 | 30.4 | 39.8 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 6.7 | 7.8 | 9.4 | 10.1 | 3.4 |
| Sodium Carbonate | $Na_2CO_3$ | | | | | |
| Sodium Chloride | NaCl | 5.9 | 6.4 | 5.6 | 5.9 | 5.6 |
| Tricalcium Phosphate | $Ca_3(PO_4)_2$ | 0.4 | 0.4 | 0.4 | 0.4 | 0.4 |
| Water | $H_2O$ | 14.3 | 14.3 | 9.8 | 15.2 | 10.7 |
| Ash or Unburned Carbon | C | 1.3 | 1.6 | 2.2 | | 1.6 |
| TOTAL | | 99.9 | 100.0 | 100.0 | 100.0 | 100 |
| PERFORMANCE FACTORS | | | | | | |
| Autoignition Temp, ° F. | | 740 | 750 | 710 | 770 | 840 |
| Open tube burn | | just burn | just burn | fast | | just burn |
| Burn rate, secs/in. | | 8.3 | 8.5 | 6.3 | 9.5 | 8.8 |
| Bulk Density | | 0.82 | 0.84 | 0.8 | 0.84 | 0.78 |
| Moisture, wt. % | | 0.7 | 0.9 | 0.8 | 0.7 | 0.6 |
| Ballistics 80 gr.vol. | | | | | | |
| Lo velocity, fps | | 1571 | 1655 | 1917 | 1713 | 1346 |
| Hi velocity, fps | | 1616 | 1698 | 1970 | 1811 | 1442 |
| ES velocity, fps | | 45 | 43 | 53 | 98 | 96 |
| Av velocity, fps | | 1592 | 1676 | 1942 | 1765 | 1384 |
| SD velocity, fps | | 19 | 19 | 20 | 44 | 39 |
| TTP, ms. | | 1 | 1 | 0.6 | 0.8 | 1 |
| Pressure, psi max. | | 4300 | 5700 | 12200 | 6300 | 3800 |
| Fouler pressure, psi | | 2900 | 4600 | 10000 | 4500 | 2100 |
| | Chemical Formula | Ref #675 | Ref #159 | Ref #176 | Ref #177 | Ref #115 |
| RAW MATERIALS, wt. % | | | | | | |
| Carbon Black | C | | 0.5 | 0.5 | 0.5 | 0.5 |
| Charcoal | C | 7 | | 1 | 1 | |
| Dextrin | $C_6H_{10}O_5$ | 2 | 6 | 6 | 4 | 6 |

TABLE 1-continued

| Gluconate Formulations | | | | | | |
|---|---|---|---|---|---|---|
| Dicyanodiamide | $C_2H_4N_4$ | | | | | |
| Graphite | C | | | | | |
| Lactose | $C_{12}H_{22}O_{11}$ | 4.5 | 10.4 | 8.9 | 9.1 | 11.1 |
| Sodium m-Nitrobenzoate | $C_7H_4NO_4Na$ | | | | | |
| Potassium Nitrate | $KNO_3$ | 37.8 | 33.2 | 30.6 | 31.3 | 32.2 |
| Potassium Perchlorate | $KClO_4$ | 32.2 | 31.9 | 33.1 | 33.8 | 30.9 |
| Sodium Benzoate | $C_7H_5NaO_2$ | 11 | 12.4 | 14.2 | 14.5 | 13.3 |
| Potassium Benzoate | $C_7H_5KO_2$ | | | | | |
| Sodium Gluconate | $C_6H_{11}NaO_7$ | 5.1 | 5.2 | 5.3 | 5.4 | 5.6 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100.0 | 100.0 | 100.0 | 100.0 | 100.0 |
| COMBUSTION PRODUCTS, wt. % | | | | | | |
| Ammonium Carbonate | $(NH_4)_2CO_3$ | | | | | |
| Carbon Dioxide | $CO_2$ | 11 | 2.7 | | 2.2 | |
| Carbon Monoxide | CO | 22.9 | 30.7 | 34.3 | 32.2 | 32.4 |
| Hydrogen Sulfide | $H_2S$ | | | | | |
| Methane | $CH_4$ | | | | | |
| Nitrogen | $N_2$ | 5.2 | 4.6 | 4.2 | 4.3 | 4.5 |
| Potassium Carbonate | $K_2CO_3$ | 32.9 | 30 | 29.3 | 30.2 | 30.2 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.7 | 9.1 | 8.8 | 8.6 | 7.8 |
| Sodium Carbonate | $Na_2CO_3$ | | | | | |
| Sodium Chloride | NaCl | 5.9 | 6.4 | 7.1 | 7.4 | 6.9 |
| Tricalcium Phosphate | $Ca_3(PO_4)_2$ | 0.4 | 0.4 | 0.4 | 0.4 | 0.4 |
| Water | $H_2O$ | 9.8 | 16.1 | 15.2 | 14.3 | 17 |
| Ash or Unburned Carbon | C | 2.2 | | 0.6 | 0.3 | 0.9 |
| TOTAL | | 100.0 | 100.0 | 99.9 | 99.9 | 100.1 |
| PERFORMANCE FACTORS | | | | | | |
| Autoignition Temp, ° F. | | 740 | 740 | 760 | 760 | 720 |
| Open tube burn | | fast | just burn | just burn | just burn | just burn |
| Burn rate, secs/in. | | 7 | 9.4 | 8.7 | 8.2 | 12 |
| Bulk Density | | 0.8 | 0.83 | 0.85 | 0.83 | 0.81 |
| Moisture, wt. % | | 0.8 | 0.8 | 0.7 | 0.7 | 0.9 |
| Ballistics 80 gr.vol. | | | | | | |
| Lo velocity, fps | | 1828 | 1776 | 1920 | 1970 | 1675 |
| Hi velocity, fps | | 1963 | 1845 | 1973 | 2066 | 1729 |
| ES velocity, fps | | 135 | 69 | 53 | 96 | 54 |
| Av velocity, fps | | 1922 | 1825 | 1945 | 2019 | 1700 |
| SD velocity, fps | | 53 | 28 | 20 | 36 | 20 |
| TTP, ms. | | 0.6 | 0.9 | 0.8 | 0.7 | 0.9 |
| Pressure, psi max. | | 13000 | 7100 | 9100 | 11800 | 6100 |
| Fouler pressure, psi | | | 6000 | 9200 | 14500 | 2300 |
| | Chemical Formula | Ref #673 | Ref #117 | Ref #676 | Ref #674 | Ref #660 |
| RAW MATERIALS, wt. % | | | | | | |
| Carbon Black | C | | 0.5 | | | 0.38 |
| Charcoal | C | 7 | | 7 | 7 | 3.15 |
| Dextrin | $C_6H_{10}O_5$ | | 6 | 2 | | 6.00 |
| Dicyanodiamide | $C_2H_4N_4$ | | | | | |
| Graphite | C | | | | | |
| Lactose | $C_{12}H_{22}O_{11}$ | 5.5 | 9.6 | 7.1 | 8 | |
| Sodium m-Nitrobenzoate | $C_7H_4NO_4Na$ | | | | | |
| Potassium Nitrate | $KNO_3$ | 37.8 | 31.9 | 32.5 | 32.8 | 25.34 |
| Potassium Perchlorate | $KClO_4$ | 32.2 | 30.9 | 32.2 | 32.2 | 39.06 |
| Sodium Benzoate | $C_7H_5NaO_2$ | 11 | 13.3 | 11 | 11 | 16.80 |
| Potassium Benzoate | $C_7H_5KO_2$ | | | | | |
| Sodium Gluconate | $C_6H_{11}NaO_7$ | 6.1 | 7.4 | 7.8 | 8.6 | 8.88 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.40 |
| TOTAL | | 100.0 | 100.0 | 100.0 | 100.0 | 100.00 |
| COMBUSTION PRODUCTS, wt. % | | | | | | |
| Ammonium Carbonate | $(NH_4)_2CO_3$ | | | | | |

TABLE 1-continued

| | | Gluconate Formulations | | | | |
|---|---|---|---|---|---|---|
| Carbon Dioxide | $CO_2$ | 11.5 | | | | |
| Carbon Monoxide | CO | 22.3 | 32 | 34.8 | 34.4 | 36.00 |
| Hydrogen Sulfide | $H_2S$ | | | | | |
| Methane | $CH_4$ | | | | | |
| Nitrogen | $N_2$ | 5.2 | 4.4 | 4.5 | 4.5 | 3.50 |
| Potassium Carbonate | $K_2CO_3$ | 33 | 30.6 | 30.1 | 30.7 | 28.10 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.5 | 7.2 | 8.9 | 8.4 | 9.30 |
| Sodium Carbonate | $Na_2CO_3$ | | | | | |
| Sodium Chloride | NaCl | 6.1 | 7.4 | 6.6 | 6.9 | 9.20 |
| Tricalcium Phosphate | $Ca_3(PO_4)_2$ | 0.4 | 0.4 | 0.4 | 0.4 | 0.40 |
| Water | $H_2O$ | 9.8 | 17 | 12.5 | 12.5 | 12.50 |
| Ash or Unburned Carbon | C | 2.2 | 1 | 2.2 | 2.2 | 1.00 |
| TOTAL | | 100.0 | 100.0 | 100.0 | 100.0 | 100.00 |
| PERFORMANCE FACTORS | | | | | | |
| Autoignition Temp, ° F. | | 720 | 740 | 740 | 720 | 800 |
| Open tube burn | | fast | just burn | fast | just burn | |
| Burn rate, secs/in. | | 6.6 | 12.2 | 6.6 | 6.8 | 6.4 |
| Bulk Density | | 0.78 | 0.85 | 0.77 | 0.77 | 0.81 |
| Moisture, wt. % | | 0.7 | 0.8 | 0.7 | 0.8 | 0.8 |
| Ballistics 80 gr.vol. | | | | | | |
| Lo velocity, fps | | 1152 | 1726 | 1846 | 1654 | 1660 |
| Hi velocity, fps | | 1727 | 1760 | 1951 | 1852 | 1907 |
| ES velocity, fps | | 575 | 34 | 105 | 198 | four |
| Av velocity, fps | | 1530 | 1748 | 1896 | 1800 | shots |
| SD velocity, fps | | 327 | 14 | 38 | 82 | |
| TTP, ms. | | 0.4 | 0.9 | 0.6 | 0.5 | 0.3 |
| Pressure, psi max. | | 24200 | 5800 | 13500 | 18400 | 24100 |
| Fouler pressure, psi | | 14100 | 5000 | 11500 | 13900 | |
| | Chemical Formula | Ref #662 | Ref #162 | Ref #83 | Ref #157 | Ref #170 |
| RAW MATERIALS, wt. % | | | | | | |
| Carbon Black | C | 0.38 | 0.5 | 0.5 | 0.5 | 0.5 |
| Charcoal | C | 5.25 | 3 | | 3 | 3 |
| Dextrin | $C_6H_{10}O_5$ | 6.00 | 6 | | 6 | 3 |
| Dicyanodiamide | $C_2H_4N_4$ | | | | | |
| Graphite | C | | | | | |
| Lactose | $C_{12}H_{22}O_{11}$ | | | | | |
| Sodium m-Nitrobenzoate | $C_7H_4NO_4Na$ | | | | | |
| Potassium Nitrate | $KNO_3$ | 32.55 | 37.4 | 53.1 | 36.3 | 37.5 |
| Potassium Perchlorate | $KClO_4$ | 32.55 | 30.8 | 21.2 | 29.9 | 30.9 |
| Sodium Benzoate | $C_7H_5NaO_2$ | 14.00 | 12.4 | 14.8 | 13.6 | 14.1 |
| Potassium Benzoate | $C_7H_5KO_2$ | | | | | |
| Sodium Gluconate | $C_6H_{11}NaO_7$ | 8.88 | 9.5 | 10 | 10.3 | 10.6 |
| Potassium Gluconate | $C_6H_{11}KO_7$ | | | | | |
| Sulfur | S | | | | | |
| Tricalcium Phosphate | $Ca_3(PO_4)_2$ | 0.40 | 0.4 | 0.4 | 0.4 | 0.4 |
| TOTAL | | 100.00 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | | 9.3 | 22.5 | 3 | 9.6 |
| Carbon Monoxide | CO | 35.00 | 23.5 | 5.2 | 29.8 | 23 |
| Hydrogen Sulfide | $H_2S$ | | | | | |
| Methane | $CH_4$ | | | | | |
| Nitrogen | $N_2$ | 4.50 | 5.2 | 7.4 | 5 | 5.2 |
| Potassium Carbonate | $K_2CO_3$ | 31.60 | 34.6 | 46.6 | 34.6 | 35.9 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 7.20 | 6.9 | 0.2 | 5.5 | 5.5 |
| Sodium Carbonate | $Na_2CO_3$ | | | | | |
| Sodium Chloride | NaCl | 8.10 | 7.6 | 8.7 | 8.4 | 8.7 |
| Tricalcium Phosphate | $Ca_3(PO_4)_2$ | 0.40 | 0.4 | 0.4 | 0.4 | 0.4 |

TABLE 1-continued

| | | Gluconate Formulations | | | | |
|---|---|---|---|---|---|---|
| Water | $H_2O$ | 11.60 | 11.6 | 8.9 | 12.5 | 10.7 |
| Ash or Unburned Carbon | C | 1.60 | 0.9 | | 0.9 | 0.9 |
| TOTAL | | 100.00 | 100 | 99.9 | 100.1 | 99.9 |
| PERFORMANCE FACTORS | | | | | | |
| Autoignition Temp, ° F. | | 730 | 710 | 780 | 720 | 740 |
| Open tube burn | | fast | just burn | just burn | just burn | just burn |
| Burn rate, secs/in. | | 7.1 | 6.9 | 8.3 | 6.9 | 6.9 |
| Bulk Density | | 0.81 | 0.84 | 0.71 | 0.83 | 0.77 |
| Moisture, wt. % | | 0.8 | 0.8 | 0.7 | 0.7 | 0.7 |
| Ballistics 80 gr.vol. | | | | | | |
| Lo velocity, fps | | 1923 | 1909 | 1561 | 1799 | 1741 |
| Hi velocity, fps | | 1953 | 1958 | 1691 | 1888 | 1856 |
| ES velocity, fps | | 30 | 49 | 130 | 89 | 115 |
| Av velocity, fps | | 1937 | 1931 | 1638 | 1855 | 1817 |
| SD velocity, fps | | 11 | 19 | 48 | 34 | 47 |
| TTP, ms. | | 0.7 | 0.7 | 1 | 0.9 | 0.5 |
| Pressure, psi max. | | 12400 | 7400 | 11900 | 8200 | 16900 |
| Fouler pressure, psi | | 10400 | 5200 | 5800 | 5400 | 13000 |
| | Chemical Formula | Ref #136 | Ref #148 | Ref #152 | Ref #155 | Ref #140 |
| RAW MATERIALS, wt. % | | | | | | |
| Carbon Black | C | 0.5 | 0.5 | 0.5 | 0.5 | 0.5 |
| Charcoal | C | 3 | 3 | 3 | 3 | 3 |
| Dextrin | $C_6H_{10}O_5$ | 6 | 6 | 6 | 6 | 6 |
| Dicyanodiamide | $C_2H_4N_4$ | | | | | |
| Graphite | C | | | | | |
| Lactose | $C_{12}H_{22}O_{11}$ | | | | | |
| Sodium m-Nitrobenzoate | $C_7H_4NO_4Na$ | | | | | |
| Potassium Nitrate | $KNO_3$ | 27.1 | 37.2 | 31.2 | 35.2 | 28.2 |
| Potassium Perchlorate | $KClO_4$ | 36.2 | 27.2 | 32.6 | 29 | 35 |
| Sodium Benzoate | $C_7H_5NaO_2$ | 15.6 | 14.5 | 15.1 | 14.7 | 15 |
| Potassium Benzoate | $C_7H_5KO_2$ | | | | | |
| Sodium Gluconate | $C_6H_{11}NaO_7$ | 11.2 | 11.2 | 11.2 | 11.2 | 11.9 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | | | | | |
| Carbon Monoxide | CO | 34.3 | 31.1 | 32.9 | 31.9 | 34.3 |
| Hydrogen Sulfide | $H_2S$ | | | | | |
| Methane | $CH_4$ | | | | | |
| Nitrogen | $N_2$ | 3.8 | 5.2 | 4.3 | 4.9 | 3.9 |
| Potassium Carbonate | $K_2CO_3$ | 29.5 | 35.9 | 32.3 | 34.6 | 30 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 7.6 | 3.4 | 5.7 | 4.2 | 7.2 |
| Sodium Carbonate | $Na_2CO_3$ | | | | | |
| Sodium Chloride | NaCl | 9.4 | 8.9 | 9.2 | 8.9 | 9.2 |
| Tricalcium Phosphate | $Ca_3(PO_4)_2$ | 0.4 | 0.4 | 0.4 | 0.4 | 0.4 |
| Water | $H_2O$ | 13.4 | 13.4 | 13.4 | 13.4 | 13.4 |
| Ash or Unburned Carbon | C | 1.6 | 1.8 | 1.7 | 1.7 | 1.5 |
| TOTAL | | 100 | 100.1 | 99.9 | 100 | 99.9 |
| PERFORMANCE FACTORS | | | | | | |
| Autoignition Temp, ° F. | | 680 | 730 | 710 | 730 | 700 |
| Open tube burn | | burn fast | just burn | burn fast | just burn | burn fast |
| Burn rate, secs/in. | | 6.7 | 7.7 | 7 | 6.8 | 6.3 |
| Bulk Density | | 0.83 | 0.81 | 0.83 | 0.84 | 0.84 |
| Moisture, wt. % | | 0.8 | 0.9 | 0.7 | 0.8 | 0.8 |
| Ballistics 80 gr.vol. | | | | | | |
| Lo velocity, fps | | 1918 | 1762 | 1931 | 1794 | 1983 |
| Hi velocity, fps | | 2123 | 1795 | 2026 | 1808 | 2010 |
| ES velocity, fps | | 205 | 33 | 95 | 14 | 27 |
| Av velocity, fps | | 2030 | 1781 | 1994 | 1800 | 1999 |

TABLE 1-continued

| Gluconate Formulations | | | | | | |
|---|---|---|---|---|---|---|
| SD velocity, fps | | 86 | 14 | 39 | 5 | 10 |
| TTP, ms. | | 0.6 | 0.9 | 0.7 | 0.7 | 0.7 |
| Pressure, psi max. | | 17000 | 6300 | 11800 | 6700 | 15800 |
| Fouler pressure, psi | | 15100 | 4300 | 13000 | 5400 | 14900 |
| | Chemical Formula | Ref #661 | Ref #143 | Ref #88 | Ref #87 | Ref #678 |
| RAW MATERIALS, wt. % | | | | | | |
| Carbon Black | C | 0.33 | 0.5 | 0.5 | 0.5 | |
| Charcoal | C | 3.15 | 3 | | | 5.70 |
| Dextrin | $C_6H_{10}O_5$ | 6.00 | 6 | 6 | 4 | |
| Dicyanodiamide | $C_2H_4N_4$ | | | | | |
| Graphite | C | | | | | |
| Lactose | $C_{12}H_{22}O_{11}$ | | | | | |
| Sodium m-Nitrobenzoate | $C_7H_4NO_4Na$ | | | | | |
| Potassium Nitrate | $KNO_3$ | 31.15 | 29.3 | 19.6 | 20 | 34.00 |
| Potassium Perchlorate | $KClO_4$ | 32.55 | 33.6 | 42.4 | 43.3 | 32.60 |
| Sodium Benzoate | $C_7H_5NaO_2$ | 14.00 | 14.5 | 18.1 | 18.5 | 11.00 |
| Potassium Benzoate | $C_7H_5KO_2$ | | | | | |
| Sodium Gluconate | $C_6H_{11}NaO_7$ | 12.43 | 12.7 | 13 | 13.3 | 16.30 |
| Potassium Gluconate | $C_6H_{11}KO_7$ | | | | | |
| Sulfur | S | | | | | |
| Tricalcium Phosphate | $Ca_3(PO_4)_2$ | 0.40 | 0.4 | 0.4 | 0.4 | 0.40 |
| TOTAL | | 100.00 | 100 | 100 | 100 | 100.00 |
| COMBUSTION PRODUCTS, wt. % | | | | | | |
| Ammonium Carbonate | $(NH_4)_2CO_3$ | | | | | |
| Carbon Dioxide | $CO_2$ | | | | 0.8 | 10.30 |
| Carbon Monoxide | CO | 33.90 | 34.2 | 34.9 | 34.9 | 23.40 |
| Hydrogen Sulfide | $H_2S$ | | | | | |
| Methane | $CH_4$ | | | | | |
| Nitrogen | $N_2$ | 4.30 | 4.1 | 2.7 | 2.8 | 4.70 |
| Potassium Carbonate | $K_2CO_3$ | 32.00 | 30.9 | 26.3 | 26.5 | 33.70 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 6.10 | 6.3 | 8.8 | 9.5 | 6.10 |
| Sodium Carbonate | $Na_2CO_3$ | | | | | |
| Sodium Chloride | NaCl | 8.90 | 9.2 | 10.9 | 10.9 | 8.90 |
| Tricalcium Phosphate | $Ca_3(PO_4)_2$ | 0.40 | 0.4 | 0.4 | 0.4 | 0.40 |
| Water | $H_2O$ | 13.40 | 13.4 | 15.2 | 14.3 | 10.70 |
| Ash or Unburned Carbon | C | 1.00 | 1.5 | | | 1.80 |
| TOTAL | | 100.00 | 100 | 99.2 | 100.1 | 100.00 |
| PERFORMANCE FACTORS | | | | | | |
| Autoignition Temp, ° F. | | 750 | 720 | 700 | 690 | 670 |
| Open tube burn | | just burn | just burn | just burn fast | just burn fast | just burn |
| Burn rate, secs/in. | | 8.3 | 6.8 | 6.7 | 6.5 | 7.6 |
| Bulk Density | | 0.84 | 0.84 | 0.83 | 0.79 | 0.72 |
| Moisture, wt. % | | 0.8 | 0.6 | 0.7 | 0.7 | 0.7 |
| Ballistics 80 gr.vol. | | | | | | |
| Lo velocity, fps | | 1908 | 1990 | 1547 | 1753 | 1653 |
| Hi velocity, fps | | 1933 | 2072 | 1951 | 2025 | 1700 |
| ES velocity, fps | | 25 | 82 | 289 | 272 | 47 |
| Av velocity, fps | | 1919 | 2020 | 1786 | 1854 | 1673 |
| SD velocity, fps | | 11 | 31 | 120 | 148 | 18 |
| TTP, ms. | | 0.7 | 0.7 | 0.3 | 0.3 | 0.5 |
| Pressure, psi max. | | 11100 | 12800 | 23600 | 21200 | 19100 |
| Fouler pressure, psi | | 10200 | 12000 | 23800 | 19700 | 19100 |
| | Chemical Formula | Ref #98 | Ref #103 | Ref #105 | Ref #116 | Ref #99 |
| RAW MATERIALS, wt. % | | | | | | |
| Carbon Black | C | 0.5 | 0.5 | 0.5 | 0.5 | 0.5 |
| Charcoal | C | | | | | |
| Dextrin | $C_6H_{10}O_5$ | 6 | 6 | 6 | 6 | 6 |
| Dicyanodiamide | $C_2H_4N_4$ | | | | | |
| Graphite | C | | | | | |
| Lactose | $C_{12}H_{22}O_{11}$ | | | | | |
| Sodium m-Nitrobenzoate | $C_7H_4NO_4Na$ | | | | | |

TABLE 1-continued

| | | Gluconate Formulations | | | | |
|---|---|---|---|---|---|---|
| Potassium Nitrate | $KNO_3$ | 25.1 | 28 | 29.4 | | 30.7 |
| Potassium Perchlorate | $KClO_4$ | 35.8 | 32.5 | 30.9 | 60.3 | 29.3 |
| Sodium Benzoate | $C_7H_5NaO_2$ | 15.4 | 14 | 13.3 | 13.3 | 12.6 |
| Potassium Benzoate | $C_7H_5KO_2$ | | | | | |
| Sodium Gluconate | $C_6H_{11}NaO_7$ | 16.8 | 18.6 | 19.5 | 19.5 | 20.5 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | | | | 9.3 | |
| Carbon Monoxide | CO | 32.9 | 32.6 | 32.2 | 32.1 | 31 |
| Hydrogen Sulfide | $H_2S$ | | | | | |
| Methane | $CH_4$ | | | | | |
| Nitrogen | $N_2$ | 3.5 | 3.9 | 4.1 | | 4.3 |
| Potassium Carbonate | $K_2CO_3$ | 29.7 | 31.8 | 32.9 | 12.7 | 33.6 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 5.7 | 3.8 | 2.9 | 18.7 | 2.1 |
| Sodium Carbonate | $Na_2CO_3$ | | | | | |
| Sodium Chloride | NaCl | 10.7 | 10.7 | 10.7 | 10.7 | 10.7 |
| Tricalcium Phosphate | $Ca_3(PO_4)_2$ | 0.4 | 0.4 | 0.4 | 0.4 | 0.4 |
| Water | $H_2O$ | 16.1 | 16.1 | 16.1 | 16.1 | 17 |
| Ash or Unburned Carbon | C | | 0.8 | 0.7 | | |
| TOTAL | | 99 | 100.1 | 100 | 100 | 99.1 |
| PERFORMANCE FACTORS | | | | | | |
| Autoignition Temp, ° F. | | 700 | 660 | 670 | 740 | 700 |
| Open tube burn | | just burn | just burn | just burn | burn fast | just burn |
| Burn rate, secs/in. | | 9.2 | 10.1 | 10.8 | 6.7 | 11 |
| Bulk Density | | 0.84 | 0.85 | 0.84 | 0.88 | 0.83 |
| Moisture, wt. % | | 0.8 | 0.8 | 0.7 | 0.8 | 0.8 |
| Ballistics 80 gr.vol. | | | | | | |
| Lo velocity, fps | | 1998 | 1909 | 1638 | only | 1475 |
| Hi velocity, fps | | 2044 | 1942 | 1697 | one | 1603 |
| ES velocity, fps | | 46 | 33 | 59 | shot | 128 |
| Av velocity, fps | | 2021 | 1922 | 1667 | 2151 | 1537 |
| SD velocity, fps | | 20 | 15 | 25 | | 45 |
| TTP, ms. | | 0.7 | 0.8 | 0.9 | 0.3 | 1 |
| Pressure, psi max. | | 13000 | 9000 | 6200 | 34900 | 4900 |
| Fouler pressure, psi | | | 9000 | 4800 | 34900 | 3400 |

| | Chemical Formula | Ref #89 | Ref #580 | Ref #670 |
|---|---|---|---|---|
| RAW MATERIALS, wt. % | | | | |
| Carbon Black | C | 0.5 | | |
| Charcoal | C | | | |
| Dextrin | $C_6H_{10}O_5$ | 6 | 6.00 | |
| Dicyanodiamide | $C_2H_4N_4$ | | | |
| Graphite | C | | | |
| Lactose | $C_{12}H_{22}O_{11}$ | | | |
| Sodium m-Nitrobenzoate | $C_7H_4NO_4Na$ | | | |
| Potassium Nitrate | $KNO_3$ | 36.3 | | 55.50 |
| Potassium Perchlorate | $KClO_4$ | 22.8 | 62.00 | |
| Sodium Benzoate | $C_7H_5NaO_2$ | 9.8 | | |
| Potassium Benzoate | $C_7H_5KO_2$ | | | |
| Sodium Gluconate | $C_6H_{11}NaO_7$ | 24.2 | 31.60 | 44.10 |
| Potassium Gluconate | $C_6H_{11}KO_7$ | | | |
| Sulfur | S | | | |
| Tricalcium Phosphate | $Ca_3(PO_4)_2$ | 0.4 | 0.40 | 0.40 |
| TOTAL | | 100 | 100.00 | 100.00 |
| COMBUSTION PRODUCTS, wt. % | | | | |
| Ammonium Carbonate | $(NH_4)_2CO_3$ | | | |
| Carbon Dioxide | $CO_2$ | | 33.80 | 23.60 |
| Carbon Monoxide | CO | 29.1 | 6.90 | |
| Hydrogen Sulfide | $H_2S$ | | | |
| Methane | $CH_4$ | | | |

TABLE 1-continued

| Gluconate Formulations | | | | |
|---|---|---|---|---|
| Nitrogen | $N_2$ | 5 | | 7.70 |
| Potassium Carbonate | $K_2CO_3$ | 36.2 | 9.90 | 38.00 |
| Potassium Thiocyanate | KCNS | | | |
| Potassium Sulfate | $K_2SO_4$ | | | |
| Potassium Thiosulfate | $K_2S_2O_3$ | | | |
| Potassium Sulfide | $K_2S$ | | | |
| Potassium Chloride | KCl | | 22.70 | |
| Sodium Carbonate | $Na_2CO_3$ | 0.7 | | 10.70 |
| Sodium Chloride | NaCl | 9.6 | 8.40 | |
| Tricalcium Phosphate | $Ca_3(PO_4)_2$ | 0.4 | 0.40 | 0.40 |
| Water | $H_2O$ | 17.9 | 17.90 | 19.60 |
| Ash or Unburned Carbon | C | | | |
| TOTAL | | 98.9 | 100.00 | 100.0 |
| PERFORMANCE FACTORS | | | | |
| Autoignition Temp, ° F. | | 660 | 740 | 620 |
| Open tube burn | | burn slow | just burned | slow burn |
| Burn rate, secs/in. | | 12.7 | 8.3 | 13 |
| Bulk Density | | 0.79 | 0.8 | 0.63 |
| Moisture, wt. % | | 0.6 | 0.8 | 0.1 |
| Ballistics 80 gr.vol. | | | | |
| Lo velocity, fps | | 1100 | 1647 | low |
| Hi velocity, fps | | 1140 | 1847 | |
| ES velocity, fps | | 40 | 200 | |
| Av velocity, fps | | 1121 | 1783 | |
| SD velocity, fps | | 140 | 80 | |
| TTP, ms. | | 1.1 | 0.7-1.3 | |
| Pressure, psi max. | | 1600 | 8300 | 500 |
| Fouler pressure, psi | | 900 | 3600 | |

In the following Table 2 representative examples are shown of propellant formulations in which the sodium nitrobenzoate salt sodium meta-nitrobenzoate alone serves as the ignition aid for the oxidizing and reducing agents as indicated.

TABLE 2

| Sodium m-Nitrobenzoate Formulations | | | | | | |
|---|---|---|---|---|---|---|
| RAW MATERIALS, wt. % | Chemical Formula | Mole Weight | Black Powder | Ref #795 | Ref #791 | Ref #792 |
| Carbon Black | C | 12.01 | | | | |
| Charcoal | C | 12.01 | 15.00 | 5.6 | 5.7 | 5.7 |
| Dextrin | $C_6H_{10}O_5$ | 162.14 | | 8 | 5.8 | 6.8 |
| Dicyanodiamide | $C_2H_4N_4$ | 84.08 | | 4.9 | 6 | 5 |
| Graphite | C | 12.01 | | | | |
| Lactose | $C_{12}H_{22}O_{11}$ | 360.31 | | | | |
| Sodium m-Nitrobenzoate | $C_7H_4NO_4Na$ | 189.11 | | 7.3 | 7.4 | 7.4 |
| Potassium Nitrate | $KNO_3$ | 101.10 | 75.00 | 38.7 | 39.2 | 39.2 |
| Potassium Perchlorate | $KClO_4$ | 138.55 | | 29 | 29.4 | 29.4 |
| Sodium Benzoate | $C_7H_5NaO_2$ | 144.11 | | 6.1 | 6.1 | 6.1 |
| Potassium Benzoate | $C_7H_5KO_2$ | 160.22 | | | | |
| Sodium Gluconate | $C_6H_{11}NaO_7$ | 218.13 | | | | |
| Potassium Gluconate | $C_6H_{11}KO_7$ | 234.24 | | | | |
| Sulfur | S | 32.06 | 10.00 | | | |
| Tricalcium Phosphate | $Ca_3(PO_4)_2$ | 310.20 | | 0.4 | 0.4 | 0.4 |
| TOTAL | | | 100.00 | 100 | 100 | 100 |
| COMBUSTION PRODUCTS, wt. % | | | | | | |
| Ammonium Carbonate | $(NH_4)_2CO_3$ | 96.11 | 0.97 | | | |
| Carbon Dioxide | $CO_2$ | 44.01 | 24.93 | 7.1 | 9.1 | 9.3 |
| Carbon Monoxide | CO | 28.01 | 3.97 | 25.4 | 22.7 | 23 |
| Hydrogen Sulfide | $H_2S$ | 34.08 | 0.69 | | | |
| Methane | $CH_4$ | 16.04 | 0.49 | | | |
| Nitrogen | $N_2$ | 28.02 | 9.92 | 9.2 | 10 | 9.3 |
| Potassium Carbonate | $K_2CO_3$ | 138.20 | 26.56 | 32 | 32.5 | 32.5 |
| Potassium Thiocyanate | KCNS | 97.18 | 1.97 | | | |
| Potassium Sulfate | $K_2SO_4$ | 174.25 | 12.34 | | | |
| Potassium Thiosulfate | $K_2S_2O_3$ | 190.32 | 15.40 | | | |
| Potassium Sulfide | $K_2S$ | 110.26 | 2.23 | | | |
| Potassium Chloride | KCl | 74.56 | | 9.5 | 9.7 | 9.7 |
| Sodium Carbonate | $Na_2CO_3$ | 105.99 | | 0 | | |
| Sodium Chloride | NaCl | 58.45 | | 4.8 | 4.8 | 4.8 |

TABLE 2-continued

Sodium m-Nitrobenzoate Formulations

| | | | | | | |
|---|---|---|---|---|---|---|
| Tricalcium Phosphate | $Ca_3(PO_4)_2$ | 310.20 | | 0.4 | 0.4 | 0.4 |
| Water | $H_2O$ | 18.02 | | 9.9 | 9.1 | 9.3 |
| Ash or Unburned Carbon | C | 12.01 | 0.53 | 1.7 | 1.7 | 1.7 |
| TOTAL | | | 100.00 | 100 | 100 | 100 |
| PERFORMANCE FACTORS | | | | | | |
| Autoignition Temp, ° F. | | | 580 | 800 | 840 | 800 |
| Open tube burn | | | just burn | | | |
| Burn rate, secs/in. | | | 2.3 | 6.3 | 6.1 | 6.2 |
| Bulk Density | | | 1 | 0.76 | 0.75 | 0.72 |
| Moisture, wt. % | | | <0.5 | 0.7 | 1 | 0.8 |
| Ballistics 80 gr. vol. | | | | | | |
| Lo velocity, fps | | | 1624 | 1869 | 1737 | 1739 |
| Hi velocity, fps | | | 1690 | 1948 | 1977 | 1857 |
| ES velocity, fps | | | 66 | 79 | 240 | 118 |
| Av velocity, fps | | | 1664 | 1911 | 1881 | 1792 |
| SD velocity, fps | | | 26 | 37 | 99 | 59 |
| TTP, ms. | | | 0.8 | 0.6 | 0.6 | 0.5 |
| Pressure, psi max. | | | 11000 | 11300 | 15800 | 17000 |
| Fouler pressure, psi | | | | 7500 | 11200 | 9300 |
| RAW MATERIALS, wt. % | | Chemical Formula | Ref #783 | Ref #694 | Ref #825 | Ref #824 |
| Carbon Black | | C | | | | |
| Charcoal | | C | 5.7 | 4 | | |
| Dextrin | | $C_6H_{10}O_5$ | 5.9 | 3.5 | | |
| Dicyanodiamide | | $C_2H_4N_4$ | 5 | | | |
| Graphite | | C | | | | |
| Lactose | | $C_{12}H_{22}O_{11}$ | | 8.5 | | |
| Sodium m-Nitrobenzoate | | $C_7H_4NO_4Na$ | 7.5 | 8 | 30.00 | 40.00 |
| Potassium Nitrate | | $KNO_3$ | 39.6 | 39.4 | | 59.60 |
| Potassium Perchlorate | | $KClO_4$ | 29.7 | 30.7 | 69.60 | |
| Sodium Benzoate | | $C_7H_5NaO_2$ | 6.2 | 5.5 | | |
| Potassium Benzoate | | $C_7H_5KO_2$ | | | | |
| Sodium Gluconate | | $C_6H_{11}NaO_7$ | | | | |
| Potassium Gluconate | | $C_6H_{11}KO_7$ | | | | |
| Sulfur | | S | | | | |
| Tricalcium Phosphate | | $Ca_3(PO_4)_2$ | 0.4 | 0.4 | 0.40 | 0.40 |
| TOTAL | | | 100 | 100.0 | 100.00 | 100.00 |
| COMBUSTION PRODUCTS, wt. % | | | | | | |
| Ammonium Carbonate | | $(NH_4)_2CO_3$ | | | | |
| Carbon Dioxide | | $CO_2$ | 11.2 | 18.6 | 45.40 | |
| Carbon Monoxide | | CO | 21 | 15.7 | | 28.00 |
| Hydrogen Sulfide | | $H_2S$ | | | | |
| Methane | | $CH_4$ | | | | |
| Nitrogen | | $N_2$ | 9.4 | 6.1 | 2.20 | 11.20 |
| Potassium Carbonate | | $K_2CO_3$ | 32.7 | 32.5 | 11.00 | 40.60 |
| Potassium Thiocyanate | | KCNS | | | | |
| Potassium Sulfate | | $K_2SO_4$ | | | | |
| Potassium Thiosulfate | | $K_2S_2O_3$ | | | | |
| Potassium Sulfide | | $K_2S$ | | | | |
| Potassium Chloride | | KCl | 9.9 | 10.5 | 25.50 | |
| Sodium Carbonate | | $Na_2CO_3$ | 0 | | | 11.30 |
| Sodium Chloride | | NaCl | 4.8 | 4.8 | 9.40 | |
| Tricalcium Phosphate | | $Ca_3(PO_4)_2$ | 0.4 | 0.4 | 0.40 | 0.40 |
| Water | | $H_2O$ | 8.8 | 10.2 | 5.60 | 7.50 |
| Ash or Unburned Carbon | | C | 1.8 | 1.2 | | |
| TOTAL | | | 100 | 100.0 | 99.5 | 99.0 |
| PERFORMANCE FACTORS | | | | | | |
| Autoignition Temp, ° F. | | | 860 | 750 | 780 | 740 |
| Open tube burn | | | | fast (693-) | bvf. prop. 9' | just burn |
| Burn rate, secs/in. | | | 6.9 | 6 | 4.2 | 4.4 |
| Bulk Density | | | 0.77 | 0.83 | 0.72 | 0.5 |
| Moisture, wt. % | | | 0.8 | 0.8 | 0.5 | 0.9 |
| Ballistics 80 gr. vol. | | | | | | |
| Lo velocity, fps | | | 1867 | 1907 | 1211 | 794 |
| Hi velocity, fps | | | 1955 | 1924 | 1461 | 853 |
| ES velocity, fps | | | 88 | 17 | 250 | 59 |
| Av velocity, fps | | | 1931 | 1914 | 1320 | 825 |
| SD velocity, fps | | | 36 | 7 | 127 | 29 |
| TTP, ms. | | | 0.6 | 0.7 | 0.1 | 0.2 |

TABLE 2-continued

| Sodium m-Nitrobenzoate Formulations | | | | |
|---|---|---|---|---|
| Pressure, psi max. | 14000 | 10200 | 22900 | 2000 |
| Fouler pressure, psi | 7600 | 8600 | 21000 | |

In the following Table 3 representative examples are shown of propellant formulations in which a mixture of a gluconic acid salt and a sodium nitrobenzoate salt serves as the ignition aid for the oxidizing and reducing agents as indicated.

TABLE 3

Gluconate with Sodium m-Nitrobenzoate Formulations

| RAW MATERIALS, wt. % | Chemical Formula | Mole Weight | Black Powder | Ref #781 | Ref #692 | Ref #784 |
|---|---|---|---|---|---|---|
| Carbon Black | C | 12.01 | | | | |
| Charcoal | C | 12.01 | 15.00 | 6.7 | 7 | 5.7 |
| Dextrin | $C_6H_{10}O_5$ | 162.14 | | 5.4 | 3.5 | 4.4 |
| Dicyanodiamide | $C_2H_4N_4$ | 84.08 | | 5 | | 5 |
| Graphite | C | 12.01 | | | | |
| Lactose | $C_{12}H_{22}O_{11}$ | 360.31 | | | 4 | |
| Sodium m-Nitrobenzoate | $C_7H_4NO_4Na$ | 189.11 | | 8.5 | 8 | 7.5 |
| Potassium Nitrate | $KNO_3$ | 101.10 | 75.00 | 38 | 39.4 | 39.6 |
| Potassium Perchlorate | $KClO_4$ | 138.55 | | 29.6 | 30.7 | 29.6 |
| Sodium Benzoate | $C_7H_5NaO_2$ | 144.11 | | 5.2 | 5.5 | 6.2 |
| Potassium Benzoate | $C_7H_5KO_2$ | 160.22 | | | | |
| Sodium Gluconate | $C_6H_{11}NaO_7$ | 218.13 | | 1.2 | 1.5 | 1.6 |
| Potassium Gluconate | $C_6H_{11}KO_7$ | 234.24 | | | | |
| Sulfur | S | 32.06 | 10.00 | | | |
| Tricalcium Phosphate | $Ca_3(PO_4)_2$ | 310.20 | | 0.4 | 0.4 | 0.4 |
| TOTAL | | | 100.00 | 100 | 100.0 | 100 |
| COMBUSTION PRODUCTS, wt.% | | | | | | |
| Ammonium Carbonate | $(NH_4)_2CO_3$ | 96.11 | 0.97 | | | |
| Carbon Dioxide | $CO_2$ | 44.01 | 24.93 | 8 | 16.8 | 11.4 |
| Carbon Monoxide | CO | 28.01 | 3.97 | 25 | 18.2 | 20.4 |
| Hydrogen Sulfide | $H_2S$ | 34.08 | 0.69 | | | |
| Methane | $CH_4$ | 16.04 | 0.49 | | | |
| Nitrogen | $N_2$ | 28.02 | 9.92 | 9.2 | 6.1 | 9.4 |
| Potassium Carbonate | $K_2CO_3$ | 138.20 | 26.56 | 31.8 | 32.9 | 33.2 |
| Potassium Thiocyanate | KCNS | 97.18 | 1.97 | | | |
| Potassium Sulfate | $K_2SO_4$ | 174.25 | 12.34 | | | |
| Potassium Thiosulfate | $K_2S_2O3$ | 190.32 | 15.40 | | | |
| Potassium Sulfide | K25 | 110.26 | 2.23 | | | |
| Potassium Chloride | KCI | 74.56 | | 9.5 | 10.1 | 9.3 |
| Sodium Carbonate | $Na2CO_3$ | 105.99 | | | | |
| Sodium Chloride | NaCl | 58.45 | | 5.1 | 5.1 | 5.3 |
| Tricalcium Phosphate | $Ca_3(PO_4)_2$ | 310.20 | | 0.4 | 0.4 | 0.4 |
| Water | $H_2O$ | 18.02 | | 8.9 | 8.2 | 8.8 |
| Ash or Unburned Carbon | C | 12.01 | 0.53 | 2.1 | 2.2 | 1.8 |
| TOTAL | | | 100.00 | 100 | 100.0 | 100 |
| PERFORMANCE FACTORS | | | | | | |
| Autoignition Temp, ° F. | | | 580 | 780 | 750 | 820 |
| Open tube burn | | | just burn | | fast | |
| Burn rate, secs/in. | | | 2.3 | 6.3 | 5.1 | 7.2 |
| Bulk Density | | | 1 | 0.77 | 0.81 | 0.74 |
| Moisture, wt. % | | | <0.5 | 0.8 | 0.9 | 0.8 |
| Ballistics 80 gr. vol. | | | | | | |
| Lo velocity, fps | | | 1624 | 1851 | 1914 | 1779 |
| Hi velocity, fps | | | 1690 | 1896 | 1968 | 1894 |
| ES velocity, fps | | | 66 | 45 | 54 | 115 |
| Av velocity, fps | | | 1664 | 1873 | 1935 | 1840 |
| SD velocity, fps | | | 26 | 19 | 20 | 43 |
| TTP, ms. | | | 0.8 | 0.6 | 0.6 | 0.6 |
| Pressure, psi max. | | | 11000 | 10400 | 11800 | 16800 |
| Fouler pressure, psi | | | | 8100 | 9000 | 7800 |
| RAW MATERIALS, wt. % | Chemical Formula | Ref #810A | Ref #806 | Ref #804 | Ref #807 | Ref #808 |
| Carbon Black | C | | | | | |
| Charcoal | C | 5.58 | 5.6 | 5.6 | 5.6 | 5.6 |
| Dextrin | $C_6H_{10}O_5$ | 5.78 | 5.8 | 5.8 | 5.8 | 5.8 |
| Dicyanodiamide | $C_2H_4N_4$ | 4.88 | 4.9 | 4.9 | 4.9 | 4.9 |
| Graphite | C | 0.35 | | | | |

TABLE 3-continued

| Gluconate with Sodium m-Nitrobenzoate Formulations | | | | | | |
|---|---|---|---|---|---|---|
| Lactose | $C_{12}H_{22}O_{11}$ | | | | | |
| Sodium m-Nitrobenzoate | $C_7H_4NO_4Na$ | 3.29 | 2.3 | 3.3 | 3.3 | 3.3 |
| Potassium Nitrate | $KNO_3$ | 39.57 | 38.7 | 38.7 | 39.7 | 39.7 |
| Potassium Perchlorate | $KClO_4$ | 27.90 | 29 | 29 | 29 | 28 |
| Sodium Benzoate | $C_7H_5NaO_2$ | 10.06 | 11.1 | 10.1 | 9.1 | 10.1 |
| Potassium Benzoate | $C_7H_5KO_2$ | | | | | |
| Sodium Gluconate | $C_6H_{11}NaO_7$ | 2.19 | 2.2 | 2.2 | 2.2 | 2.2 |
| Potassium Gluconate | $C_6H_{11}KO_7$ | | | | | |
| Sulfur | S | | | | | |
| Tricalcium Phosphate | $Ca_3(PO_4)_2$ | 0.40 | 0.4 | 0.4 | 0.4 | 0.4 |
| TOTAL | | 100.00 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | | 2.2 | 3.6 | 7.1 | 3 |
| Carbon Monoxide | CO | | 29.4 | 28.1 | 24.4 | 28.5 |
| Hydrogen Sulfide | $H_2S$ | | | | | |
| Methane | $CH_4$ | | | | | |
| Nitrogen | $N_2$ | | 8.8 | 8.9 | 9 | 9 |
| Potassium Carbonate | $K_2CO_3$ | | 33.2 | 33.1 | 33.5 | 33.5 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | | 8.2 | 8.3 | 8.7 | 8.2 |
| Sodium Carbonate | $Na_2CO_3$ | | | | | |
| Sodium Chloride | NaCl | | 5.8 | 5.7 | 5.4 | 5.5 |
| Tricalcium Phosphate | $Ca_3(PO_4)_2$ | | 0.4 | 0.4 | 0.4 | 0.4 |
| Water | $H_2O$ | | 10.3 | 10.2 | 9.8 | 10.2 |
| Ash or Unburned Carbon | C | | 1.7 | 1.7 | 1.7 | 1.7 |
| TOTAL | | | 100 | 100 | 100 | 100 |
| PERFORMANCE FACTORS | | | | | | |
| Autoignition Temp, ° F. | | | 800 | 810 | 820 | 800 |
| Open tube burn | | | | | | |
| Burn rate, secs/in. | | | 7.1 | 7.6 | 7.1 | 7.2 |
| Bulk Density | | | 0.84 | 0.81 | 0.8 | 0.82 |
| Moisture, wt. % | | | 0.9 | 0.8 | 0.8 | 0.9 |
| Ballistics 80 gr. vol. | | | | | | |
| Lo velocity, fps | | 1870 | 1868 | 1891 | 1907 | 1849 |
| Hi velocity, fps | | 1930 | 1902 | 1929 | 1972 | 1909 |
| ES velocity, fps | | 60 | 34 | 38 | 65 | 60 |
| Av velocity, fps | | 1908 | 1883 | 1913 | 1952 | 1885 |
| SD velocity, fps | | 24 | 15 | 20 | 26 | 22 |
| TTP, ms. | | 0.7 | 0.7 | 0.7 | 0.7 | 0.7 |
| Pressure, psi max. | | 10300 | 10000 | 11200 | 12000 | 9900 |
| Fouler pressure, psi | | 6400 | 7100 | 8000 | 7400 | 6600 |
| RAW MATERIALS, wt. % | Chemical Formula | Ref #803 | Ref #799 | Ref #802 | Ref #801 | Ref #789 |
| Carbon Black | C | | | | | |
| Charcoal | C | 5.6 | 3 | 5.6 | 5.6 | 5.5 |
| Dextrin | $C_6H_{10}O_5$ | 5.8 | 6 | 5.8 | 5.8 | 6.8 |
| Dicyanodiamide | $C_2H_4N_4$ | 4.9 | 4.9 | 4.9 | 4.9 | 4.9 |
| Graphite | C | | | | | |
| Lactose | $C_{12}H_{22}O_{11}$ | | | | | |
| Sodium m-Nitrobenzoate | $C_7H_4NO_4Na$ | 4.3 | 5 | 5.3 | 6.3 | 7.2 |
| Potassium Nitrate | $KNO_3$ | 38.7 | 38.7 | 38.7 | 38.7 | 38.3 |
| Potassium Perchlorate | $KClO_4$ | 29 | 29 | 29 | 29 | 28.7 |
| Sodium Benzoate | $C_7H_5NaO_2$ | 9.1 | 10.8 | 8.1 | 7.1 | 6 |
| Potassium Benzoate | $C_7H_5KO_2$ | | | | | |
| Sodium Gluconate | $C_6H_{11}NaO_7$ | 2.2 | 2.2 | 2.2 | 2.2 | 2.2 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 4.7 | 5.2 | 6 | 6.9 | 6.6 |
| Carbon Monoxide | CO | 27.2 | 25.8 | 25.9 | 25.3 | 25.6 |
| Hydrogen Sulfide | $H_2S$ | | | | | |
| Methane | $CH_4$ | | | | | |
| Nitrogen | $N_2$ | 8.9 | 9 | 9 | 9.1 | 9.1 |
| Potassium Carbonate | $K_2CO_3$ | 33.1 | 34.1 | 33.1 | 32.7 | 32.5 |

TABLE 3-continued

| Gluconate with Sodium m-Nitrobenzoate Formulations | | | | | | |
|---|---|---|---|---|---|---|
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 8.3 | 7.2 | 8.3 | 8.8 | 8.6 |
| Sodium Carbonate | $Na_2CO_3$ | | | | | |
| Sodium Chloride | NaCl | 5.7 | 6.6 | 5.7 | 5.3 | 5.3 |
| Tricalcium Phosphate | $Ca_3(PO_4)_2$ | 0.4 | 0.4 | 0.4 | 0.4 | 0.4 |
| Water | $H_2O$ | 10 | 10.8 | 9.9 | 9.8 | 10.2 |
| Ash or Unburned Carbon | C | 1.7 | 0.9 | 1.7 | 1.7 | 1.7 |
| TOTAL | | 100 | 100 | 100 | 100 | 100 |
| PERFORMANCE FACTORS | | | | | | |
| Autoignition Temp, ° F. | | 780 | 780 | 780 | 770 | 770 |
| Open tube burn | | | | | | |
| Burn rate, secs/in. | | 6.8 | 7.6 | 7.2 | 6.8 | 7.7 |
| Bulk Density | | 0.79 | 0.78 | 0.78 | 0.77 | 0.8 |
| Moisture, wt. % | | 0.9 | 0.7 | 0.9 | 0.8 | 0.8 |
| Ballistics 80 gr. vol. | | | | | | |
| Lo velocity, fps | | 1901 | 1896 | 1891 | 1859 | 1823 |
| Hi velocity, fps | | 1988 | 1968 | 1912 | 1945 | 1866 |
| ES velocity, fps | | 87 | 72 | 21 | 86 | 43 |
| Av velocity, fps | | 1944 | 1942 | 1898 | 1902 | 1839 |
| SD velocity, fps | | 37 | 30 | 8 | 24 | 15 |
| TTP, ms. | | 0.6 | 0.6 | 0.7 | 0.6 | |
| Pressure, psi max. | | 13300 | 13100 | 10400 | 11600 | 8800 |
| Fouler pressure, psi | | 8500 | 9800 | 7000 | 5800 | 7300 |
| RAW MATERIALS, wt. % | Chemical Formula | Ref #782 | Ref #788 | Ref #812 | Ref #786 | Ref #776 |
| Carbon Black | C | | | | | |
| Charcoal | C | 5.6 | 5.6 | 5.6 | 6.1 | 6.7 |
| Dextrin | $C_6H_{10}O_5$ | 5.8 | 6.3 | 5.8 | 3.8 | 5.3 |
| Dicyanodiamide | $C_2H_4N_4$ | 4.9 | 4.9 | 4.9 | 5.3 | 5 |
| Graphite | C | | | | | |
| Lactose | $C_{12}H_{22}O_{11}$ | | | | | |
| Sodium m-Nitrobenzoate | $C_7H_4NO_4Na$ | 7.3 | 7.3 | 7.3 | 7.9 | 8.4 |
| Potassium Nitrate | $KNO_3$ | 38.7 | 38.4 | 38.7 | 38.7 | 37.5 |
| Potassium Perchlorate | $KClO_4$ | 29 | 28.8 | 29 | 29 | 29.3 |
| Sodium Benzoate | $C_7H_5NaO_2$ | 6.1 | 6.1 | 6.6 | 5.2 | |
| Potassium Benzoate | $C_7H_5KO_2$ | 6.1 | | | | |
| Sodium Gluconate | $C_6H_{11}NaO_7$ | 2.2 | 2.2 | 2.2 | 2.2 | 2.2 |
| Potassium Gluconate | $C_6H_{11}KO_7$ | | | | | |
| Sulfur | S | | | | | |
| Tricalcium Phosphate | $Ca_3(PO4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 8 | 6.9 | 9.9 | 7.5 | 5.9 |
| Carbon Monoxide | CO | 24.3 | 25.4 | 22.2 | 24.7 | 26.8 |
| Hydrogen Sulfide | $H_2S$ | | | | | |
| Methane | $CH_4$ | | | | | |
| Nitrogen | $N_2$ | 9.2 | 9.1 | 9.2 | 9.5 | 9.2 |
| Potassium Carbonate | $K_2CO_3$ | 32.7 | 32.5 | 32.4 | 33 | 31.8 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 8.8 | 8.8 | 12 | 8.4 | 9.1 |
| Sodium Carbonate | $Na_2CO_3$ | | | | | |
| Sodium Chloride | NaCl | 5.3 | 5.3 | 2.8 | 5.6 | 5.3 |
| Tricalcium Phosphate | $Ca_3(PO_4)_2$ | 0.4 | 0.4 | 0.4 | 0.4 | 0.4 |
| Water | $H_2O$ | 9.6 | 9.9 | 9.4 | 9 | 9.4 |
| Ash or Unburned Carbon | C | 1.7 | 1.7 | 1.7 | 1.9 | 2.1 |
| TOTAL | | 100 | 100 | 100 | 100 | 100 |
| PERFORMANCE FACTORS | | 40 gr vol. | | | | |
| Autoignition Temp, ° F. | | 800 | 780 | 780 | 810 | 780 |
| Open tube burn | | fast, blk. fstr. | | | | |
| Burn rate, secs/in. | | 4.9 | 7.3 | 6.7 | 7.1 | 7 |
| Bulk Density | | 0.98 | 0.79 | 0.82 | 0.74 | 0.77 |
| Moisture, wt. % | | 0.7 | 0.7 | 0.7 | 0.9 | 0.9 |
| Ballistics 80 gr. vol. | | | | | | |
| Lo velocity, fps | | 1676 | 1892 | 1975 | 1800 | 1871 |

TABLE 3-continued

Gluconate with Sodium m-Nitrobenzoate Formulations

| | | | | | | |
|---|---|---|---|---|---|---|
| Hi velocity, fps | | 1706 | 1931 | 2012 | 1868 | 1901 |
| ES velocity, fps | | 30 | 39 | 37 | 68 | 30 |
| Av velocity, fps | | 1695 | 1908 | 1986 | 1842 | 1890 |
| SD velocity, fps | | 12 | 14 | 14 | 27 | 12 |
| TTP, ms. | | 0.2 | 0.6 | 0.6 | 0.6 | 0.65 |
| Pressure, psi max. | | 13100 | 10400 | 11800 | 12100 | 10500 |
| Fouler pressure, psi | | 12600 | 8500 | 10000 | 8100 | 8400 |
| RAW MATERIALS, wt. % | Chemical Formula | Ref #800 | Ref #780 | Ref #809 | Ref #805 | Ref #815 |
| Carbon Black | C | | | | | |
| Charcoal | C | 3.3 | 6.5 | 5.6 | 5.6 | 6.6 |
| Dextrin | $C_6H_{10}O_5$ | 6 | 5.2 | 5.8 | 5.8 | 4.8 |
| Dicyanodiamide | $C_2H_4N_4$ | 5.4 | 4.8 | 3.9 | 4.9 | 5.9 |
| Graphite | C | | | | | |
| Lactose | $C_{12}H_{22}O_{11}$ | | | | | |
| Sodium m-Nitrobenzoate | $C_7H_4NO_4Na$ | 3 | 8.1 | 2.3 | 4.3 | 6.3 |
| Potassium Nitrate | $KNO_3$ | 38.7 | 36.4 | 38.7 | 38.7 | 38.7 |
| Potassium Perchlorate | $KClO_4$ | 29 | 28.4 | 29 | 29 | 29 |
| Sodium Benzoate | $C_7H_5NaO_2$ | 11.8 | 7.1 | 11.1 | 8.1 | 5.1 |
| Potassium Benzoate | $C_7H_5KO_2$ | | | | | |
| Sodium Gluconate | $C_6H_{11}NaO_7$ | 2.4 | 3.1 | 3.2 | 3.2 | 3.2 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 3.6 | | 2.7 | 6 | 8.2 |
| Carbon Monoxide | CO | 26.9 | 32.9 | 29.2 | 25.7 | 23.8 |
| Hydrogen Sulfide | $H_2S$ | | | | | |
| Methane | $CH_4$ | | | | | |
| Nitrogen | $N_2$ | 9.2 | 8.8 | 8.1 | 8.9 | 9.8 |
| Potassium Carbonate | $K_2CO_3$ | 34.1 | 32 | 33.6 | 33.2 | 32 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 7.3 | 7.6 | 7.8 | 8.2 | 9.5 |
| Sodium Carbonate | $Na_2CO_3$ | | | | | |
| Sodium Chloride | NaCl | 6.4 | 6.1 | 6.1 | 5.7 | 4.8 |
| Tricalcium Phosphate | $Ca_3(PO_4)_2$ | 0.4 | 0.4 | 0.4 | 0.4 | 0.4 |
| Water | $H_2O$ | 11.1 | 10.2 | 10.4 | 10.2 | 9.5 |
| Ash or Unburned Carbon | C | 1 | 2 | 1.7 | 1.7 | 2 |
| TOTAL | | 100 | 100 | 100 | 100 | 100 |
| PERFORMANCE FACTORS | | | | | | |
| Autoignition Temp, ° F. | | 780 | 780 | 810 | 780 | 730 |
| Open tube burn | | | | | | |
| Burn rate, secs/in. | | 9.9 | 7 | 7.3 | 7.1 | 6 |
| Bulk Density | | 0.75 | 0.8 | 0.82 | 0.76 | 0.75 |
| Moisture, wt. % | | 0.8 | 0.9 | 0.8 | 0.8 | 0.8 |
| Ballistics 80 gr. vol. | | | | | | |
| Lo velocity, fps | | 1789 | 1762 | 1939 | 1854 | 1835 |
| Hi velocity, fps | | 1865 | 1841 | 1985 | 1899 | 1908 |
| ES velocity, fps | | 76 | 79 | 46 | 45 | 73 |
| Av velocity, fps | | 1821 | 1816 | 1964 | 1879 | 1875 |
| SD velocity, fps | | 29 | 31 | 21 | 18 | 26 |
| TTP, ms. | | 0.6 | 0.7 | 0.7 | 0.7 | 0.7 |
| Pressure, psi max. | | 15300 | 9200 | 12000 | 10700 | 10000 |
| Fouler pressure, psi | | 7100 | 7500 | 8400 | 7100 | 6800 |
| RAW MATERIALS, wt. % | Chemical Formula | Ref #768 | Ref #761 | Ref #763 | Ref #765 | Ref #769 |
| Carbon Black | C | | | | | |
| Charcoal | C | 6.7 | 7.6 | 6.5 | 6.5 | 6.5 |
| Dextrin | $C_6H_{10}O_5$ | 5.4 | 5.2 | 6.3 | 5.2 | 5.2 |
| Dicyanodiamide | $C_2H_4N_4$ | 5 | 4.9 | 4.8 | 5.9 | 4.8 |
| Graphite | C | | | | | |
| Lactose | $C_{12}H_{22}O_{11}$ | | | | | |
| Sodium m-Nitrobenzoate | $C_7H_4NO_4Na$ | 7.3 | 8.2 | 8.2 | 8.2 | 8.2 |
| Potassium Nitrate | $KNO_3$ | 37.6 | 36.8 | 36.8 | 36.8 | 38.2 |
| Potassium Perchlorate | $KClO_4$ | 29.3 | 28.7 | 28.7 | 28.7 | 28.5 |
| Sodium Benzoate | $C_7H_5NaO_2$ | 5.1 | 5 | 5.1 | 5.1 | 5 |
| Potassium Benzoate | $C_7H_5KO_2$ | | | | | |

TABLE 3-continued

| Gluconate with Sodium m-Nitrobenzoate Formulations | | | | | | |
|---|---|---|---|---|---|---|
| Sodium Gluconate | $C_6H_{11}NaO_7$ | 3.2 | 3.2 | 3.2 | 3.2 | 3.2 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 6.9 | 2.5 | 3.4 | 2.6 | 6.8 |
| Carbon Monoxide | CO | 25.9 | 30.8 | 29.5 | 29.7 | 25.9 |
| Hydrogen Sulfide | $H_2S$ | | | | | |
| Methane | $CH_4$ | | | | | |
| Nitrogen | $N_2$ | 9.1 | 9 | 8.9 | 9.6 | 9.1 |
| Potassium Carbonate | $K_2CO_3$ | 31.6 | 31.4 | 31.8 | 31.8 | 32.3 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.3 | 8.6 | 8.2 | 8.2 | 8.6 |
| Sodium Carbonate | $Na_2CO_3$ | | | | | |
| Sodium Chloride | NaCl | 5.1 | 5.3 | 5.6 | 5.6 | 5.3 |
| Tricalcium Phosphate | $Ca_3(PO_4)_2$ | 0.4 | 0.4 | 0.4 | 0.4 | 0.4 |
| Water | $H_2O$ | 9.6 | 9.6 | 10.2 | 10.1 | 9.6 |
| Ash or Unburned Carbon | C | 2.1 | 2.4 | 2 | 2 | 2 |
| TOTAL | | 100 | 100 | 100 | 100 | 100 |
| PERFORMANCE FACTORS | | | | | | |
| Autoignition Temp, ° F. | | 780 | 790 | 800 | 780 | 780 |
| Open tube burn | | | | | | |
| Burn rate, secs/in. | | 6.9 | 6.7 | 7.2 | 7.2 | 6.9 |
| Bulk Density | | 0.81 | 0.78 | 0.85 | 0.78 | 0.8 |
| Moisture, wt. % | | 0.8 | 0.9 | 0.7 | 0.9 | 0.8 |
| Ballistics 80 gr. vol. | | | | | | |
| Lo velocity, fps | | 1848 | 1831 | 1839 | 1870 | 1840 |
| Hi velocity, fps | | 1885 | 1914 | 1864 | 1929 | 1885 |
| ES velocity, fps | | 37 | 83 | 25 | 59 | 45 |
| Av velocity, fps | | 1867 | 1885 | 1849 | 1893 | 1863 |
| SD velocity, fps | | 15 | 32 | 9 | 22 | 19 |
| TTP, ms. | | 0.6 | 0.6 | 0.7 | 0.65 | 0.65 |
| Pressure, psi max. | | 10400 | 10600 | 9200 | 11200 | 10300 |
| Fouler pressure, psi | | 8100 | 7700 | 7600 | 8400 | 7700 |
| RAW MATERIALS, wt. % | Chemical Formula | Ref #771 | Ref #773 | Ref #793 | Ref #759 | Ref #762 |
| Carbon Black | C | | | | | |
| Charcoal | C | 6.5 | 6.5 | 6.5 | 6.6 | 5.6 |
| Dextrin | $C_6H_{10}O_5$ | 5.2 | 5.3 | 6.3 | 5.3 | 5.4 |
| Dicyanodiamide | $C_2H_4N_4$ | 4.8 | 4.8 | 4.8 | 4.9 | 5 |
| Graphite | C | | | | | |
| Lactose | $C_{12}H_{22}O_{11}$ | | | | | |
| Sodium m-Nitrobenzoate | $C_7H_4NO_4Na$ | 8.2 | 8.2 | 8.2 | 8.3 | 8.4 |
| Potassium Nitrate | $KNO_3$ | 36.7 | 36.8 | 36.8 | 37.2 | 37.5 |
| Potassium Perchlorate | $KClO_4$ | 30 | 28.7 | 28.7 | 29 | 29.3 |
| Sodium Benzoate | $C_7H_5NaO_2$ | 5 | 6.1 | 5.1 | 5.1 | 5.2 |
| Potassium Benzoate | $C_7H_5KO_2$ | | | | | |
| Sodium Gluconate | $C_6H_{11}NaO_7$ | 3.2 | 3.2 | 3.2 | 3.2 | 3.2 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 6.9 | 2.8 | 3.4 | 5.2 | 7.7 |
| Carbon Monoxide | CO | 26.1 | 30.2 | 29.5 | 27.4 | 24.7 |
| Hydrogen Sulfide | $H_2S$ | | | | | |
| Methane | $CH_4$ | | | | | |
| Nitrogen | $N_2$ | 8.9 | 8.9 | 8.9 | 9 | 9.2 |
| Potassium Carbonate | $K_2CO_3$ | 31.3 | 32.1 | 31.8 | 32.1 | 32.3 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.5 | 7.9 | 8.2 | 8.5 | 8.6 |
| Sodium Carbonate | $Na_2CO_3$ | 0 | | | | |

TABLE 3-continued

| Gluconate with Sodium m-Nitrobenzoate Formulations | | | | | | |
|---|---|---|---|---|---|---|
| Sodium Chloride | NaCl | 5.3 | 5.8 | 5.6 | 5.6 | 5.6 |
| Tricalcium Phosphate | $Ca_3(PO_4)_2$ | 0.4 | 0.4 | 0.4 | 0.4 | 0.4 |
| Water | $H_2O$ | 9.6 | 9.9 | 10.2 | 9.7 | 9.8 |
| Ash or Unburned Carbon | C | 2 | 2 | 2 | 2.1 | 1.7 |
| TOTAL | | 100 | 100 | 100 | 100 | 100 |
| PERFORMANCE FACTORS | | | | | | |
| Autoignition Temp, ° F. | | 790 | 790 | | 800 | 800 |
| Open tube burn | | | | | | |
| Burn rate, secs/in. | | 6.8 | 7.1 | 6.8 | 6.4 | 7.3 |
| Bulk Density | | 0.75 | 0.78 | 0.74 | 0.77 | 0.78 |
| Moisture, wt. % | | 0.9 | 0.9 | 0.9 | 0.8 | 0.8 |
| Ballistics 80 gr. vol. | | | | | | |
| Lo velocity, fps | | 1818 | 1829 | 1823 | 1885 | 1882 |
| Hi velocity, fps | | 1912 | 1850 | 1852 | 1948 | 1908 |
| ES velocity, fps | | 94 | 21 | 29 | 63 | 26 |
| Av velocity, fps | | 1873 | 1844 | 1841 | 1913 | 1896 |
| SD velocity, fps | | 40 | 8 | 12 | 28 | 12 |
| TTP, ms. | | 0.6 | 0.7 | 0.6 | 0.6 | |
| Pressure, psi max. | | 12900 | 9400 | 10400 | 10900 | 10400 |
| Fouler pressure, psi | | 9200 | 7300 | 8000 | 8300 | 8500 |
| RAW MATERIALS, wt. % | Chemical Formula | Ref #764 | Ref #766 | Ref #770 | Ref #772 | Ref #774 |
| Carbon Black | C | | | | | |
| Charcoal | C | 6.7 | 6.7 | 6.7 | 6.7 | 6.7 |
| Dextrin | $C_6H_{10}O_5$ | 4.3 | 5.4 | 5.4 | 5.4 | 5.3 |
| Dicyanodiamide | $C_2H_4N_4$ | 5 | 3.9 | 5 | 5 | 5 |
| Graphite | C | | | | | |
| Lactose | $C_{12}H_{22}O_{11}$ | | | | | |
| Sodium m-Nitrobenzoate | $C_7H_4NO_4Na$ | 8.4 | 8.4 | 8.4 | 8.4 | 8.4 |
| Potassium Nitrate | $KNO_3$ | 37.6 | 37.6 | 36.2 | 37.7 | 37.6 |
| Potassium Perchlorate | $KClO_4$ | 29.3 | 29.3 | 29.5 | 28 | 29.3 |
| Sodium Benzoate | $C_7H_5NaO_2$ | 5.1 | 5.1 | 5.2 | 5.2 | 4.1 |
| Potassium Benzoate | $C_7H_5KO_2$ | | | | | |
| Sodium Gluconate | $C_6H_{11}NaO_7$ | 3.2 | 3.2 | 3.2 | 3.2 | 3.2 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 7.1 | 7.4 | 4.1 | 3.6 | 7.6 |
| Carbon Monoxide | CO | 25.5 | 25.8 | 29 | 29.1 | 25.2 |
| Hydrogen Sulfide | $H_2S$ | | | | | |
| Methane | $CH_4$ | | | | | |
| Nitrogen | $N_2$ | 9.2 | 8.4 | 9 | 9.2 | 9.2 |
| Potassium Carbonate | $K_2CO_3$ | 32.3 | 32.2 | 31.3 | 32.2 | 31.6 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 8.6 | 8.7 | 8.8 | 8.1 | 9.3 |
| Sodium Carbonate | $Na_2CO_3$ | 0 | | | | |
| Sodium Chloride | NaCl | 5.6 | 5.6 | 5.5 | 5.5 | 5.1 |
| Tricalcium Phosphate | $Ca_3(PO_4)_2$ | 0.4 | 0.4 | 0.4 | 0.4 | 0.4 |
| Water | $H_2O$ | 9.2 | 9.4 | 9.8 | 9.8 | 9.5 |
| Ash or Unburned Carbon | C | 2.1 | 2.1 | 2.1 | 2.1 | 2.1 |
| TOTAL | | 100 | 100 | 100 | 100 | 100 |
| PERFORMANCE FACTORS | | | | | | |
| Autoignition Temp, ° F. | | 790 | 780 | 780 | 780 | 790 |
| Open tube burn | | | | | | |
| Burn rate, secs/in. | | 7 | 5.8 | 7.1 | 7 | 6.8 |
| Bulk Density | | 0.75 | 0.77 | 0.81 | 0.74 | 0.76 |
| Moisture, wt. % | | 0.9 | 0.8 | 0.9 | 0.8 | 0.8 |
| Ballistics 80 gr. vol. | | | | | | |
| Lo velocity, fps | | 1848 | 1924 | 1812 | 1788 | 1825 |
| Hi velocity, fps | | 1919 | 1990 | 1850 | 1839 | 1931 |
| ES velocity, fps | | 71 | 66 | 38 | 51 | 106 |
| Av velocity, fps | | 1892 | 1960 | 1828 | 1815 | 1885 |
| SD velocity, fps | | 26 | 28 | 15 | 24 | 35 |
| TTP, ms. | | 0.6 | 0.6 | 0.7 | 0.7 | 0.6 |

TABLE 3-continued

Gluconate with Sodium m-Nitrobenzoate Formulations

| | | | | | | |
|---|---|---|---|---|---|---|
| Pressure, psi max. | | 10800 | 13400 | 9100 | 9300 | 10100 |
| Fouler pressure, psi | | 8500 | 9200 | 7000 | 7700 | 6900 |
| RAW MATERIALS, wt. % | Chemical Formula | Ref #767 | Ref #779 | Ref #756 | Ref #758 | Ref #760 |
| Carbon Black | C | | | | | |
| Charcoal | C | 6.5 | 6.7 | 6.6 | 6.6 | 6.6 |
| Dextrin | $C_6H_{10}O_5$ | 5.2 | 5.4 | 4.3 | 3.3 | 3.8 |
| Dicyanodiamide | $C_2H_4N_4$ | 4.8 | 5 | 5 | 6 | 5.5 |
| Graphite | C | | | | | |
| Lactose | $C_{12}H_{22}O_{11}$ | | | | | |
| Sodium m-Nitrobenzoate | $C_7H_4NO_4Na$ | 9.3 | 6.3 | 8.4 | 8.4 | 8.4 |
| Potassium Nitrate | $KNO_3$ | 36.8 | 38 | 37.6 | 37.6 | 37.6 |
| Potassium Perchlorate | $KClO_4$ | 28.7 | 29.7 | 29.3 | 29.3 | 29.3 |
| Sodium Benzoate | $C_7H_5NaO_2$ | 5.1 | 5.2 | 5.1 | 5.1 | 5.1 |
| Potassium Benzoate | $C_7H_5KO_2$ | | | | | |
| Sodium Gluconate | $C_6H_{11}NaO_7$ | 3.2 | 3.3 | 3.3 | 3.3 | 3.3 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 3.8 | 8.5 | 6.9 | 6.6 | 6.9 |
| Carbon Monoxide | CO | 29.1 | 24.1 | 25.7 | 25.5 | 25.4 |
| Hydrogen Sulfide | $H_2S$ | | | | | |
| Methane | $CH_4$ | | | | | |
| Nitrogen | $N_2$ | 9 | 9.1 | 9.2 | 9.8 | 9.5 |
| Potassium Carbonate | $K_2CO_3$ | 32.2 | 31.6 | 32.3 | 32.3 | 32.3 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 7.8 | 9.9 | 8.6 | 8.6 | 8.6 |
| Sodium Carbonate | $Na_2CO_3$ | | | | | |
| Sodium Chloride | NaCl | 5.9 | 4.8 | 5.6 | 5.6 | 5.6 |
| Tricalcium Phosphate | $Ca_3(PO_4)_2$ | 0.4 | 0.4 | 0.4 | 0.4 | 0.4 |
| Water | $H_2O$ | 9.8 | 9.5 | 9.3 | 9.1 | 9.2 |
| Ash or Unburned Carbon | C | 2 | 2.1 | 2 | 2.1 | 2.1 |
| TOTAL | | 100 | 100 | 100 | 100 | 100 |
| PERFORMANCE FACTORS | | | | | | |
| Autoignition Temp, ° F. | | 770 | 780 | 790 | 800 | 810 |
| Open tube burn | | | | | | |
| Burn rate, secs/in. | | 6.5 | 6.6 | 6.6 | 6.9 | 6.6 |
| Bulk Density | | 0.78 | 0.81 | 0.78 | 0.77 | 0.76 |
| Moisture, wt. % | | 0.9 | 0.8 | 0.9 | 0.8 | |
| Ballistics 80 gr. vol. | | | | | | |
| Lo velocity, fps | | 1826 | 1858 | 1912 | 1811 | 1852 |
| Hi velocity, fps | | 1893 | 1922 | 1950 | 1843 | 1923 |
| ES velocity, fps | | 67 | 64 | 38 | 32 | 71 |
| Av velocity, fps | | 1861 | 1895 | 1929 | 1827 | 1899 |
| SD velocity, fps | | 25 | 27 | 18 | 14 | 28 |
| TTP, ms. | | 0.6 | 0.6 | 0.6 | 0.6 | |
| Pressure, psi max. | | 11000 | 10600 | 12200 | 10400 | 10900 |
| Fouler pressure, psi | | 7700 | 6000 | 8300 | 8900 | 8100 |
| RAW MATERIALS, wt. % | Chemical Formula | Ref #755 | Ref #757 | Ref #778 | Ref #730 | Ref #723 |
| Carbon Black | C | | | | | |
| Charcoal | C | 6.7 | 6.7 | 4.6 | 5.7 | 6.5 |
| Dextrin | $C_6H_{10}O_5$ | 3.3 | 3.3 | 5.4 | 3.5 | 3.5 |
| Dicyanodiamide | $C_2H_4N_4$ | 5 | 6 | 5 | 5 | |
| Graphite | C | | | | | |
| Lactose | $C_{12}H_{22}O_{11}$ | 3.7 | | | | |
| Sodium m-Nitrobenzoate | $C_7H_4NO_4Na$ | 8.5 | 8.5 | 8.5 | 7.3 | 4.6 |
| Potassium Nitrate | $KNO_3$ | 38 | 37.4 | 38 | 39.4 | 40.5 |
| Potassium Perchlorate | $KClO_4$ | 29.6 | 29.2 | 29.5 | 30.7 | 31.5 |
| Sodium Benzoate | $C_7H_5NaO_2$ | 5.2 | 5.2 | 5.3 | 4.4 | 5.1 |
| Potassium Benzoate | $C_7H_5KO_2$ | | | | | |
| Sodium Gluconate | $C_6H_{11}NaO_7$ | 3.3 | 3.3 | 3.3 | 3.6 | 4.2 |

TABLE 3-continued

| Gluconate with Sodium m-Nitrobenzoate Formulations | | | | | | |
|---|---|---|---|---|---|---|
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100 | 100.0 |
| COMBUSTION PRODUCTS, wt. % | | | | | | |
| Ammonium Carbonate | $(NH_4)_2CO_3$ | | | | | |
| Carbon Dioxide | $CO_2$ | 8.8 | 6 | 10.2 | 17.3 | 23.1 |
| Carbon Monoxide | CO | 23.9 | 26.2 | 21.9 | 14.6 | 11.2 |
| Hydrogen Sulfide | $H_2S$ | | | | | |
| Methane | $CH_4$ | | | | | |
| Nitrogen | $N_2$ | 9.2 | 9.8 | 9.2 | 9.3 | 6 |
| Potassium Carbonate | $K_2CO_3$ | 32.5 | 32 | 32.7 | 32.9 | 33 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 8.8 | 8.8 | 8.7 | 10.1 | 11.2 |
| Sodium Carbonate | $Na_2CO_3$ | | | | | |
| Sodium Chloride | NaCl | 5.6 | 5.5 | 5.6 | 5.1 | 4.6 |
| Tricalcium Phosphate | $Ca_3(PO_4)_2$ | 0.4 | 0.4 | 0.4 | 0.4 | 0.4 |
| Water | $H_2O$ | 8.7 | 9.2 | 9.9 | 8.5 | 8.5 |
| Ash or Unburned Carbon | C | 2.1 | 2.1 | 1.4 | 1.8 | 2 |
| TOTAL | | 100 | 100 | 100 | 100 | 100.0 |
| PERFORMANCE FACTORS | | | | | | |
| Autoignition Temp, ° F. | | 800 | 800 | 790 | 800 | 720 |
| Open tube burn | | | | | | |
| Burn rate, secs/in. | | 6.8 | 7.4 | 7.2 | 6.8 | 6.3 |
| Bulk Density | | 0.78 | 0.74 | 0.79 | 0.81 | 0.83 |
| Moisture, wt. % | | 0.8 | 0.9 | 0.9 | 0.8 | 0.7 |
| Ballistics 80 gr. vol. | | | | | | |
| Lo velocity, fps | | 1846 | 1747 | 1854 | 1902 | 1901 |
| Hi velocity, fps | | 1922 | 1801 | 1896 | 1947 | 1940 |
| ES velocity, fps | | 76 | 54 | 41 | 45 | 39 |
| Av velocity, fps | | 1902 | 1778 | 1879 | 1928 | 1921 |
| SD velocity, fps | | 31 | 24 | 16 | 19 | 17 |
| TTP, ms. | | 0.5 | 0.6 | 0.6 | 0.7 | 0.8 |
| Pressure, psi max. | | 13100 | 9600 | 9800 | 10900 | 9700 |
| Fouler pressure, psi | | 10500 | 6800 | 7600 | 9000 | 6200 |
| RAW MATERIALS, wt. % | Chemical Formula | Ref #794 | Ref #775 | Ref #729A | Ref #747A | Ref #729 |
| Carbon Black | C | | | | | |
| Charcoal | C | 5.6 | 6.5 | 6.68 | 6.68 | 6.7 |
| Dextrin | $C_6H_{10}O_5$ | 3.8 | 5.3 | 3.29 | 3.29 | 3.3 |
| Dicyanodiamide | $C_2H_4N_4$ | 4.9 | 4.8 | 4.98 | 2.49 | 5 |
| Graphite | C | 0.35 | 0.35 | | | |
| Lactose | $C_{12}H_{22}O_{11}$ | | | | | |
| Sodium m-Nitrobenzoate | $C_7H_4NO_4Na$ | 7.3 | 8.2 | 8.47 | 8.47 | 8.5 |
| Potassium Nitrate | $KNO_3$ | 38.7 | 36.8 | 37.27 | 37.27 | 37.4 |
| Potassium Perchlorate | $KClO_4$ | 29 | 28.7 | 29.10 | 29.10 | 29.2 |
| Sodium Benzoate | $C_7H_5NaO_2$ | 6.1 | 5.1 | 5.18 | 7.67 | 5.2 |
| Potassium Benzoate | $C_7H_5KO_2$ | | | | | |
| Sodium Gluconate | $C_6H_{11}NaO_7$ | 4.2 | 4.2 | 4.28 | 4.28 | 4.3 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.40 | 0.40 | 0.4 |
| TOTAL | | 100 | 100 | 100.00 | 100.00 | 100 |
| COMBUSTION PRODUCTS, wt. % | | | | | | |
| Ammonium Carbonate | $(NH_4)_2CO_3$ | | | | | |
| Carbon Dioxide | $CO_2$ | 9.3 | 4.1 | | 5.2 | 6.7 |
| Carbon Monoxide | CO | 22.6 | 28.6 | | 28.4 | 26 |
| Hydrogen Sulfide | $H_2S$ | | | | | |
| Methane | $CH_4$ | | | | | |
| Nitrogen | $N_2$ | 9.2 | 8.9 | | 7.5 | 9.1 |
| Potassium Carbonate | $K_2CO_3$ | 33.4 | 32.2 | | 33.7 | 32.4 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 8 | 7.8 | | 6.9 | 8.3 |
| Sodium Carbonate | $Na_2CO_3$ | 0 | | | | |
| Sodium Chloride | NaCl | 5.9 | 5.9 | | 6.9 | 5.8 |

TABLE 3-continued

| Gluconate with Sodium m-Nitrobenzoate Formulations | | | | | | |
|---|---|---|---|---|---|---|
| Tricalcium Phosphate | $Ca_3(PO_4)_2$ | 0.4 | 0.4 | | 0.4 | 0.4 |
| Water | $H_2O$ | 9.5 | 10.1 | | 8.9 | 9.2 |
| Ash or Unburned Carbon | C | 1.7 | 2 | | 2.1 | 2.1 |
| TOTAL | | 100 | 100 | | 100 | 100 |
| PERFORMANCE FACTORS | | | | | | |
| Autoignition Temp, ° F. | | 810 | 780 | | | 820 |
| Open tube burn | | | | | | |
| Burn rate, secs/in. | | 6.9 | 7.2 | | | 6.3 |
| Bulk Density | | 0.76 | 0.79 | | | 0.77 |
| Moisture, wt. % | | 0.8 | 0.8 | | | 0.9 |
| Ballistics 80 gr. vol. | | | | | | |
| Lo velocity, fps | | 1826 | 1795 | | | 1789 |
| Hi velocity, fps | | 1865 | 1843 | | | 1899 |
| ES velocity, fps | | 39 | 48 | | | 110 |
| Av velocity, fps | | 1843 | 1830 | | | 1849 |
| SD velocity, fps | | 15 | 19 | | | 39 |
| TTP, ms. | | 0.6 | 0.7 | | | 0.6 |
| Pressure, psi max. | | 10000 | 9200 | | | 10600 |
| Fouler pressure, psi | | 9500 | 6900 | | | 6700 |
| RAW MATERIALS, wt. % | Chemical Formula | Ref #747 | Ref #737A | Ref #688 | Ref #687 | Ref #697 |
| Carbon Black | C | | | | | |
| Charcoal | C | 6.7 | 6.98 | 7 | 7 | 11.6 |
| Dextrin | $C_6H_{10}O_5$ | 3.3 | 4.98 | 3.5 | 3.5 | 3.5 |
| Dicyanodiamide | $C_2H_4N_4$ | 2.5 | 2.49 | | | |
| Graphite | C | | 0.35 | | | |
| Lactose | $C_{12}H_{22}O_{11}$ | | | 4 | 4 | 4 |
| Sodium m-Nitrobenzoate | $C_7H4NO_4Na$ | 8.5 | 4.98 | 2 | 5.0 | 5 |
| Potassium Nitrate | $KNO_3$ | 37.4 | 39.26 | 39.4 | 39.4 | 39.4 |
| Potassium Perchlorate | $KClO_4$ | 29.2 | 30.60 | 30.7 | 30.7 | 26.1 |
| Sodium Benzoate | $C_7H_5NaO_2$ | 7.7 | 5.48 | 8.5 | 5.5 | 5.5 |
| Potassium Benzoate | $C_7H_5KO_2$ | | | | | |
| Sodium Gluconate | $C_6H_{11}NaO_7$ | 4.3 | 4.48 | 4.5 | 4.5 | 4.5 |
| Potassium Gluconate | $C6H11KO_7$ | | | | | |
| Sulfur | S | | | | | |
| Tricalcium Phosphate | $Ca_3(PO_4)_2$ | 0.4 | 0.40 | 0.4 | 0.4 | 0.4 |
| TOTAL | | 100 | 100.0 | 100.0 | 100.0 | 100.00 |
| COMBUSTION PRODUCTS, wt. % | | | | | | |
| Ammonium Carbonate | $(NH_4)_2CO_3$ | | | | | |
| Carbon Dioxide | $CO_2$ | 5.2 | | 12.9 | 17.9 | |
| Carbon Monoxide | CO | 28.4 | | 20.9 | 16.8 | 35.6 |
| Hydrogen Sulfide | $H_2S$ | | | | | |
| Methane | $CH_4$ | | | | | |
| Nitrogen | $N_2$ | 7.5 | | 5.6 | 5.8 | 5.8 |
| Potassium Carbonate | $K_2CO_3$ | 33.7 | | 33 | 32.8 | 33 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 6.9 | | 9.9 | 10.1 | 7.5 |
| Sodium Carbonate | $Na_2CO_3$ | | | | | |
| Sodium Chloride | NaCl | 6.9 | | 5.3 | 5.1 | 5.1 |
| Tricalcium Phosphate | $Ca_3(PO_4)_2$ | 0.4 | | 0.4 | 0.4 | 0.4 |
| Water | $H_2O$ | 8.9 | | 9.8 | 8.9 | 9 |
| Ash or Unburned Carbon | C | 2.1 | | 2.2 | 2.2 | 3.6 |
| TOTAL | | 100 | | 100.0 | 100.0 | 100.0 |
| PERFORMANCE FACTORS | | | | | | |
| Autoignition Temp, ° F. | | 800 | | 710 | 700 | 680 |
| Open tube burn | | | | fast | fast | fast |
| Burn rate, secs/in. | | 6.5 | | 6.5 | 5.7 | 5.3 |
| Bulk Density | | 0.75 | | 0.81 | 0.85 | 0.8 |
| Moisture, wt. % | | 0.9 | | 0.8 | 0.9 | 0.9 |
| Ballistics 80 gr. vol. | | | | | | |
| Lo velocity, fps | | 1846 | | 1849 | 1829 | 1661 |
| Hi velocity, fps | | 1873 | | 1890 | 1898 | 1692 |
| ES velocity, fps | | 27 | | 41 | 69 | 31 |
| Av velocity, fps | | 1858 | | 1874 | 1871 | 1675 |
| SD velocity, fps | | 10 | | 15 | 29 | 11 |
| TTP, ms. | | 0.6 | | 0.7 | 0.7 | 0.8 |
| Pressure, psi max. | | 11100 | | 10200 | 10200 | 7300 |
| Fouler pressure, psi | | 9200 | | 7200 | 6400 | 5400 |

TABLE 3-continued

Gluconate with Sodium m-Nitrobenzoate Formulations

| RAW MATERIALS, wt. % | Chemical Formula | Ref #698 | Ref #699 | Ref #720 | Ref #732 | Ref #735 |
|---|---|---|---|---|---|---|
| Carbon Black | C | | | | | |
| Charcoal | C | 7 | 7 | 7 | 7 | 9.5 |
| Dextrin | $C_6H_{10}O_5$ | 3.5 | 3.5 | 3.5 | 3.5 | 5 |
| Dicyanodiamide | $C_2H_4N_4$ | | | | | |
| Graphite | C | | | | | |
| Lactose | $C_{12}H_{22}O_{11}$ | 4 | | 4 | | |
| Sodium m-Nitrobenzoate | $C_7H_4NO_4Na$ | 5 | 5 | 5 | 5 | 5 |
| Potassium Nitrate | $KNO_3$ | 42.4 | 43.4 | 37.4 | 39.4 | 39.4 |
| Potassium Perchlorate | $KClO_4$ | 27.7 | 30.7 | 32.7 | 30.7 | 30.7 |
| Sodium Benzoate | $C_7H_5NaO_2$ | 5.5 | 5.5 | 5.5 | 9.5 | 5.5 |
| Potassium Benzoate | $C_7H_5KO_2$ | | | | | |
| Sodium Gluconate | $C_6H_{11}NaO_7$ | 4.5 | 4.5 | 4.5 | 4.5 | 4.5 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100.0 | 100 | 100.0 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 15.9 | 27.2 | 17.9 | 13.5 | 14.8 |
| Carbon Monoxide | CO | 17.8 | 6.4 | 17.2 | 20.8 | 20.4 |
| Hydrogen Sulfide | $H_2S$ | | | | | |
| Methane | $CH_4$ | | | | | |
| Nitrogen | $N_2$ | 6.2 | 6.4 | 5.6 | 5.8 | 5.8 |
| Potassium Carbonate | $K_2CO_3$ | 35 | 35.5 | 31.4 | 34.6 | 32.9 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 8.4 | 10.1 | 11.2 | 8.2 | 10.1 |
| Sodium Carbonate | $Na_2CO_3$ | | | | | |
| Sodium Chloride | NaCl | 5.1 | 5.1 | 5.1 | 6.6 | 5.1 |
| Tricalcium Phosphate | $Ca_3(PO_4)_2$ | 0.4 | 0.4 | 0.4 | 0.4 | 0.4 |
| Water | $H_2O$ | 9 | 6.7 | 9 | 7.9 | 7.5 |
| Ash or Unburned Carbon | C | 2.2 | 2.2 | 2.2 | 2.2 | 3 |
| TOTAL | | 100.0 | 100 | 100.0 | 100 | 100 |
| PERFORMANCE FACTORS | | | | | | |
| Autoignition Temp, ° F. | | 700 | 760 | 730 | 730 | 720 |
| Open tube burn | | | | | | |
| Burn rate, secs/in. | | 6.5 | 6.3 | 6.2 or 7.1? | 4.9 | 5.2 |
| Bulk Density | | 0.81 | 0.83 | 0.82 | 0.79 | 0.77 |
| Moisture, wt. % | | 0.9 | 0.9 | 0.7 | 0.8 | 0.8 |
| Ballistics 80 gr. vol. | | | | | | |
| Lo velocity, fps | | 1745 | 1953 | 1956 | 1931 | 1937 |
| Hi velocity, fps | | 1816 | 1991 | 2008 | 2017 | 2006 |
| ES velocity, fps | | 71 | 38 | 52 | 86 | 69 |
| Av velocity, fps | | 1786 | 1976 | 1998 | 1979 | 1969 |
| SD velocity, fps | | 25 | 15 | 22 | 41 | 27 |
| TTP, ms. | | 0.8 | 0.7 | 0.7 | 0.6 | 0.6 |
| Pressure, psi max. | | 8200 | 11600 | 11700 | 15800 | 13000 |
| Fouler pressure, psi | | 4900 | 7500 | 9200 | 10200 | 8500 |

| RAW MATERIALS, wt. % | Chemical Formula | Ref #737 | Ref #743 | Ref #746 | Ref #726 | Ref #731 |
|---|---|---|---|---|---|---|
| Carbon Black | C | | | | | |
| Charcoal | C | 7 | 7 | 7 | 7 | 7 |
| Dextrin | $C_6H_{10}O_5$ | 5 | 4.2 | 5 | 3 | 5 |
| Dicyanodiamide | $C_2H_4N_4$ | 2.5 | 1.3 | 2.5 | | |
| Graphite | C | | | | | |
| Lactose | $C_{12}H_{22}O_{11}$ | | | | 4 | |
| Sodium m-Nitrobenzoate | $C_7H_4NO_4Na$ | 5 | 5 | 5 | 5.5 | 7.5 |
| Potassium Nitrate | $KNO_3$ | 39.4 | 41.4 | 37.2 | 39.4 | 39.4 |
| Potassium Perchlorate | $KClO_4$ | 30.7 | 30.7 | 28.9 | 30.7 | 30.7 |
| Sodium Benzoate | $C_7H_5NaO_2$ | 5.5 | 5.5 | 9.5 | 5.5 | 5.5 |
| Potassium Benzoate | $C_7H_5KO_2$ | | | | | |
| Sodium Gluconate | $C_6H_{11}NaO_7$ | 4.5 | 4.5 | 4.5 | 4.5 | 4.5 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100 | 100 | 100.0 | 100 |

TABLE 3-continued

| Gluconate with Sodium m-Nitrobenzoate Formulations | | | | | | |
|---|---|---|---|---|---|---|
| COMBUSTION PRODUCTS, wt. % | | | | | | |
| Ammonium Carbonate | $(NH_4)_2CO_3$ | | | | | |
| Carbon Dioxide | $CO_2$ | 15.9 | 21.2 | 1.2 | | 17.5 |
| Carbon Monoxide | CO | 17.3 | 12 | 32.2 | | 17.1 |
| Hydrogen Sulfide | $H_2S$ | | | | | |
| Methane | $CH_4$ | | | | | |
| Nitrogen | $N_2$ | 7.5 | 7 | 7.2 | | 6 |
| Potassium Carbonate | $K_2CO_3$ | 32.9 | 34.3 | 33.1 | | 33.8 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 10.1 | 10 | 7.2 | | 9.1 |
| Sodium Carbonate | $Na_2CO_3$ | | | | | |
| Sodium Chloride | NaCl | 5.1 | 5.2 | 6.6 | | 5.9 |
| Tricalcium Phosphate | $Ca_3(PO_4)_2$ | 0.4 | 0.4 | 0.4 | | 0.4 |
| Water | $H_2O$ | 8.6 | 7.7 | 9.9 | | 8 |
| Ash or Unburned Carbon | C | 2.2 | 2.2 | 2.2 | | 2.2 |
| TOTAL | | 100 | 100 | 100 | 0.0 | 100 |
| PERFORMANCE FACTORS | | | | | | |
| Autoignition Temp, ° F. | | 790 | 760 | 820 | 710 | 730 |
| Open tube burn | | | | | | |
| Burn rate, secs/in. | | 7.5 | 7.4 | 7.2 | 6.7 | 5.1 |
| Bulk Density | | 0.82 | 0.83 | 0.82 | 0.8 | 0.83 |
| Moisture, wt. % | | 0.8 | 0.9 | 0.7 | 0.8 | 0.8 |
| Ballistics 80 gr. vol. | | | | | | |
| Lo velocity, fps | | 1880 | 1851 | 1859 | 1841 | 1971 |
| Hi velocity, fps | | 1933 | 1888 | 1885 | 1910 | 2018 |
| ES velocity, fps | | 53 | 37 | 26 | 69 | 47 |
| Av velocity, fps | | 1908 | 1863 | 1878 | 1874 | 2002 |
| SD velocity, fps | | 20 | 14 | 10 | 25 | 19 |
| TTP, ms. | | 0.7 | 0.7 | 0.7 | 0.7 | 0.65 |
| Pressure, psi max. | | 10200 | 8800 | 9900 | 10300 | 12700 |
| Fouler pressure, psi | | 8000 | 6600 | 8500 | 7700 | 8400 |
| RAW MATERIALS, wt. % | Chemical Formula | Ref #691 | Ref #725 | Ref #733 | Ref #748 | Ref #706 |
| Carbon Black | C | | | | | |
| Charcoal | C | 4 | 7 | 7 | 6 | 7 |
| Dextrin | $C_6H_{10}O_5$ | 3.5 | 3.5 | 3.5 | 4 | 3.5 |
| Dicyanodiamide | $C_2H_4N_4$ | | | | 2 | |
| Graphite | C | | | | | |
| Lactose | $C_{12}H_{22}O_{11}$ | 4 | | | | 4 |
| Sodium m-Nitrobenzoate | $C_7H_4NO_4Na$ | 8 | 9 | 9 | 10 | 10.5 |
| Potassium Nitrate | $KNO_3$ | 39.4 | 39.4 | 40.4 | 35.9 | 39.4 |
| Potassium Perchlorate | $KClO_4$ | 30.7 | 30.7 | 29.7 | 28.6 | 30.7 |
| Sodium Benzoate | $C_7H_5NaO_2$ | 5.5 | 5.5 | 5.5 | 8.6 | |
| Potassium Benzoate | $C_7H_5KO_2$ | | | | | |
| Sodium Gluconate | $C_6H_{11}NaO_7$ | 4.5 | 4.5 | 4.5 | 4.5 | 4.5 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100.0 | 100 | 100 | 100 | 100.0 |
| COMBUSTION PRODUCTS, wt. % | | | | | | |
| Ammonium Carbonate | $(NH_4)_2CO_3$ | | | | | |
| Carbon Dioxide | $CO_2$ | 20.6 | 18.4 | 17.9 | 0.5 | 24.2 |
| Carbon Monoxide | CO | 13.4 | 16.5 | 16.8 | 33.5 | 11.1 |
| Hydrogen Sulfide | $H_2S$ | | | | | |
| Methane | $CH_4$ | | | | | |
| Nitrogen | $N_2$ | 6.1 | 6.1 | 6.3 | 7 | 6.2 |
| Potassium Carbonate | $K_2CO_3$ | 33.8 | 34.1 | 34.8 | 33.7 | 32.3 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.1 | 8.8 | 8.1 | 5.5 | 10.7 |
| Sodium Carbonate | $Na_2CO_3$ | | | | | |
| Sodium Chloride | NaCl | 5.9 | 6.1 | 6.1 | 7.8 | 4.6 |
| Tricalcium Phosphate | $Ca_3(PO_4)_2$ | 0.4 | 0.4 | 0.4 | 0.4 | 0.4 |
| Water | $H_2O$ | 9.5 | 7.4 | 7.4 | 9.7 | 8.3 |
| Ash or Unburned Carbon | C | 1.2 | 2.2 | 2.2 | 1.9 | 2.2 |
| TOTAL | | 100.0 | 100 | 100 | 100 | 100.0 |

TABLE 3-continued

Gluconate with Sodium m-Nitrobenzoate Formulations

| PERFORMANCE FACTORS | | | | | | |
|---|---|---|---|---|---|---|
| Autoignition Temp, ° F. | | 720 | 720 | 720 | 780 | 750 |
| Open tube burn | | fast | | | | fast |
| Burn rate, secs/in. | | 5.3 | 5.5 | 5.3 | 6.3 | 5.2 |
| Bulk Density | | 0.83 | 0.83 | 0.8 | 0.76 | 0.79 |
| Moisture, wt. % | | 0.8 | 0.9 | 0.8 | 0.8 | 0.9 |
| Ballistics 80 gr. vol. | | | | | | |
| Lo velocity, fps | | 1997 | 1942 | 1891 | 1883 | 1759 |
| Hi velocity, fps | | 2050 | 1972 | 1963 | 1910 | 1791 |
| ES velocity, fps | | 53 | 50 | 72 | 27 | 32 |
| Av velocity, fps | | 2020 | 1963 | 1937 | 1896 | 1773 |
| SD velocity, fps | | 19 | 23 | 28 | 11 | 12 |
| TTP, ms. | | 0.6 | 0.6 | 0.6 | 0.6 | 0.7 |
| Pressure, psi max. | | 13000 | 12200 | 12500 | 12300 | 7800 |
| Fouler pressure, psi | | 10900 | 8800 | 9700 | 12300 | 5400 |
| RAW MATERIALS, wt. % | Chemical Formula | Ref #744 | Ref #722 | Ref #745 | Ref #738 | Ref #753 |
| Carbon Black | C | | | | | |
| Charcoal | C | 7.3 | 7.5 | 7.6 | 7.6 | 9 |
| Dextrin | $C_6H_{10}O5$ | 5 | 3.5 | 5 | 5 | 4 |
| Dicyanodiamide | $C_2H_4N_4$ | 1.5 | | 1.5 | | 1 |
| Graphite | C | | | | | |
| Lactose | $C_{12}H_{22}O_{11}$ | | 4.3 | | | |
| Sodium m-Nitrobenzoate | $C_7H_4NO_4Na$ | 5.2 | 5.4 | 5.4 | 8.1 | 5 |
| Potassium Nitrate | $KNO_3$ | 39.4 | 38.3 | 38.4 | 38.3 | 39.4 |
| Potassium Perchlorate | $KClO_4$ | 30.7 | 29.8 | 30.7 | 29.8 | 30.7 |
| Sodium Benzoate | $C_7H_5NaO_2$ | 5.8 | 5.9 | 6.1 | 5.9 | 5.5 |
| Potassium Benzoate | $C_7H_5KO_2$ | | | | | |
| Sodium Gluconate | $C_6H_{11}NaO_7$ | 4.7 | 4.9 | 4.9 | 4.9 | 5 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.4 | 0.4 |
| TOTAL | | 100 | 100.0 | 100 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | 16.2 | 11.5 | 12.9 | 11.8 | 14.8 |
| Carbon Monoxide | CO | 17.7 | 23.5 | 21.4 | 23.3 | 19.9 |
| Hydrogen Sulfide | $H_2S$ | | | | | |
| Methane | $CH_4$ | | | | | |
| Nitrogen | $N_2$ | 6.8 | 5.7 | 6.7 | 5.9 | 6.5 |
| Potassium Carbonate | $K_2CO_3$ | 33 | 32.4 | 32.3 | 33.4 | 32.7 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.9 | 9.2 | 9.9 | 8.3 | 10.3 |
| Sodium Carbonate | $Na_2CO_3$ | | | | | |
| Sodium Chloride | NaCl | 5.3 | 5.4 | 5.3 | 6.1 | 5 |
| Tricalcium Phosphate | $Ca_3(PO_4)_2$ | 0.4 | 0.4 | 0.4 | 0.4 | 0.4 |
| Water | $H_2O$ | 8.4 | 9.6 | 8.7 | 8.4 | 7.6 |
| Ash or Unburned Carbon | C | 2.3 | 2.3 | 2.4 | 2.4 | 2.8 |
| TOTAL | | 100 | 100.0 | 100 | 100 | 100 |
| PERFORMANCE FACTORS | | | | | | |
| Autoignition Temp, ° F. | | 760 | 710 | 760 | 720 | 760 |
| Open tube burn | | | | | | |
| Burn rate, secs/in. | | 6.8 | 6.1 | 6.4 | 5.6 | 6.4 |
| Bulk Density | | 0.79 | 0.85 | 0.82 | 0.8 | 0.78 |
| Moisture, wt. % | | 0.8 | 0.8 | 0.8 | 0.8 | 0.8 |
| Ballistics 80 gr. vol. | | | | | | |
| Lo velocity, fps | | 1856 | 1806 | 1845 | 1865 | 1858 |
| Hi velocity, fps | | 1890 | 1845 | 1885 | 1885 | 1912 |
| ES velocity, fps | | 34 | 39 | 40 | 20 | 54 |
| Av velocity, fps | | 1875 | 1827 | 1861 | 1871 | 1882 |
| SD velocity, fps | | 13 | 16 | 17 | 8 | 21 |
| TTP, ms. | | 0.7 | 0.7 | 0.8 | 0.7 | 0.7 |
| Pressure, psi max. | | 9300 | 9100 | 9200 | 10200 | 10400 |
| Fouler pressure, psi | | 5700 | 6900 | 6800 | 7400 | 6800 |
| RAW MATERIALS, wt. % | Chemical Formula | Ref #736 | Ref #750 | Ref #754 | Ref #752A | Ref #752 |
| Carbon Black | C | | | | | |
| Charcoal | C | 8 | 6.7 | 7.7 | 7.97 | 8 |

TABLE 3-continued

| Gluconate with Sodium m-Nitrobenzoate Formulations | | | | | | |
|---|---|---|---|---|---|---|
| Dextrin | $C_6H_{10}O_5$ | 5 | 3.3 | 3.3 | 3.99 | 4 |
| Dicyanodiamide | $C_2H_4N_4$ | | 1 | 1 | 1.00 | 1 |
| Graphite | C | | | | 0.35 | |
| Lactose | $C_{12}H_{22}O_{11}$ | | | | | |
| Sodium m-Nitrobenzoate | $C_7H_4NO_4Na$ | 5 | 8.5 | 8.5 | 4.98 | 5 |
| Potassium Nitrate | $KNO_3$ | 39.4 | 37.4 | 37.4 | 39.26 | 39.4 |
| Potassium Perchlorate | $KClO_4$ | 30.7 | 29.2 | 29.2 | 30.59 | 30.7 |
| Sodium Benzoate | $C_7H_5NaO_2$ | 6.3 | 7.7 | 6.7 | 5.48 | 5.5 |
| Potassium Benzoate | $C_7H_5KO_2$ | | | | | |
| Sodium Gluconate | $C_6H_{11}NaO_7$ | 5.2 | 5.8 | 5.8 | 5.98 | 6 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.4 | 0.40 | 0.4 |
| TOTAL | | 100 | 100 | 100 | 100.00 | 100 |
| COMBUSTION PRODUCTS, wt. % | | | | | | |
| Ammonium Carbonate | $(NH_4)_2CO_3$ | | | | | |
| Carbon Dioxide | $CO_2$ | 15.7 | 6.9 | 6.6 | 16.8 | 16.8 |
| Carbon Monoxide | CO | 19.1 | 27.2 | 27.9 | 17.5 | 17.5 |
| Hydrogen Sulfide | $H_2S$ | | | | | |
| Methane | $CH_4$ | | | | | |
| Nitrogen | $N_2$ | 5.8 | 6.5 | 6.5 | 6.5 | 6.5 |
| Potassium Carbonate | $K_2CO_3$ | 33.4 | 34.3 | 33.7 | 33 | 33 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.4 | 6.3 | 6.9 | 9.9 | 9.9 |
| Sodium Carbonate | $Na_2CO_3$ | | | | | |
| Sodium Chloride | NaCl | 5.6 | 7.4 | 6.9 | 5.3 | 5.3 |
| Tricalcium Phosphate | $Ca_3(PO_4)_2$ | 0.4 | 0.4 | 0.4 | 0.4 | 0.4 |
| Water | $H_2O$ | 8.1 | 8.9 | 8.7 | 8.1 | 8.1 |
| Ash or Unburned Carbon | C | 2.5 | 2.1 | 2.4 | 2.5 | 2.5 |
| TOTAL | | 100 | 100 | 100 | 100 | 100 |
| PERFORMANCE FACTORS | | | | | | |
| Autoignition Temp, ° F. | | 720 | 790 | 780 | | 760 |
| Open tube burn | | | | | | |
| Burn rate, secs/in. | | 5.9 | 6 | 5.4 | | 6.4 |
| Bulk Density | | 0.8 | 0.8 | 0.76 | | 0.81 |
| Moisture, wt. % | | 0.9 | 0.9 | 0.9 | | 0.9 |
| Ballistics 80 gr. vol. | | | | | | |
| Lo velocity, fps | | 1917 | 1866 | 1735 | | 1926 |
| Hi velocity, fps | | 1944 | 1952 | 1887 | | 1941 |
| ES velocity, fps | | 27 | 86 | 152 | | 15 |
| Av velocity, fps | | 1926 | 1917 | 1833 | | 1935 |
| SD velocity, fps | | 10 | 35 | 59 | | 6 |
| TTP, ms. | | 0.7 | 0.6 | 0.6 | | 0.7 |
| Pressure, psi max. | | 10800 | 12900 | 15200 | | 11400 |
| Fouler pressure, psi | | 7200 | 9800 | 8800 | | 8700 |
| RAW MATERIALS, wt. % | Chemical Formula | Ref #707 | Ref #751 | Ref #749A | Ref #734 | Ref #749 |
| Carbon Black | C | | | | | |
| Charcoal | C | 7 | 6.7 | 6.98 | 7 | 7 |
| Dextrin | $C_6H_{10}O_5$ | 3.5 | 3.3 | 3.99 | 5 | 4 |
| Dicyanodiamide | $C_2H_4N_4$ | | 1 | 1.00 | | 1 |
| Graphite | C | | | 0.35 | | |
| Lactose | $C_{12}H_{22}O_{11}$ | 4 | | | | |
| Sodium m-Nitrobenzoate | $C_7H_4NO_4Na$ | 7.1 | 8.5 | 4.98 | 5 | 5 |
| Potassium Nitrate | $KNO_3$ | 35.9 | 37.4 | 39.25 | 39.4 | 39.4 |
| Potassium Perchlorate | $KClO_4$ | 28 | 29.2 | 30.59 | 30.7 | 30.7 |
| Sodium Benzoate | $C_7H_5NaO_2$ | 7.8 | 6.7 | 5.48 | 5.5 | 5.5 |
| Potassium Benzoate | $C_7H_5KO_2$ | | | | | |
| Sodium Gluconate | $C_6H_{11}NaO_7$ | 6.3 | 6.8 | 6.98 | 7 | 7 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.4 | 0.40 | 0.4 | 0.4 |
| TOTAL | | 100.0 | 100 | 100.00 | 100 | 100 |
| COMBUSTION PRODUCTS, wt. % | | | | | | |
| Ammonium Carbonate | $(NH_4)_2CO_3$ | | | | | |
| Carbon Dioxide | $CO_2$ | | 8.5 | 17.9 | 18.4 | 17.9 |
| Carbon Monoxide | CO | 34.9 | 25.6 | 15.9 | 16 | 15.9 |
| Hydrogen Sulfide | $H_2S$ | | | | | |

TABLE 3-continued

| Gluconate with Sodium m-Nitrobenzoate Formulations | | | | | | |
|---|---|---|---|---|---|---|
| Methane | $CH_4$ | | | | | |
| Nitrogen | $N_2$ | 5.5 | 6.5 | 6.5 | 5.8 | 6.5 |
| Potassium Carbonate | $K_2CO_3$ | 32.8 | 34.1 | 33.4 | 33.4 | 33.4 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 6.3 | 6.5 | 9.5 | 9.5 | 9.5 |
| Sodium Carbonate | $Na_2CO_3$ | | | | | |
| Sodium Chloride | NaCl | 7 | 7.2 | 5.6 | 5.6 | 5.6 |
| Tricalcium Phosphate | $Ca_3(PO_4)_2$ | 0.4 | 0.4 | 0.4 | 0.4 | 0.4 |
| Water | $H_2O$ | 10.9 | 9.1 | 8.6 | 8.7 | 8.6 |
| Ash or Unburned Carbon | C | 2.2 | 2.1 | 2.2 | 2.2 | 2.2 |
| TOTAL | | 100.0 | 100 | 100 | 100 | 100 |
| PERFORMANCE FACTORS | | | | | | |
| Autoignition Temp, ° F. | | 700 | 770 | | 720 | 790 |
| Open tube burn | | fast | | | | |
| Burn rate, secs/in. | | 5.8 | 6 | | 6.2 | 6.7 |
| Bulk Density | | 0.8 | 0.8 | | 0.84 | 0.79 |
| Moisture, wt. % | | 0.8 | 0.8 | | 0.9 | 0.9 |
| Ballistics 80 gr. vol. | | | | | | |
| Lo velocity, fps | | 1808 | 1877 | | 1848 | 1862 |
| Hi velocity, fps | | 1844 | 1929 | | 1928 | 1916 |
| ES velocity, fps | | 36 | 52 | | 80 | 54 |
| Av velocity, fps | | 1826 | 1910 | | 1901 | 1886 |
| SD velocity, fps | | 12 | 20 | | 33 | 21 |
| TTP, ms. | | 0.7 | 0.6 | | 0.7 | 0.7 |
| Pressure, psi max. | | 9600 | 12300 | | 10400 | 10400 |
| Fouler pressure, psi | | 7500 | 9300 | | 6300 | 6200 (8100) |
| RAW MATERIALS, wt. % | Chemical Formula | Ref #695 | Ref #693A | Ref #693 | Ref #728 | Ref #696 |
| Carbon Black | C | | | | | |
| Charcoal | C | 4 | 3.99 | 4 | 7 | 7 |
| Dextrin | $C_6H_{10}O_5$ | 3.5 | 3.49 | 3.5 | 3 | 3.5 |
| Dicyanodiamide | $C_2H_4N_4$ | | | | | |
| Graphite | C | | 0.35 | | | |
| Lactose | $C_{12}H_{22}O_{11}$ | 4 | | | | 4 |
| Sodium m-Nitrobenzoate | $C_7H_4NO_4Na$ | 5 | 7.97 | 8 | 8 | 5 |
| Potassium Nitrate | $KNO_3$ | 39.4 | 39.26 | 39.4 | 39.4 | 39.4 |
| Potassium Perchlorate | $KClO_4$ | 30.7 | 30.59 | 30.7 | 30.7 | 23.5 |
| Sodium Benzoate | $C_7H_5NaO_2$ | 5.5 | 5.48 | 5.5 | | 5.5 |
| Potassium Benzoate | $C_7H_5KO_2$ | | | | | |
| Sodium Gluconate | $C_6H_{11}NaO_7$ | 7.5 | 8.47 | 8.5 | 11.5 | 11.7 |
| Potassium Gluconate | $C_6H_{11}KO_7$ | | | | | |
| Sulfur | S | | | | | |
| Tricalcium Phosphate | $Ca_3(PO_4)_2$ | 0.4 | 0.40 | 0.4 | 0.4 | 0.4 |
| TOTAL | | 100.00 | 100.0 | 100 | 100.0 | 100.0 |
| COMBUSTION PRODUCTS, wt. % | | | | | | |
| Ammonium Carbonate | $(NH_4)_2CO_3$ | | | | | |
| Carbon Dioxide | $CO_2$ | 21.7 | | 22.5 | 26.8 | |
| Carbon Monoxide | CO | 11.8 | | 11 | 7.6 | 33.4 |
| Hydrogen Sulfide | $H_2S$ | | | | | |
| Methane | $CH_4$ | | | | | |
| Nitrogen | $N_2$ | 5.8 | | 6.1 | 6.1 | 5.8 |
| Potassium Carbonate | $K_2CO_3$ | 33.7 | | 35 | 33.4 | 35.2 |
| Potassium Thiocyanate | KCNS | | | | | |
| Potassium Sulfate | $K_2SO_4$ | | | | | |
| Potassium Thiosulfate | $K_2S_2O_3$ | | | | | |
| Potassium Sulfide | $K_2S$ | | | | | |
| Potassium Chloride | KCl | 9.1 | | 7.8 | 9.5 | 3.8 |
| Sodium Carbonate | $Na_2CO_3$ | | | | | |
| Sodium Chloride | NaCl | 5.9 | | 6.9 | 5.6 | 6.9 |
| Tricalcium Phosphate | $Ca_3(PO_4)_2$ | 0.4 | | 0.4 | 0.4 | 0.4 |
| Water | $H_2O$ | 10.4 | | 9.1 | 8.4 | 12.3 |
| Ash or Unburned Carbon | C | 1.2 | | 1.2 | 2.2 | 2.2 |
| TOTAL | | 100.0 | | 100 | 100.0 | 100.0 |
| PERFORMANCE FACTORS | | | | | | |
| Autoignition Temp, ° F. | | 720 | | 710 | 760 | 660 |
| Open tube burn | | just burn | | fast | | just burn |
| Burn rate, secs/in. | | 6.7 | | 5.7 | 6 | 6.6 |
| Bulk Density | | 0.84 | | 0.8 | 0.84 | 0.79 |

TABLE 3-continued

| Gluconate with Sodium m-Nitrobenzoate Formulations | | | | | |
|---|---|---|---|---|---|
| Moisture, wt. % | | 0.9 | 0.8 | 0.9 | 0.8 |
| Ballistics 80 gr. vol. | | | | | |
| Lo velocity, fps | | 1848 | 1899 | 1610 | 1483 |
| Hi velocity, fps | | 1888 | 1990 | 1676 | 1517 |
| ES velocity, fps | | 40 | 91 | 66 | 34 |
| Av velocity, fps | | 1874 | 1945 | 1650 | 1502 |
| SD velocity, fps | | 16 | 39 | 27 | 12 |
| TTP, ms. | | 0.7 | 0.65 | 0.9 | 0.9 |
| Pressure, psi max. | | 9500 | 12600 | 5900 | 5000 |
| Fouler pressure, psi | | 6100 | 9400 | 3200 | 3100 |
| RAW MATERIALS, wt. % | Chemical Formula | Ref #727 | Ref #811 | Ref #813 | Ref #814 |
| Carbon Black | C | | | | |
| Charcoal | C | 4 | 5.6 | 5.6 | 6.6 |
| Dextrin | $C_6H_{10}O_5$ | 3 | 5.8 | 5.8 | 4.8 |
| Dicyanodiamide | $C_2H_4N_4$ | | 4.9 | 4.9 | 5.9 |
| Graphite | C | | | | |
| Lactose | $C_{12}H_{22}O_{11}$ | | | | |
| Sodium m-Nitrobenzoate | $C_7H_4NO_4Na$ | 8 | 7.3 | 7.3 | 6.3 |
| Potassium Nitrate | $KNO_3$ | 39.4 | 38.7 | 38.7 | 38.7 |
| Potassium Perchlorate | $KClO_4$ | 30.7 | 29 | 29 | 29 |
| Sodium Benzoate | $C_7H_5NaO_2$ | | | 6.1 | |
| Potassium Benzoate | $C_7H_5KO_2$ | | 6.1 | | 5.1 |
| Sodium Gluconate | $C_6H_{11}NaO_7$ | 14.5 | | | |
| Potassium Gluconate | $C_6H_{11}KO_7$ | | 2.2 | 2.2 | 3.2 |
| Sulfur | S | | | | |
| Tricalcium Phosphate | $Ca_3(PO_4)_2$ | 0.4 | 0.4 | 0.4 | 0.4 |
| TOTAL | | 100 | 100 | 100 | 100 |
| COMBUSTION PRODUCTS, wt. % | | | | | |
| Ammonium Carbonate | $(NH_4)_2CO_3$ | | | | |
| Carbon Dioxide | $CO_2$ | 31.3 | 9.6 | 8.2 | 8 |
| Carbon Monoxide | CO | 2 | 22.3 | 23.9 | 23.6 |
| Hydrogen Sulfide | $H_2S$ | | | | |
| Methane | $CH_4$ | | | | |
| Nitrogen | $N_2$ | 6.1 | 9.2 | 9.2 | 9.8 |
| Potassium Carbonate | $K_2CO_3$ | 34.5 | 32.5 | 32.7 | 32.4 |
| Potassium Thiocyanate | KCNS | | | | |
| Potassium Sulfate | $K_2SO_4$ | | | | |
| Potassium Thiosulfate | $K_2S_2O_3$ | | | | |
| Potassium Sulfide | $K_2S$ | | | | |
| Potassium Chloride | KCl | 8.4 | 12.6 | 9.5 | 10.3 |
| Sodium Carbonate | $Na_2CO_3$ | | | | |
| Sodium Chloride | NaCl | 6.4 | 2.3 | 4.8 | 4.1 |
| Tricalcium Phosphate | $Ca_3(PO_4)_2$ | 0.4 | 0.4 | 0.4 | 0.4 |
| Water | $H_2O$ | 9.7 | 9.4 | 9.6 | 9.4 |
| Ash or Unburned Carbon | C | 1.2 | 1.7 | 1.7 | 2 |
| TOTAL | | 100 | 100 | 100 | 100 |
| PERFORMANCE FACTORS | | | | | |
| Autoignition Temp, ° F. | | 760 | 790 | 780 | 820 |
| Open tube burn | | | | | |
| Burn rate, secs/in. | | 6.4 | 6.8 | 7.3 | 6.9 |
| Bulk Density | | 0.85 | 0.85 | 0.79 | 0.83 |
| Moisture, wt. % | | 0.7 | 0.9 | 0.8 | 0.8 |
| Ballistics 80 gr. vol. | | | | | |
| Lo velocity, fps | | 1426 | 1947 | 1762 | 1904 |
| Hi velocity, fps | | 1466 | 2030 | 1815 | 1945 |
| ES velocity, fps | | 40 | 83 | 83 | 41 |
| Av velocity, fps | | 1449 | 1995 | 1786 | 1924 |
| SD velocity, fps | | 14 | 33 | 20 | 16 |
| TTP, ms. | | 0.9 | 0.6 | 0.7 | 0.6 |
| Pressure, psi max. | | 3500 | 12600 | 9300 | 10400 |
| Fouler pressure, psi | | 1900 | 8500 | 6700 | 7600 |

In addition to the elimination of sulfur as previously disclosed in the teachings of our parent application, we have now discovered that it is possible to eliminate elemental carbon also in order to formulate a fully functional white propellant. Thus, two of the three traditional constituents of blackpowder can be omitted utilizing our new formulations. Sulfur and carbon have accounted for many of the problems associated with blackpowder since the products of combustion form corrosive sulfur compounds and black carbonaceous residues.

White propellants free of both sulfur and carbon can be formulated with a fuel agent selected from the group consisting of sodium benzoate, lactose, sodium salicylate, sodium m-nitrobenzoate, and mixtures thereof. Preferably, the agent is sodium benzoate. It may be present in the working range of 17 to 25 percent by weight, with the most preferred range of 19 to 23 percent by weight. However, all or part of the sodium benzoate may be replaced by lactose, sodium salicylate, sodium m-nitrobenzoate, and mixtures, in the foregoing percentage by weight ranges, which are suitable substitutes for sodium benzoate by itself.

The remaining constituents of the white propellant formulations are dextrin, potassium nitrate, potassium perchlorate and tricalcium phosphate. Dextrin may be present in the working range of 4 to 8 percent by weight, with the most preferred range of 5.5 to 6.5 percent by weight. Potassium nitrate, the only component of traditional blackpowder included, may be present in the working range of 42 to 52 percent by weight, with the most preferred range of 45 to 49 percent by weight. Potassium perchlorate may be present in the working range of 21 to 31 percent by weight, with the most preferred range of 24 to 28 percent by weight. Lastly, tricalcium phosphate may be present in the working range of 0.1 to 0.7 percent by weight, with the most preferred range of 0.3 to 0.5 percent by weight.

In the event the foregoing propellant compositions prove to be too energetic for a particular application, then dicyanodiamide present in the range of 0 to 5 percent by weight may be employed as a burn rate modifier.

In the following Table 4 representative examples are shown of white propellant formulations which eliminate both sulfur and elemental carbon for the oxidizing and reducing agents as indicated.

TABLE 4

White Powder Formulations

| RAW MATERIALS, wt. % | Chemical Formula | Mole Weight | Black Powder | Ref 862 | Ref 863 | Ref 865 | Ref 866 | Ref 867 |
|---|---|---|---|---|---|---|---|---|
| Charcoal | C | 12.01 | 15 | | | | | |
| Sulfur | S | 32.06 | 10 | | | | | |
| Dextrin | C6H10O5 | 162.14 | | 4 | 6 | 6 | 6 | 6 |
| Sodium Benzoate | NaC7H5O2 | 144.11 | | 22.8 | 22.3 | 15.3 | 23.9 | 23.9 |
| Potassium Nitrate | KNO3 | 101.11 | 75 | 52 | 50.9 | 50.9 | 43.7 | 45.7 |
| Potassium Perchlorate | KClO4 | 138.55 | | 20.8 | 20.4 | 27.4 | 26 | 24 |
| Tricalcium Phosphate | Ca3(PO4)2 | 310.2 | | 0.4 | 0.4 | 0.4 | 0.4 | 0.4 |
| Lactose | C12H22O11 | 360.31 | | | | | | |
| Sodium Salicylate | NaC7H5O3 | 160.11 | | | | | | |
| Sodium m-Nitrobenzoate | C7H4NO4Na | 189.11 | | | | | | |
| Dicyandiamide | C2H4N4 | 84.08 | | | | | | |
| TOTAL | | | | 100 | 100 | 100 | 100 | 100 |
| Oxidizer % | | | 75 | 72.8 | 71.3 | 78.3 | 69.7 | 69.7 |
| COMBUST PRODUCTS, wt. % | | | | | | | | |
| Ammonium Carbonate | (NH4)2CO3 | 96.11 | 0.97 | | | | | |
| Carbon Dioxide | CO2 | 44.01 | 24.93 | 5.2 | 2.5 | 29.3 | 0 | |
| Carbon Monoxide | CO | 28.01 | 3.97 | 22.5 | 25.7 | 0 | 29.8 | 28.9 |
| Hydrogen Sulfide | H2S | 34.08 | 0.69 | | | | | |
| Methane | CH4 | 16.04 | 0.49 | | | | | |
| Nitrogen | N2 | 28.02 | 9.92 | 7.2 | 7.1 | 7.1 | 6.1 | 6.3 |
| Potassium Carbonate | K2CO3 | 138.2 | 26.56 | 45.9 | 44.9 | 42 | 41.2 | 42.8 |
| Potassium Thiocyanate | KCNS | 97.18 | 1.97 | | | | | |
| Potassium Sulfate | K2SO4 | 174.25 | 12.34 | | | | | |
| Potassium Thiosulfate | K2S2O3 | 190.32 | 15.4 | | | | | |
| Potassium Sulfide | K2S, K2S2 | 142.31 | 2.23 | | | | | |
| Potassium Chloride | KCl | 74.56 | | | | 6.9 | 1.7 | 0.4 |
| Sodium Carbonate | Na2CO3 | 105.99 | | 0.5 | 0.5 | | | |
| Sodium Chloride | NaCl | 58.45 | | 8.7 | 8.6 | 6.1 | 9.7 | 9.7 |
| Tricalcium Phosphate | Ca3(PO4)2 | 310.2 | | 0.4 | 0.4 | 0.4 | 0.4 | 0.4 |
| Water | H2O | 18.02 | | 9.6 | 10.3 | 8.2 | 11.1 | 11 |
| Ash or Unburned Carbon | | | 0.53 | | | | | 0.5 |
| TOTAL | | | 100 | 100 | 100 | 100 | 100 | 100 |
| GASES, wt. % | | | 40 | 44.5 | 45.6 | 44.6 | 47 | 46.2 |
| SOLIDS, wt. % | | | 60 | 55.5 | 54.4 | 55.4 | 53 | 53.8 |
| PERFORMANCE FACTORS | | | | | | | | |
| Autoignition Temp, ° F. | | | 580 | | 870 | 880 | 870 | 870 |
| Burn rate, secs/in. | | | 2.3 | 6.2 | 6.8 | 7.5 | 5.7 | 6 |
| Bulk Density | | | 1.00 | 0.71 | 0.71 | 0.78 | 0.75 | 0.75 |
| Moisture, wt. % | | | <0.5 | 0.7 | 0.8 | 0.7 | 0.7 | 0.8 |
| Ballistics for 100 gr. Sabot | | | | | | | | |
| Av velocity, fps | | | | | | | | |
| SD velocity, fps | | | | | | | | |
| Ignition | | | | | | | | |
| Pressure, psi max. | | | | | | | | |
| Pressure, avg | | | | | | | | |

| RAW MATERIALS, wt. % | Chemical Formula | Ref 868 | Ref 870 | Ref 2876 | Ref 2883 | Ref 2886 | Ref 2887 | Ref 2891 |
|---|---|---|---|---|---|---|---|---|
| Charcoal | C | | | | | | | |
| Sulfur | S | | | | | | | |

TABLE 4-continued

| White Powder Formulations | | | | | | | | |
|---|---|---|---|---|---|---|---|---|
| Dextrin | C6H10O5 | 6 | 6 | 3 | 4.5 | 5.8 | 5.8 | 5.8 |
| Sodium Benzoate | NaC7H5O2 | 22.9 | 20.9 | 12.8 | 11.3 | | | |
| Potassium Nitrate | KNO3 | 44.7 | 46.7 | 41.7 | 43.7 | 41.7 | 41.7 | 41.7 |
| Potassium Perchlorate | KClO4 | 26 | 26 | 26 | 24 | 26 | 26 | 26 |
| Tricalcium Phosphate | Ca3(PO4)2 | 0.4 | 0.4 | 0.4 | 0.4 | 0.4 | 0.4 | 0.4 |
| Lactose | C12H22O11 | | | | | | 21.2 | 26.1 |
| Sodium Salicylate | NaC7H5O3 | | | | | | | |
| Sodium m-Nitrobenzoate | C7H4NO4Na | | | 11.2 | 11.2 | 21.2 | | |
| Dicyandiamide | C2H4N4 | | | 4.9 | 4.9 | 4.9 | 4.9 | |
| TOTAL | | 100 | 100 | 100 | 100 | 100 | 100 | 100 |
| Oxidizer % | | 70.7 | 72.7 | 67.7 | 67.7 | 67.7 | 67.7 | 67.7 |
| COMBUST PRODUCTS, wt. % | | | | | | | | |
| Ammonium Carbonate | (NH4)2CO3 | | | | | | | |
| Carbon Dioxide | CO2 | 2.5 | 9.1 | 4.9 | | | | |
| Carbon Monoxide | CO | 27.3 | 20.5 | 24.4 | | | | |
| Hydrogen Sulfide | H2S | | | | | | | |
| Methane | CH4 | | | | | | | |
| Nitrogen | N2 | 6.2 | 6.5 | 9.9 | | | | |
| Potassium Carbonate | K2CO3 | 41.5 | 41.7 | 38.9 | | | | |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | 2.1 | 3.4 | 2.9 | | | | |
| Sodium Carbonate | Na2CO3 | | | | | | | |
| Sodium Chloride | NaCl | 9.4 | 8.4 | 8.6 | | | | |
| Tricalcium Phosphate | Ca3(PO4)2 | 0.4 | 0.4 | 0.4 | | | | |
| Water | H2O | 10.6 | 10 | 10 | | | | |
| Ash or Unburned Carbon | | | | | | | | |
| TOTAL | | 100 | 100 | 100 | | | | |
| GASES, wt. % | | 46.6 | 46.1 | 49.2 | | | | |
| SOLIDS, wt. % | | 53.4 | 53.9 | 50.8 | | | | |
| PERFORMANCE FACTORS | | | | | | | | |
| Autoignition Temp, ° F. | | 870 | 880 | | 840 | 790 | 760 | 700 |
| Burn rate, secs/in. | | 5.7 | 6.2 | | 8.9 | 6.7 | | 10.2 |
| Bulk Density | | 0.77 | 0.74 | | 0.78 | 0.78 | 0.74 | 0.70 |
| Moisture, wt. % | | 0.8 | 0.7 | | 0.9 | 0.8 | 0.6 | 0.6 |
| Ballistics for 100 gr. Sabot | | | | | | | | |
| Av velocity, fps | | | 1768 | | 1849 | 1893 | 1087 | 842 |
| SD velocity, fps | | | 40 | | 29 | 27 | 145 | 123 |
| Ignition | | | | | | | mf, hf | poor |
| Pressure, psi max. | | | 20400 | | 20400 | 26400 | 4100 | 3100 |
| Pressure, avg | | | 15500 | | 15100 | 17400 | 3000 | 2600 |
| RAW MATERIALS, wt. % | Chemical Formula | Ref 2901 | Ref 2926 | Ref 2957 | Ref 2960 | Ref 2961 | Ref 4087 | Ref 4088 |
| Charcoal | C | | | | | | | |
| Sulfur | S | | | | | | | |
| Dextrin | C6H10O5 | 5.8 | 5.8 | 10 | 6.8 | 6.8 | 5.8 | 5.8 |
| Sodium Benzoate | NaC7H5O2 | | 10.4 | | 9 | 8 | 13.1 | 10.5 |
| Potassium Nitrate | KNO3 | 41.7 | 40.2 | 27.4 | 25.9 | 26.4 | 35.4 | 37.15 |
| Potassium Perchlorate | KClO4 | 26 | 25 | 40.3 | 38.3 | 38.8 | 32 | 30.15 |
| Tricalcium Phosphate | Ca3(PO4)2 | 0.4 | 0.4 | 0.4 | 0.4 | 0.4 | 0.7 | 0.7 |
| Lactose | C12H22O11 | | | 21.9 | 19.6 | 19.6 | 13 | 15.7 |
| Sodium Salicylate | NaC7H5O3 | 21.2 | | | | | | |
| Sodium m-Nitrobenzoate | C7H4NO4Na | | 13.3 | | | | | |
| Dicyandiamide | C2H4N4 | 4.9 | 4.9 | | | | | |
| TOTAL | | 100 | 100 | 100 | 100 | 100 | 100 | 100 |
| Oxidizer % | | 67.7 | 65.2 | 67.7 | 64.2 | 65.2 | 67.4 | 67.3 |
| COMBUST PRODUCTS, wt. % | | | | | | | | |
| Ammonium Carbonate | (NH4)2CO3 | | | | | | | |
| Carbon Dioxide | CO2 | | 0.8 | | | | | |
| Carbon Monoxide | CO | | 29 | | | | | |
| Hydrogen Sulfide | H2S | | | | | | | |
| Methane | CH4 | | | | | | | |
| Nitrogen | N2 | | 9.8 | | | | | |
| Potassium Carbonate | K2CO3 | | 37.5 | | | | | |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | | 2.7 | | | | | |

TABLE 4-continued

White Powder Formulations

| | | | | | | | | |
|---|---|---|---|---|---|---|---|---|
| Sodium Carbonate | Na2CO3 | | | | | | | |
| Sodium Chloride | NaCl | | 8.4 | | | | | |
| Tricalcium Phosphate | Ca3(PO4)2 | | 0.4 | | | | | |
| Water | H2O | | 11.4 | | | | | |
| Ash or Unburned Carbon | | | | | | | | |
| TOTAL | | | 100 | | | | | |
| GASES, wt. % | | | 51 | | | | | |
| SOLIDS, wt. % | | | 49 | | | | | |
| PERFORMANCE FACTORS | | | | | | | | |
| Autoignition Temp, ° F. | | 700 | 840 | | 760 | 770 | | |
| Burn rate, secs/in. | | 9.2 | 7.9 | | 17 | 17.2 | | |
| Bulk Density | | 0.85 | 0.78 | | 0.81 | 0.82 | | |
| Moisture, wt. % | | 0.6 | 0.6 | | 0.7 | 0.6 | | |
| Ballistics for 100 gr. Sabot | | | | | | | | |
| Av velocity, fps | | 1519 | 1802 | | 1978 | 1934 | | |
| SD velocity, fps | | 28 | 25 | | 46 | 46 | | |
| Ignition | | ok | ok | | shf | shf | | |
| Pressure, psi max. | | 7000 | 14000 | | 18100 | 16300 | | |
| Pressure, avg | | 6400 | 12600 | | 14500 | 13000 | | |
| RAW MATERIALS, wt. % | Chemical Formula | Ref 4091 | Ref 4092 | Ref 4093 | Ref 4094 | Ref 4095 | Ref 4096 | Ref 4097 |
| Charcoal | C | | | | | | | |
| Sulfur | S | | | | | | | |
| Dextrin | C6H10O5 | 5.8 | 5.8 | 5.8 | 5.8 | 5.8 | 5.8 | 5.8 |
| Sodium Benzoate | NaC7H5O2 | 10.5 | 10.5 | 10.5 | 10.5 | 10.5 | 10.5 | 10.5 |
| Potassium Nitrate | KNO3 | 35.55 | 37.55 | 37.55 | 34.1 | 32.7 | 32.1 | 35.55 |
| Potassium Perchlorate | KClO4 | 32.15 | 30.15 | 30.15 | 34.0 | 34 | 34 | 30.15 |
| Tricalcium Phosphate | Ca3(PO4)2 | 0.3 | 0.3 | 0.3 | | 1.4 | 2 | 2.3 |
| Lactose | C12H22O11 | 15.7 | 15.7 | 15.7 | 15.6 | 15.6 | 15.6 | 15.7 |
| Sodium Salicylate | NaC7H5O3 | | | | | | | |
| Sodium m-Nitrobenzoate | C7H4NO4Na | | | | | | | |
| Dicyandiamide | C2H4N4 | | | | | | | |
| TOTAL | | 100 | 100 | 100 | 100 | 100 | 100 | 100 |
| Oxidizer % | | 67.7 | 67.7 | 67.7 | 68.1 | 66.7 | 66.1 | 65.7 |
| COMBUST PRODUCTS, wt. % | | | | | | | | |
| Ammonium Carbonate | (NH4)2CO3 | | | | | | | |
| Carbon Dioxide | CO2 | | | | | | | |
| Carbon Monoxide | CO | | | | | | | |
| Hydrogen Sulfide | H2S | | | | | | | |
| Methane | CH4 | | | | | | | |
| Nitrogen | N2 | | | | | | | |
| Potassium Carbonate | K2CO3 | | | | | | | |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | | | | | | | |
| Sodium Carbonate | Na2CO3 | | | | | | | |
| Sodium Chloride | NaCl | | | | | | | |
| Tricalcium Phosphate | Ca3(PO4)2 | | | | | | | |
| Water | H2O | | | | | | | |
| Ash or Unburned Carbon | | | | | | | | |
| TOTAL | | | | | | | | |
| GASES, wt. % | | | | | | | | |
| SOLIDS, wt. % | | | | | | | | |
| PERFORMANCE FACTORS | | | | | | | | |
| Autoignition Temp, ° F. | | | | | | | | |
| Burn rate, secs/in. | | 11.5 | 10.4 | | 10.7 | 9.7 | 8.2 | |
| Bulk Density | | 0.81 | 0.80 | | 0.82 | 0.80 | 0.82 | |
| Moisture, wt. % | | 0.8 | 0.7 | | 0.7 | 0.8 | 0.8 | |
| Ballistics for 100 gr. Sabot | | | | | | | | |
| Av velocity, fps | | 1902 | 1911 | | 1899 | 1856 | 1870 | |
| SD velocity, fps | | 30 | 6 | | 41 | 23 | 32 | |
| Ignition | | ok | ok | | ok | ok | ok | |
| Pressure, psi max. | | 15900 | 17600 | | 18800 | 15700 | 16800 | |
| Pressure, avg | | 14800 | 15900 | | 15800 | 14800 | 15200 | |
| RAW MATERIALS, wt. % | Chemical Formula | Ref 4127 | Ref 4146 | Ref 4171P | Ref 4175 | Ref 4176 | Ref 4177 | Ref 4179 |
| Charcoal | C | | | | | | | |
| Sulfur | S | | | | | | | |
| Dextrin | C6H10O5 | 5.8 | 7.8 | 5.8 | 6 | 5.8 | 5.8 | 5.8 |

TABLE 4-continued

White Powder Formulations

| | | | | | | | | |
|---|---|---|---|---|---|---|---|---|
| Sodium Benzoate | NaC7H5O2 | 10.5 | 12.7 | 17.5 | 14.4 | 12.2 | | |
| Potassium Nitrate | KNO3 | 35.1 | 34.1 | 37.6 | 49.4 | 36.3 | 41.7 | 36.7 |
| Potassium Perchlorate | KClO4 | 31 | 32 | 29 | 23.8 | 30 | 26 | 31 |
| Tricalcium Phosphate | Ca3(PO4)2 | 2 | 2 | 0.5 | 0.4 | 0 | 0.4 | 0.4 |
| Lactose | C12H22O11 | 15.6 | 11.4 | 9.6 | | 7.7 | | |
| Sodium Salicylate | NaC7H5O3 | | | | 6 | 6 | 26.1 | 21.2 |
| Sodium m-Nitrobenzoate | C7H4NO4Na | | | | | | | |
| Dicyandiamide | C2H4N4 | | | | | 2 | | 4.9 |
| TOTAL | | 100 | 100 | 100 | 100 | 100 | 100 | 100 |
| Oxidizer % | | 66.1 | 66.1 | 66.6 | 73.2 | 66.3 | 67.7 | 67.7 |
| COMBUST PRODUCTS, wt. % | | | | | | | | |
| Ammonium Carbonate | (NH4)2CO3 | | | | | | | |
| Carbon Dioxide | CO2 | | 6.6 | 0 | 13.7 | 0 | 6.2 | 8.3 |
| Carbon Monoxide | CO | | 26.6 | 32.2 | 15.6 | 32.2 | 26 | 23.1 |
| Hydrogen Sulfide | H2S | | | | | | | |
| Methane | CH4 | | | | | | | |
| Nitrogen | N2 | | 4.7 | 5.2 | 6.8 | 6.4 | 5.8 | 8.4 |
| Potassium Carbonate | K2CO3 | | 29.3 | 34.1 | 43.3 | 33 | 39.6 | 34.1 |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | | 10.7 | 6.5 | 2.5 | 7.2 | 2.1 | 6.9 |
| Sodium Carbonate | Na2CO3 | | | | | | | |
| Sodium Chloride | NaCl | | 5.1 | 7.1 | 8.1 | 7.1 | 9.4 | 7.6 |
| Tricalcium Phosphate | Ca3(PO4)2 | | 2 | 0.5 | 0.4 | 0 | 0.4 | 0.4 |
| Water | H2O | | 15 | 14.4 | 9.6 | 14.1 | 10.5 | 11.2 |
| Ash or Unburned Carbon | | | | | | | | |
| TOTAL | | | 100 | 100 | 100 | 100 | 100 | 100 |
| GASES, wt. % | | | 52.9 | 51.8 | 45.7 | 52.7 | 48.5 | 51 |
| SOLIDS, wt. % | | | 47.1 | 48.2 | 54.3 | 47.3 | 51.5 | 49 |
| PERFORMANCE FACTORS | | | | | | | | |
| Autoignition Temp, ° F. | | | | | 860 | | | |
| Burn rate, secs/in. | | 10.2 | 8.8 | 9.5 | 6.1 | | 5.7 | 11.1 |
| Bulk Density | | 0.80 | 0.80 | 0.89 | 0.76 | | 0.84 | 0.82 |
| Moisture, wt. % | | 0.75 | 0.8 | 0.9 | 0.8 | | 0.7 | 0.8 |
| Ballistics for 100 gr. Sabot | | | | | | | | |
| Av velocity, fps | | 1559 | 1685 | 1762 | 1711 | | 1594 | 1691 |
| SD velocity, fps | | 25 | 37 | 31 | 24 | | 13 | 22 |
| Ignition | | ok | ok | ok | ok | | ok | ok |
| Pressure, psi max. | | 9900 | 13700 | 14000 | 16200 | | 12900 | 15500 |
| Pressure, avg | | 8100 | 12100 | 13100 | 14900 | | 12400 | 14600 |
| | Chemical | Ref | Ref | Ref | Ref | Ref | Ref | Ref |
| RAW MATERIALS, wt. % | Formula | 4180 | 4181 | 4182 | 4183 | 4184 | 4185 | 4186 |
| Charcoal | C | | | | | | | |
| Sulfur | S | | | | | | | |
| Dextrin | C6H10O5 | 6 | 6 | 6.2 | 6.2 | 6.2 | 7 | 6 |
| Sodium Benzoate | NaC7H5O2 | | 16.4 | 18 | 16 | 19.6 | 16.4 | 17.4 |
| Potassium Nitrate | KNO3 | 43.7 | 49.4 | 48.1 | 48.1 | 46.7 | 49.4 | 49.4 |
| Potassium Perchlorate | KClO4 | 27.8 | 23.8 | 23.1 | 23.1 | 22.5 | 22.8 | 23.8 |
| Tricalcium Phosphate | Ca3(PO4)2 | 0.4 | 0.4 | 0.4 | 0.4 | 0.4 | 0.4 | 0.4 |
| Lactose | C12H22O11 | | | | | | | |
| Sodium Salicylate | NaC7H5O3 | 22.1 | 4 | 4.2 | 6.2 | 4.6 | 4 | 3 |
| Sodium m-Nitrobenzoate | C7H4NO4Na | | | | | | | |
| Dicyandiamide | C2H4N4 | | | | | | | |
| TOTAL | | 100 | 100 | 100 | 100 | 100 | 100 | 100 |
| Oxidizer % | | 71.5 | 73.2 | 71.2 | 71.2 | 69.2 | 72.2 | 73.2 |
| COMBUST PRODUCTS, wt. % | | | | | | | | |
| Ammonium Carbonate | (NH4)2CO3 | | | | | | | |
| Carbon Dioxide | CO2 | 17.9 | 12.7 | 5.5 | 6.7 | 0 | 9.3 | 12.1 |
| Carbon Monoxide | CO | 14 | 16.5 | 23.8 | 22.8 | 29 | 19.9 | 17.1 |
| Hydrogen Sulfide | H2S | | | | | | | |
| Methane | CH4 | | | | | | | |
| Nitrogen | N2 | 6.1 | 6.8 | 6.7 | 6.7 | 6.5 | 6.8 | 6.8 |
| Potassium Carbonate | K2CO3 | 39.4 | 43.3 | 43.3 | 43.1 | 43.1 | 43.3 | 43.3 |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | 4.6 | 2.5 | 1.1 | 1.3 | 0 | 1.9 | 2.5 |
| Sodium Carbonate | Na2CO3 | | | | | | | |

TABLE 4-continued

| White Powder Formulations | | | | | | | | |
|---|---|---|---|---|---|---|---|---|
| Sodium Chloride | NaCl | 8.1 | 8.1 | 8.9 | 8.7 | 9.6 | 8.1 | 8.1 |
| Tricalcium Phosphate | Ca3(PO4)2 | 0.4 | 0.4 | 0.4 | 0.4 | 0.4 | 0.4 | 0.4 |
| Water | H2O | 9.5 | 9.7 | 10.3 | 10.3 | 11 | 10.3 | 9.7 |
| Ash or Unburned Carbon | | | | | | 0.4 | | |
| TOTAL | | 100 | 100 | 100 | 100 | 100 | 100 | 100 |
| GASES, wt. % | | 47.5 | 45.7 | 46.3 | 46.5 | 46.5 | 46.3 | 45.7 |
| SOLIDS, wt. % | | 52.5 | 54.3 | 53.7 | 53.5 | 53.5 | 53.7 | 54.3 |
| PERFORMANCE FACTORS | | | | | | | | |
| Autoignition Temp, ° F. | | 760 | 860 | | | 860 | | |
| Burn rate, secs/in. | | 5.6 | 5.7 | 5.7 | 5.5 | 5.8 | 6.2 | 6.5 |
| Bulk Density | | 0.82 | 0.80 | 0.78 | 0.74 | 0.78 | 0.77 | 0.78 |
| Moisture, wt. % | | 0.75 | 0.75 | 0.75 | 0.7 | 0.8 | 0.8 | 0.9 |
| Ballistics for 100 gr. Sabot | | | | | | | | |
| Av velocity, fps | | 1630 | 1795 | 1813 | 1801 | 1729 | 1694 | 1690 |
| SD velocity, fps | | 13 | 39 | 22 | 120 | 38 | 36 | 34 |
| Ignition | | ok | ok | ok | ok | ok | ok | ok |
| Pressure, psi max. | | 15100 | 20000 | 21800 | 33500 | 19100 | 15900 | 13700 |
| Pressure, avg | | 14400 | 16500 | 19000 | 24300 | 16600 | 13900 | 13000 |
| RAW MATERIALS, wt. % | Chemical Formula | Ref 4187 | Ref 4186 | Ref 4187 | Ref 4188 | Ref 4189 | Ref 4191 | Ref 4193 |
| Charcoal | C | | | | | | | |
| Sulfur | S | | | | | | | |
| Dextrin | C6H10O5 | 4 | 6 | 4 | 6 | 6 | 6 | 6 |
| Sodium Benzoate | NaC7H5O2 | 22.8 | 17.4 | 22.8 | 20.8 | 15.8 | 22.8 | 15.8 |
| Potassium Nitrate | KNO3 | 52 | 49.4 | 52 | 52 | 52 | 50.6 | 50.6 |
| Potassium Perchlorate | KClO4 | 20.8 | 23.8 | 20.8 | 20.8 | 20.8 | 20.2 | 20.2 |
| Tricalcium Phosphate | Ca3(PO4)2 | 0.4 | 0.4 | 0.4 | 0.4 | 0.4 | 0.4 | 0.4 |
| Lactose | C12H22O11 | | | | | | | |
| Sodium Salicylate | NaC7H5O3 | | 3 | | | 5 | | 7 |
| Sodium m-Nitrobenzoate | C7H4NO4Na | | | | | | | |
| Dicyandiamide | C2H4N4 | | | | | | | |
| TOTAL | | 100 | 100 | 100 | 100 | 100 | 100 | 100 |
| Oxidizer % | | 72.8 | 73.2 | 72.8 | 72.8 | 72.8 | 70.8 | 70.8 |
| COMBUST PRODUCTS, wt. % | | | | | | | | |
| Ammonium Carbonate | (NH4)2CO3 | | | | | | | |
| Carbon Dioxide | CO2 | 5.2 | 12.1 | 5.2 | 7.4 | 10.2 | 0 | 4.6 |
| Carbon Monoxide | CO | 22.5 | 17.1 | 22.5 | 20.6 | 18.3 | 28.2 | 24.4 |
| Hydrogen Sulfide | H2S | | | | | | | |
| Methane | CH4 | | | | | | | |
| Nitrogen | N2 | 7.2 | 6.8 | 7.2 | 7.2 | 7.2 | 7 | 7 |
| Potassium Carbonate | K2CO3 | 45.9 | 43.3 | 45.9 | 45.6 | 45.2 | 44.7 | 44.8 |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | | 2.5 | | 0.4 | 0.8 | 0 | |
| Sodium Carbonate | Na2CO3 | 0.5 | | 0.5 | | | 0.5 | 0.2 |
| Sodium Chloride | NaCl | 8.7 | 8.1 | 8.7 | 8.4 | 8.1 | 8.6 | 8.6 |
| Tricalcium Phosphate | Ca3(PO4)2 | 0.4 | 0.4 | 0.4 | 0.4 | 0.4 | 0.4 | 0.4 |
| Water | H2O | 9.6 | 9.7 | 9.6 | 10 | 9.8 | 10.6 | 10 |
| Ash or Unburned Carbon | | | | | | | | |
| TOTAL | | 100 | 100 | 100 | 100 | 100 | 100 | 100 |
| GASES, wt. % | | 44.5 | 45.7 | 44.5 | 45.2 | 45.5 | 45.8 | 46 |
| SOLIDS, wt. % | | 55.5 | 54.3 | 55.5 | 54.8 | 54.5 | 54.2 | 54 |
| PERFORMANCE FACTORS | | | | | | | | |
| Autoignition Temp, ° F. | | 870 | | 870 | 870 | 830 | 850 | 825 |
| Burn rate, secs/in. | | 6.4 | 6.5 | 6.4 | 6.7 | 6.6 | 6.6 | 6.9 |
| Bulk Density | | 0.71 | 0.78 | 0.71 | 0.77 | 0.77 | 0.75 | 0.80 |
| Moisture, wt. % | | 0.85 | 0.9 | 0.85 | 0.85 | 0.7 | 0.75 | 0.9 |
| Ballistics for 100 gr. Sabot | | | | | | | | |
| Av velocity, fps | | 1562 | 1690 | 1562 | 1543 | 1643 | 1626 | 1647 |
| SD velocity, fps | | 50 | 34 | 50 | 20 | 18 | 37 | 31 |
| Ignition | | ok | ok | ok | ok | ok | ok | ok |
| Pressure, psi max. | | 12700 | 13700 | 12700 | 8600 | 14700 | 14000 | 12400 |
| Pressure, avg | | 11800 | 13000 | 11800 | 8300 | 13400 | 12100 | 11300 |
| RAW MATERIALS, wt. % | Chemical Formula | Ref 4195 | Ref 4198 | Ref 4199 | Ref 4200 | Ref 4203 | Ref 4205 | Ref 4206 |
| Charcoal | C | | | | | | | |
| Sulfur | S | | | | | | | |
| Dextrin | C6H10O5 | 6 | 6 | 6 | 8 | 8 | 6 | 6 |

TABLE 4-continued

| White Powder Formulations | | | | | | | | |
|---|---|---|---|---|---|---|---|---|
| Sodium Benzoate | NaC7H5O2 | 13.8 | 22.8 | 11.8 | 11.8 | 10.8 | 17.8 | 19.9 |
| Potassium Nitrate | KNO3 | 50.6 | 46.6 | 46.6 | 45.3 | 46.6 | 54.1 | 49.7 |
| Potassium Perchlorate | KClO4 | 20.2 | 24.2 | 24.2 | 23.5 | 24.2 | 21.7 | 24 |
| Tricalcium Phosphate | Ca3(PO4)2 | 0.4 | 0.4 | 0.4 | 0.4 | 0.4 | 0.4 | 0.4 |
| Lactose | C12H22O11 | | | | | | | |
| Sodium Salicylate | NaC7H5O3 | 9 | | 11 | 11 | 10 | | |
| Sodium m-Nitrobenzoate | C7H4NO4Na | | | | | | | |
| Dicyandiamide | C2H4N4 | | | | | | | |
| TOTAL | | 100 | 100 | 100 | 100 | 100 | 100 | 100 |
| Oxidizer % | | 70.8 | 70.8 | 70.8 | 68.8 | 70.8 | 75.8 | 73.7 |
| COMBUST PRODUCTS, wt. % | | | | | | | | |
| Ammonium Carbonate | (NH4)2CO3 | | | | | | | |
| Carbon Dioxide | CO2 | 5.5 | 8 | 1.9 | 3 | 9.3 | 18.7 | 12.1 |
| Carbon Monoxide | CO | 23.3 | 21.9 | 27.4 | 27.5 | 20.8 | 9.4 | 16.6 |
| Hydrogen Sulfide | H2S | | | | | | | |
| Methane | CH4 | | | | | | | |
| Nitrogen | N2 | 7 | 6.5 | 6.5 | 6.3 | 6.5 | 7.5 | 6.9 |
| Potassium Carbonate | K2CO3 | 44.7 | 42.4 | 42.8 | 41.3 | 41.5 | 45.2 | 43.7 |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | | 1.7 | 1.3 | 1.3 | 2.7 | 2.7 | 2.5 |
| Sodium Carbonate | Na2CO3 | 0.2 | | | | | | |
| Sodium Chloride | NaCl | 8.6 | 8.9 | 9.1 | 8.9 | 8.1 | 7.1 | 8.1 |
| Tricalcium Phosphate | Ca3(PO4)2 | 0.4 | 0.4 | 0.4 | 0.4 | 0.4 | 0.4 | 0.4 |
| Water | H2O | 10.3 | 10.2 | 10.6 | 11.3 | 10.7 | 9 | 9.7 |
| Ash or Unburned Carbon | | | | | | | | |
| TOTAL | | 100 | 100 | 100 | 100 | 100 | 100 | 100 |
| GASES, wt. % | | 46.1 | 46.6 | 46.4 | 48.1 | 47.3 | 44.6 | 45.3 |
| SOLIDS, wt. % | | 53.9 | 53.4 | 53.6 | 51.9 | 52.7 | 55.4 | 54.7 |
| PERFORMANCE FACTORS | | | | | | | | |
| Autoignition Temp, ° F. | | 820 | 850 | 780 | 740 | 760 | 900 | 910 |
| Burn rate, secs/in. | | 6.3 | 6.4 | 6.3 | 6.5 | 6.8 | 7.7 | 6.5 |
| Bulk Density | | 0.78 | 0.75 | 0.72 | 0.73 | 0.77 | 0.80 | 0.75 |
| Moisture, wt. % | | 0.85 | 0.9 | 0.7 | 0.75 | 0.75 | 0.8 | 0.75 |
| Ballistics for 100 gr. Sabot | | | | | | | | |
| Av velocity, fps | | 1626 | 1708 | 1665 | 1680 | 1712 | 1179 | 1639 |
| SD velocity, fps | | 16 | 22 | 60 | 87 | 80 | 111 | 39 |
| Ignition | | ok | ok | ok | ok | ok | ok | ok |
| Pressure, psi max. | | 14100 | 16200 | 22700 | 22300 | 23500 | 5700 | 15700 |
| Pressure, avg | | 12000 | 15000 | 16900 | 15100 | 15400 | n\a | 12100 |
| | Chemical | Ref | Ref | Ref | Ref | Ref | Ref | Ref |
| RAW MATERIALS, wt. % | Formula | 4207 | 4207A | 4207P | 4209 | 4212 | 4213 | 4214 |
| Charcoal | C | | | | | | | |
| Sulfur | S | | | | | | | |
| Dextrin | C6H10O5 | 6 | 6 | 6 | 6 | 8 | 6 | 6 |
| Sodium Benzoate | NaC7H5O2 | 20.9 | 20.9 | 20.9 | 21.9 | 19.9 | 21.9 | 23.9 |
| Potassium Nitrate | KNO3 | 46.7 | 46.7 | 46.7 | 43.7 | 45.7 | 41.7 | 41.7 |
| Potassium Perchlorate | KClO4 | 26 | 26 | 26 | 28 | 26 | 30 | 28 |
| Tricalcium Phosphate | Ca3(PO4)2 | 0.4 | 0.4 | 0.4 | 0.4 | 0.4 | 0.4 | 0.4 |
| Lactose | C12H22O11 | | | | | | | |
| Sodium Salicylate | NaC7H5O3 | | | | | | | |
| Sodium m-Nitrobenzoate | C7H4NO4Na | | | | | | | |
| Dicyandiamide | C2H4N4 | | | | | | | |
| TOTAL | | 100 | 100 | 100 | 100 | 100 | 100 | 100 |
| Oxidizer % | | 72.7 | 72.7 | 72.7 | 71.7 | 71.7 | 71.7 | 69.7 |
| COMBUST PRODUCTS, wt. % | | | | | | | | |
| Ammonium Carbonate | (NH4)2CO3 | | | | | | | |
| Carbon Dioxide | CO2 | 9.1 | 9.1 | | 6.9 | 7.4 | 7.4 | 0 |
| Carbon Monoxide | CO | 20.5 | 20.5 | | 23.2 | 22.6 | 23.3 | 30.5 |
| Hydrogen Sulfide | H2S | | | | | | | |
| Methane | CH4 | | | | | | | |
| Nitrogen | N2 | 6.5 | 6.5 | | 6.1 | 6.3 | 5.8 | 5.8 |
| Potassium Carbonate | K2CO3 | 41.7 | 41.7 | | 40.3 | 40.6 | 39 | 39.9 |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | 3.4 | 3.4 | | 3.8 | 3.8 | 4.8 | 2.7 |
| Sodium Carbonate | Na2CO3 | | | | | | | |

TABLE 4-continued

| White Powder Formulations | | | | | | | | |
|---|---|---|---|---|---|---|---|---|
| Sodium Chloride | NaCl | 8.4 | 8.4 | | 8.9 | 8.1 | 8.9 | 9.7 |
| Tricalcium Phosphate | Ca3(PO4)2 | 0.4 | 0.4 | | 0.4 | 0.4 | 0.4 | 0.4 |
| Water | H2O | 10 | 10 | | 10.4 | 10.8 | 10.4 | 11 |
| Ash or Unburned Carbon | | | | | | | | |
| TOTAL | | 100 | 100 | | 100 | 100 | 100 | 100 |
| GASES, wt. % | | 46.1 | 46.1 | | 46.6 | 47.1 | 46.9 | 47.3 |
| SOLIDS, wt. % | | 53.9 | 53.9 | | 53.4 | 52.9 | 53.1 | 52.7 |
| PERFORMANCE FACTORS | | | | | | | | |
| Autoignition Temp, ° F. | | 890 | | | 905 | 890 | | |
| Burn rate, secs/in. | | 5.8 | 6.4 | 6.2 | 6.1 | 7.2 | 6.1 | 5.8 |
| Bulk Density | | 0.86 | 0.82 | 0.82 | 0.80 | 0.86 | 0.80 | 0.80 |
| Moisture, wt. % | | 0.7 | 0.9 | 0.7 | 0.85 | 0.85 | 0.75 | 0.75 |
| Ballistics for 100 gr. Sabot | | | | | | | | |
| Av velocity, fps | | 1846 | 1824 | 1814 | 1818 | 1749 | 1890 | 1890 |
| SD velocity, fps | | 6 | 14 | 21 | 13 | 35 | 22 | 11 |
| Ignition | | ok | ok | ok | ok | ok | ok | ok |
| Pressure, psi max. | | 17700 | 15200 | 16800 | 18400 | 14400 | 20000 | 21300 |
| Pressure, avg | | 17100 | 14800 | 15900 | 17600 | 12900 | 19300 | 20800 |
| RAW MATERIALS, wt. % | Chemical Formula | Ref 4215 | Ref 4216 | Ref 4220 | Ref 4221 | Ref 4223 | Ref 4224 | Ref 4225 |
| Charcoal | C | | | | | | | |
| Sulfur | S | | | | | | | |
| Dextrin | C6H10O5 | 6 | 6 | 6 | 6 | 5.8 | 5.8 | 5.8 |
| Sodium Benzoate | NaC7H5O2 | 23.9 | 21.9 | 18.9 | 21.9 | 9.3 | 12.3 | 15.3 |
| Potassium Nitrate | KNO3 | 39.7 | 41.7 | 46.7 | 41.7 | 41.7 | 41.7 | 41.7 |
| Potassium Perchlorate | KClO4 | 30 | 28 | 26 | 28 | 26 | 26 | 26 |
| Tricalcium Phosphate | Ca3(PO4)2 | 0.4 | 0.4 | 0.4 | 0.4 | 0.4 | 0.4 | 0.4 |
| Lactose | C12H22O11 | | | 2 | 2 | | | |
| Sodium Salicylate | NaC7H5O3 | | | | | | | |
| Sodium m-Nitrobenzoate | C7H4NO4Na | | | | | 11.9 | 8.9 | 5.9 |
| Dicyandiamide | C2H4N4 | | 2 | | | 4.9 | 4.9 | 4.9 |
| TOTAL | | 100 | 100 | 100 | 100 | 100 | 100 | 100 |
| Oxidizer % | | 69.7 | 69.7 | 72.7 | 69.7 | 67.7 | 67.7 | 67.7 |
| COMBUST PRODUCTS, wt. % | | | | | | | | |
| Ammonium Carbonate | (NH4)2CO3 | | | | | | | |
| Carbon Dioxide | CO2 | 0 | 0.8 | 11.5 | 1.6 | 8.5 | 5.5 | 1.6 |
| Carbon Monoxide | CO | 31.1 | 28.9 | 18.3 | 29.1 | 21.4 | 24 | 27.3 |
| Hydrogen Sulfide | H2S | | | | | | | |
| Methane | CH4 | | | | | | | |
| Nitrogen | N2 | 5.5 | 7.1 | 6.5 | 5.8 | 9.9 | 9.7 | 9.5 |
| Potassium Carbonate | K2CO3 | 38.5 | 38.9 | 40.8 | 38.9 | 37.3 | 37.5 | 38 |
| Potassium Thiocyanate | KCNS | | | | | | | |
| Potassium Sulfate | K2SO4 | | | | | | | |
| Potassium Thiosulfate | K2S2O3 | | | | | | | |
| Potassium Sulfide | K2S, K2S2 | | | | | | | |
| Potassium Chloride | KCl | 3.8 | 3.8 | 4.4 | 3.8 | 4.6 | 4.4 | 3.8 |
| Sodium Carbonate | Na2CO3 | | | | | | | |
| Sodium Chloride | NaCl | 9.7 | 8.9 | 7.6 | 8.9 | 7.4 | 7.6 | 8.1 |
| Tricalcium Phosphate | Ca3(PO4)2 | 0.4 | 0.4 | 0.4 | 0.4 | 0.4 | 0.4 | 0.4 |
| Water | H2O | 11 | 11.2 | 10.5 | 11.5 | 10.5 | 10.9 | 11.3 |
| Ash or Unburned Carbon | | | | | | | | |
| TOTAL | | 100 | 100 | 100 | 100 | 100 | 100 | 100 |
| GASES, wt. % | | 47.6 | 48 | 46.8 | 48 | 50.3 | 50.1 | 49.7 |
| SOLIDS, wt. % | | 52.4 | 52 | 53.2 | 52 | 49.7 | 49.9 | 50.3 |
| PERFORMANCE FACTORS | | | | | | | | |
| Autoignition Temp, ° F. | | | | 885 | 875 | | | |
| Burn rate, secs/in. | | 5.9 | 7.9 | 7 | 6.3 | 8.2 | 8.1 | 10.1 |
| Bulk Density | | 0.78 | 0.75 | 0.79 | 0.79 | 0.83 | 0.78 | 0.83 |
| Moisture, wt. % | | 0.75 | 0.7 | 0.85 | 0.7 | 0.8 | 0.7 | 0.8 |
| Ballistics for 100 gr. Sabot | | | | | | | | |
| Av velocity, fps | | 1886 | 1812 | 1786 | 1895 | 1922 | 1845 | 1844 |
| SD velocity, fps | | 27 | 25 | 40 | 16 | 15 | 26 | 33 |
| Ignition | | ok | ok | ok | ok | ok | ok | ok |
| Pressure, psi max. | | 29200 | 19200 | 18600 | 25500 | 18800 | 19700 | 16900 |
| Pressure, avg | | 24600 | 18400 | 15600 | 23800 | 18300 | 16900 | 15400 |
| RAW MATERIALS, wt. % | | | | | Chemical Formula | Ref 4226 | Ref 4227 | Ref 7-63 |
| Charcoal | | | | | C | | | |
| Sulfur | | | | | S | | | |
| Dextrin | | | | | C6H10O5 | 6 | 6 | 6 |

TABLE 4-continued

| White Powder Formulations | | | | |
|---|---|---|---|---|
| Sodium Benzoate | NaC7H5O2 | 18.9 | 13.9 | 20.9 |
| Potassium Nitrate | KNO3 | 41.7 | 41.7 | 46.7 |
| Potassium Perchlorate | KClO4 | 28 | 28 | 26 |
| Tricalcium Phosphate | Ca3(PO4)2 | 0.4 | 0.4 | |
| Lactose | C12H22O11 | | | |
| Sodium Salicylate | NaC7H5O3 | | | |
| Sodium m-Nitrobenzoate | C7H4NO4Na | 5 | 10 | |
| Dicyandiamide | C2H4N4 | | | |
| TOTAL | | 100 | 100 | 100 |
| Oxidizer % | | 69.7 | 69.7 | 72.7 |
| COMBUST PRODUCTS, wt. % | | | | |
| Ammonium Carbonate | (NH4)2CO3 | | | |
| Carbon Dioxide | CO2 | 5.8 | 12.4 | |
| Carbon Monoxide | CO | 25.5 | 19.7 | |
| Hydrogen Sulfide | H2S | | | |
| Methane | CH4 | | | |
| Nitrogen | N2 | 6.1 | 6.5 | |
| Potassium Carbonate | K2CO3 | 39.2 | 38.7 | |
| Potassium Thiocyanate | KCNS | | | |
| Potassium Sulfate | K2SO4 | | | |
| Potassium Thiosulfate | K2S2O3 | | | |
| Potassium Sulfide | K2S, K2S2 | | | |
| Potassium Chloride | KCl | 3.4 | 4 | |
| Sodium Carbonate | Na2CO3 | | | |
| Sodium Chloride | NaCl | 9.2 | 8.7 | |
| Tricalcium Phosphate | Ca3(PO4)2 | 0.4 | 0.4 | |
| Water | H2O | 10.4 | 9.6 | |
| Ash or Unburned Carbon | | | | |
| TOTAL | | 100 | 100 | |
| GASES, wt. % | | 47.8 | 48.2 | |
| SOLIDS, wt. % | | 52.2 | 51.8 | |
| PERFORMANCE FACTORS | | | | |
| Autoignition Temp, ° F. | | | | |
| Burn rate, secs/in. | | 5.5 | 5.2 | |
| Bulk Density | | 0.80 | 0.77 | 0.86 |
| Moisture, wt. % | | 0.75 | 0.8 | 1 |
| Ballistics for 100 gr. Sabot | | | | |
| Av velocity, fps | | 1918 | 1964 | 1831 |
| SD velocity, fps | | 16 | 41 | 29 |
| Ignition | | ok | ok | ok |
| Pressure, psi max. | | 28200 | 37000 | 18800 |
| Pressure, avg | | 23000 | 31500 | 16600 |

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth is to be interpreted as illustrative and not in a limiting sense.

Having thus described our invention, we claim:

1. A white propellant composition free of elemental sulfur and elemental carbon, said composition consisting of a fuel agent select from the group consisting sodium benzoate and sodium m-nitrobenzoate and mixtures thereof, dextrin, present in the range of 4 to 8 percent by weight, potassium nitrate, potassium perchlorate and tricalcium phosphate present in the range of 0.1 to 0.7 percent by weight.

2. The propellant composition as in claim 1, said fuel agent present in the range of 17 to 25 percent by weight.

3. The propellant composition as in claim 2, said fuel agent present in the range of 19 to 23 percent by weight.

4. The propellant composition as in claim 2 with potassium nitrate present in the range of 42 to 52 percent by weight and potassium perchlorate present in the range of 21 to 31 percent by weight.

5. The propellant composition as in claim 4, said fuel agent present in the range of 19 to 23 percent by weight; dextrin present in the range of 5.5 to 6.5 percent by weight; potassium nitrate present in the range of 45 to 49 percent by weight; potassium perchlorate present in the range of 24 to 28 percent by weight; and tricalcium phosphate present in the range of 0.3 to 0.5 percent by weight.

6. The propellant composition as in claim 1, said fuel agent consisting of sodium benzoate present in the range of 17 to 25 percent by weight; dextrin present in the range of 4 to 8 percent by weight; potassium nitrate present in the range of 42 to 52 percent by weight; potassium perchlorate present in the range of 21 to 31 percent by weight; and tricalcium phosphate present in the range of 0.1 to 0.7 percent by weight.

7. The propellant composition as in claim 6 with sodium benzoate present in the range of 19 to 23 percent by weight; dextrin present in the range of 5.5 to 6.5 percent by weight; potassium nitrate present in the range of 45 to 49 percent by weight; potassium perchlorate present in the range of 24 to 28 percent by weight; and tricalcium phosphate present in the range of 0.3 to 0.5.

8. A white propellant composition free of elemental sulfur and elemental carbon, said composition consisting of a fuel agent select from the group consisting sodium benzoate and sodium m-nitrobenzoate and mixtures thereof, dextrin, potassium nitrate, potassium perchlorate, tricalcium phosphate, and dicyanodiamide.

9. The propellant composition as in claim 8, said fuel agent present in the range of 17 to 25 percent by weight.

10. The propellant composition as in claim 9, said fuel agent present in the range of 19 to 23 percent by weight.

11. The propellant composition as in claim 9 with potassium nitrate present in the range of 42 to 52 percent by weight; potassium perchlorate present in the range of 21 to 31 percent by weight; and dicyanodiamide present in the range of 0 to 5 percent by weight.

12. The propellant composition as in claim 11, said fuel agent present in the range of 19 to 23 percent by weight; dextrin present in the range of 5.5 to 6.5 percent by weight; potassium nitrate present in the range of 45 to 49 percent by weight; potassium perchlorate present in the range of 24 to 28 percent by weight; tricalcium phosphate present in the range of 0.3 to 0.5 percent by weight; and dicyanodiamide present in the range of 0 to 5 percent by weight.

13. The propellant composition as in claim 8, said fuel agent consisting of sodium benzoate present in the range of 17 to 25 percent by weight; dextrin present in the range of 4 to 8 percent by weight; potassium nitrate present in the range of 42 to 52 percent by weight; potassium perchlorate present in the range of 21 to 31 percent by weight; tricalcium phosphate present in the range of 0.1 to 0.7 percent by weight; and dicyanodiamide present in the range of 0 to 5 percent by weight.

14. The propellant composition as in claim 13 with sodium benzoate present in the range of 19 to 23 percent by weight; dextrin present in the range of 5.5 to 6.5 percent by weight; potassium nitrate present in the range of 45 to 49 percent by weight; potassium perchlorate present in the range of 24 to 28 percent by weight; tricalcium phosphate present in the range of 0.3 to 0.5; and dicyanodiamide present in the range of 0 to 5 percent by weight.

* * * * *